US011196154B2

(12) United States Patent
Mizuno et al.

(10) Patent No.: US 11,196,154 B2
(45) Date of Patent: Dec. 7, 2021

(54) ANTENNA DEVICE

(71) Applicant: YOKOWO CO., LTD., Tokyo (JP)

(72) Inventors: Hirotoshi Mizuno, Tomioka (JP); Masayuki Goto, Tomioka (JP); Kazuhiro Kowaita, Tomioka (JP)

(73) Assignee: YOKOWO CO., LTD., Tokyo (JP)

( * ) Notice: Subject to any disclaimer, the term of this patent is extended or adjusted under 35 U.S.C. 154(b) by 74 days.

(21) Appl. No.: 16/323,347

(22) PCT Filed: Sep. 11, 2017

(86) PCT No.: PCT/JP2017/032631
§ 371 (c)(1),
(2) Date: Feb. 5, 2019

(87) PCT Pub. No.: WO2018/074099
PCT Pub. Date: Apr. 26, 2018

(65) Prior Publication Data

US 2019/0393596 A1 Dec. 26, 2019

(30) Foreign Application Priority Data

Oct. 21, 2016 (JP) ..... JP2016-207361

(51) Int. Cl.
*H01Q 1/32* (2006.01)
*H01Q 1/52* (2006.01)
(Continued)

(52) U.S. Cl.
CPC ..... *H01Q 1/521* (2013.01); *H01Q 1/3275* (2013.01); *H01Q 5/30* (2015.01); *H01Q 9/06* (2013.01)

(58) Field of Classification Search
CPC .... H01Q 1/521; H01Q 1/3275; H01Q 1/1214; H01Q 1/42; H01Q 5/30; H01Q 9/06; H01Q 9/40; H01Q 9/0407; H01Q 21/28
See application file for complete search history.

(56) References Cited

U.S. PATENT DOCUMENTS 9,178,272 B2 * 11/2015 Chakam ..... H01Q 9/0407
2010/0013724 A1 1/2010 Ohshima et al.
(Continued)

FOREIGN PATENT DOCUMENTS

CN 105337015 A 2/2016
JP H05-145324 A 6/1993
(Continued)

OTHER PUBLICATIONS

Search Report (with partial translation) and Written Opinion dated Oct. 24, 2017, issued in corresponding International Application No. PCT/JP2017/032631.
(Continued)

*Primary Examiner* — Awat M Salih
(74) *Attorney, Agent, or Firm* — Morgan, Lewis & Bockius LLP

(57) ABSTRACT

In an antenna device, when an AM/FM antenna as a first antenna and an SDARS antenna or a GPS antenna as a second antenna that have different frequency bands are provided in a common case, an additional conductor portion extends out from a conductor main body portion of a capacitive element, and the additional conductor portion includes a parallel strip-shaped portion having a length that is ¼ of an effective wavelength in a frequency band of the second antenna, and extending parallel to the conductor main body portion.

20 Claims, 47 Drawing Sheets

(51) Int. Cl.
*H01Q 5/30* (2015.01)
*H01Q 9/06* (2006.01)

(56) References Cited

U.S. PATENT DOCUMENTS

| | | | | |
|---|---|---|---|---|
| 2012/0223862 | A1* | 9/2012 | Kerselaers | H01Q 1/3275 343/700 MS |
| 2015/0054706 | A1* | 2/2015 | Shimura | H01Q 1/243 343/843 |
| 2016/0036121 | A1 | 2/2016 | Hayashi et al. | |
| 2016/0315378 | A1* | 10/2016 | Kiriyama | H01Q 9/36 |
| 2018/0053992 | A1* | 2/2018 | Mizutani | H01Q 1/22 |
| 2018/0069326 | A1 | 3/2018 | Van Gils et al. | |
| 2018/0241118 | A1* | 8/2018 | Jeong | H01Q 9/0407 |
| 2018/0261913 | A1* | 9/2018 | Imamura | H01Q 1/3275 |

FOREIGN PATENT DOCUMENTS

| | | | |
|---|---|---|---|
| JP | 2009-135741 | A | 6/2009 |
| JP | 4992762 | B2 | 5/2012 |
| JP | 2018-515042 | A | 6/2018 |
| KR | 101622170 | B1 | 5/2016 |
| WO | 2016/018073 | A1 | 2/2016 |
| WO | 2016/180733 | A1 | 11/2016 |

OTHER PUBLICATIONS

Office Action dated Jul. 6, 2020, issued in corresponding Japanese Patent Application No. 2016-207361A.
Office Action dated Sep. 11, 2020, issued in corresponding Chinese Patent Application No. 201780048584.1.

* cited by examiner 2332.5[MHz]
2338.75[MHz]
2345[MHz]

MEASUREMENT MODEL ELEVATION ANGLE 40°

2332.5[MHz]
2338.75[MHz]
2345[MHz]

MEASUREMENT MODEL ELEVATION ANGLE 60°

REFERENCE MODEL ELEVATION ANGLE 20°

2332.5[MHz]
2338.75[MHz]
2345[MHz]

REFERENCE MODEL ELEVATION ANGLE 40°

REFERENCE MODEL ELEVATION ANGLE 60°

STANDARD MODEL ELEVATION ANGLE 20°

STANDARD MODEL ELEVATION ANGLE 60°

SDARS GROUND WAVE RIPPLE (ELEVATION ANGLE 0°)

ANTENNA DEVICE

TECHNICAL FIELD

The present invention relates to an antenna device which includes two or more antennas in a common case and is suitable for vehicle.

BACKGROUND ART

As a medium accommodated in a case of a conventional antenna device for vehicle, an AM/FM antenna (antenna for AM and FM broadcasting), a telephone antenna (3G or 4G), a GNSS (Global Navigation Satellite System: a collective term including GPS, GLONASS, GALILEO, and the like), an SDARS (Satellite Digital Audio Radio Service: a collective term including XM and Sirius), a DAB (Digital Audio Broadcasting mainly adopted in the European region), or an antenna for a highway traffic system such as ITS or DSRC is adopted, and the use thereof is expected to increase in the future.

In general, the performance required for a mobile antenna is omnidirectional in a horizontal plane, and the above-described respective antennas should be configured in a limited space of a case. Therefore, it is necessary that an internal configuration (layout) of the mobile antenna is made in consideration of structures (sizes depending on wavelengths) of antenna elements to be incorporated and an influence of interference between the antenna elements.

In particular, as a satellite receiving antenna such as GNSS or SDARS antenna, directivity in an elevation angle direction is required, and an antenna is arranged in a space defined by an appearance design of an antenna device. Therefore, a small-sized antenna is required, and a planar antenna (patch antenna) is used. It is desirable that a directional characteristic of this patch antenna be omnidirectional (no distortion or deviation in directivity). When the patch antenna is combined with another antenna, an antenna layout needs to be made such that the patch antenna can coexist with another medium in a limited space without having an influence on directional characteristics of the patch antenna. At this time, it is essential that characteristics of the other medium are not deteriorated.

Currently, a layout in which antennas and another medium are separated from each other (a certain distance is provided) is necessary. In particular, a shark fin-shaped antenna device that is required to be integrated with an AM/FM antenna has a problem in size reduction for the integration.

In a general medium alignment in the shark fin-shaped antenna device, a satellite receiving antenna such as SDARS or GNSS that has a short height and an AM/FM antenna that is required to have a tall height are arranged in this order from the front side of the antenna device. Therefore, the size of the antenna device in a length direction is required. The reason why the SDARS or GNSS antenna is not arranged immediately below the AM/FM element is that, since the SDARS or GNSS antenna is a satellite receiving antenna, an antenna characteristic that improves a gain in a high elevation angle (overhead) direction is required.

FIGS. 36A to 36E illustrate an example of a conventional shark fin-shaped antenna device when an SDARS antenna or a GPS antenna (one example of a GNSS antenna) is arranged in front of an AM/FM antenna. Here, a thin side of a capacitively loaded plate 31 as a capacitive element described later is set as the front side of the antenna device, for convenience of description, a view illustrating the antenna device when seen from the rear side is set as a front view, a side surface on the left side when the antenna device is seen from the rear side is set as a left side surface, and a side surface on the right side when the antenna device is seen from the rear side is set as a right side surface. In addition, a front-rear direction may be expressed as a length direction, an up-down direction may be expressed as a height direction, and a left-right direction may be expressed as a width direction. FIG. 36A is a left side view of the example of the related art. FIG. 36B is a perspective view illustrating a standard model in which the AM/FM antenna of the example of the related art and an SDARS antenna or a GPS antenna are arranged on a ground plane (ground conductor). FIG. 36C is a rear view illustrating the standard model (when the antenna device is seen from the front side). FIG. 36D is a right side view illustrating the standard model. FIG. 36E is a diagram explaining the dimension (unit: mm) of each of portions of the standard model. FIGS. 36A and 36C illustrate the front, rear, up, down, left, and right sides of the antenna device.

As illustrated in these drawings, in the example of the related art of the antenna device, an exterior case 5 includes: a base 10; and a shark fin-shaped cover 20 that covers the base 10. In an internal space between the base 10 and the cover 20, an AM/FM antenna 30 and an SDARS antenna 40 or a GPS antenna 50 positioned in front of the AM/FM antenna 30 are accommodated. On the base 10, a circuit board 60 where an amplifier amplifying a received signal of the AM/FM antenna 30 and the like are mounted is fixed.

The AM/FM antenna 30 includes: the capacitively loaded plate 31; and a coil element 32 of which one end (upper end) is connected to the capacitively loaded plate 31. The capacitively loaded plate 31 is supported in the vicinity of a ceiling of the cover 20, and the other end (lower end) of the coil element 32 is connected to the circuit board 60.

The SDARS antenna 40 or the GPS antenna 50 is fixed to the base 10 in front of the AM/FM antenna 30. The SDARS antenna 40 is a patch antenna, and the external shape thereof has a size of 18 mm (length)×18 mm (width) and a thickness of 4 mm. The GPS antenna 50 is a patch antenna, and the external shape thereof has a size of 20 mm (length)×20 mm (width) and a thickness of 4 mm.

When a length, a maximum height, and a maximum width of the capacitively loaded plate 31 of the AM/FM antenna 30 are denoted by L1, T, and W1, respectively, as illustrated in FIG. 36E, L1 is 89 mm, T is 24 mm, and W1 is 21 mm. Measurement data described later is obtained using the standard model in which the AM/FM antenna 30, and the SDARS antenna 40 or the GPS antenna 50 are arranged on the ground plane 70 corresponding to the vehicle roof as illustrated in FIGS. 36B to 36D. A height H of the capacitively loaded plate 31 on the ground plane 70 is 34.9 mm, a separation distance G1 between the capacitively loaded plate 31 and the SDARS antenna 40 (or the GPS antenna 50) in a front-rear direction (horizontal direction) along the ground plane 70 is 10.3 mm, and a separation distance G2 between the capacitively loaded plate 31 and the SDARS antenna 40 (or the GPS antenna 50) in a height direction perpendicular to the ground plane 70 is 26.2 mm.

FIG. 37 is a diagram explaining an antenna measurement system, in which three orthogonal axes X, Y, and Z are defined around an antenna which is a measurement target, an XY plane is defined as a horizontal plane, an axis perpendicular to the XY plane is defined as a Z axis, and an azimuth angle cp of a measurement point P is defined as a counter-clockwise angle of a position P' from the X axis which is set to 0°, the position P' being a position of a vertical line extended from the measurement point P to the XY plane. An elevation angle θ is an angle between the XY plane and the measurement point P, which is 0° on the XY plane and 90° in a Z axis direction. In the SDARS or GPS antenna, a characteristic in which the azimuth angle φ on the horizontal plane (XY plane) is 0° to 360° at intervals of a predetermined angle θ (elevation angle) is required.

In the standard model illustrated in FIG. 36B, the SDARS antenna 40 (or the GPS antenna 50) as a patch antenna, the capacitively loaded plate 31 and the coil element 32 are provided on the ground plane 70, and the three orthogonal axes X, Y, and Z are defined as illustrated in the drawing. The XY plane is positioned on the ground plane 70, the X axis is a front-rear direction of the capacitively loaded plate 31 (the rear direction is +), the Y axis is a left-right direction of the capacitively loaded plate 31, and the Z axis is a direction perpendicular to the ground plane 70.

FIG. 38 is a diagram explaining a reference model (having desired antenna characteristics) of the SDARS antenna alone as a patch antenna, in which the SDARS antenna 40 as a patch antenna is provided alone on the ground plane 70, and the three orthogonal axes X, Y, and Z are defined as illustrated in the drawing. The XY plane is positioned on the ground plane 70, and the Z axis is a direction perpendicular to the ground plane 70.

FIG. 39 illustrates the reference model of FIG. 38 and is a directivity characteristic diagram illustrating a relationship between an azimuth angle (φ=0° to 360°) and a circular polarization gain (dBic) at an elevation angle of 20° in an SDARS frequency band of 2332.5 MHz to 2345 MHz. FIG. 40 is a directivity characteristic diagram illustrating a case where the elevation angle is 40° under the same conditions. FIG. 41 is a directivity characteristic diagram illustrating a case where the elevation angle is 60° under the same conditions.

FIG. 42 illustrates the standard model (the dimensional relationship is as illustrated in FIG. 36E) of FIG. 36B and is a directivity characteristic diagram illustrating a relationship between an azimuth angle and a circular polarization gain (dBic) at an elevation angle of 20° in an SDARS frequency band of 2332.5 MHz to 2345 MHz. FIG. 43 is a directivity characteristic diagram illustrating a case where the elevation angle is 40° under the same conditions. FIG. 44 is a directivity characteristic diagram illustrating a case where the elevation angle is 60° under the same conditions. In the standard model illustrated in FIGS. 42 to 44, as compared to the reference model illustrated in FIG. 39 to FIG. 41, distortion occurs in horizontal plane directivity to deteriorate the horizontal plane directivity, and a variation in gain (dBic) increases.

FIG. 45 is a graph illustrating a relationship between an elevation angle and an average gain at a frequency of 2332.5 MHz in the reference model of the SDARS antenna alone, and the standard model in which the distance between the capacitively loaded plate of the AM/FM antenna and the SDARS antenna in the horizontal direction (G1 in FIGS. 36A and 36E) is 0 mm to 64 mm {64 mm≅λ/2, wherein $\lambda=\lambda_{SDARS}$ (wavelength at 2332.5 MHz≅128 mm)}. An elevation angle of 0° represents a linear polarization average gain with respect to SDARS ground waves, and an elevation angle of 20° to 60° represents a circular polarization average gain with respect to SDARS satellite waves. Here, the average gain refers to an average value of gain values measured at an azimuth angle φ of 0° to 360° in a measurement plane as a target. An elevation angle required for ground waves of the SDARS antenna is "elevation angle of 0°", and an elevation angle required for satellite waves of the SDARS antenna is "elevation angle of 20° to 60°". FIG. 46 is a graph illustrating a relationship between an elevation angle and an average gain at a frequency of 2338.75 MHz under the same conditions. FIG. 47 is a graph illustrating a relationship between an elevation angle and an average gain at a frequency of 2345 MHz under the same conditions. As illustrated in FIGS. 45 to 47, as the elevation angle increases, a decrease in the average gain of the standard model is more significant than that of the reference model.

FIG. 48 is a graph illustrating a relationship between an elevation angle and a minimum circular polarization gain (dBic) at a frequency of 2332.5 MHz in the reference model of the SDARS antenna alone, and the standard model in which the distance G1 between the capacitively loaded plate of the AM/FM antenna and the SDARS antenna in the horizontal direction is 0 mm to 64 mm. A minimum gain with respect to satellite waves in an elevation angle range of 20° to 60° is measured. Here, the minimum gain refers to a minimum value among gain values measured at an azimuth angle φ of 0° to 360° in a measurement plane as a target. FIG. 49 is a graph illustrating a relationship between an elevation angle and a minimum gain at a frequency of 2338.75 MHz under the same conditions. FIG. 50 is a graph illustrating a relationship between an elevation angle and a minimum gain at a frequency of 2345 MHz under the same conditions. As illustrated in FIGS. 48 to 50, the minimum gain of the reference model of the SDARS antenna alone is the highest. When the distance G1 between the capacitively loaded plate and the SDARS antenna is 0 mm, the minimum gain is the lowest. As the distance G1 increases, a decrease in gain is reduced as compared to that of the reference model.

FIG. 51 is a graph illustrating a ripple (maximum gain-minimum gain) at an elevation angle of 0° (ground wave reception) in each frequency band of 2332.50 MHz to 2345.00 MHz. The ripple of the reference model of the SDARS antenna alone is the lowest. When the distance G1 between the capacitively loaded plate and the SDARS antenna is 0 mm, the ripple is the highest. As the distance G1 between the capacitively loaded plate and the SDARS antenna increases, the ripple decreases and approaches that of the reference model.

FIG. 52 illustrates a relationship between an elevation angle and an average gain at a frequency of 1575.42 MHz in a reference model of the GPS antenna alone, and the standard model of FIG. 36B (the GPS antenna is arranged), in which the reference model of the GPS antenna alone and the standard model in which the distance G1 between the capacitively loaded plate and the GPS antenna in the horizontal direction is 0 mm to 95 mm {95 mm≅λ/2, wherein $\lambda=\lambda_{GPS}$ (wavelength at 1575.42 MHz≅190 mm)} are compared to each other. An elevation angle required for the GPS antenna is "elevation angle of 10° to 90°". Even in this case, the average gain of the reference model of the GPS antenna alone is the highest. When the distance G1 between the capacitively loaded plate and the GPS antenna is 0 mm, the average gain is the lowest. As the distance G1 increases, a decrease in gain is reduced as compared to that of the reference model.

Based on the measurement results of FIGS. 45 to 52, it can be said that, in particular, in the SDARS antenna, a decrease in the minimum gain of satellite waves is significant and distortion occurs in directivity. When the performance of the reference model of the SDARS antenna alone and the GPS antenna alone is set as a target, in order to obtain equivalent performance to that of the reference model, it is necessary that the distance between the antennas is 64 mm ($\lambda_{SDARS}/2$) or longer in the SDARS antenna and is 95 mm ($\lambda_{GPS}/2$) or longer in the GPS antenna, and antenna characteristics depend on the distance (wavelength) between the antennas.

FIGS. 53A to 53C illustrate an electric field distribution in the capacitively loaded plate 31 of the AM/FM antenna when a radio wave (left circularly polarized wave) in an SDARS band is transmitted from the SDARS antenna 40 in the standard model in which the AM/FM antenna 30 and the SDARS antenna 40 are combined. Bright portions (light-colored portions) in a frame of a right side view of FIG. 53A and in a frame of a front view of FIG. 53B are portions having a high electric field. When the portion having a high electric field is present in the capacitively loaded plate 31 as described above, there is an influence on radiation of the SDARS antenna 40. That is, plural radiation sources present in the antenna cause the occurrence of deviation in directivity. The intensity of the electric field distribution depends on the distance (wavelength $\lambda$) between the antennas. Therefore, the equivalent performance to that of reference model can be obtained by adjusting the distance to be $\lambda/2$ or longer because the distribution is weakened. In the left side view of FIG. 53C, a portion having a high electric field is not present.

In addition, FIGS. 54A to 54C illustrate an electric field distribution in the capacitively loaded plate 31 of the AM/FM antenna when a radio wave (right circularly polarized wave) in a GPS band is transmitted from the GPS antenna 50 in the standard model in which the AM/FM antenna 30 and the GPS antenna 50 are combined. A bright portion (light-colored portion) in the frame of a left side view of FIG. 54C is a portion having a high electric field. Even in this case, when the portion having a high electric field is present in the capacitively loaded plate 31, there is an influence on radiation of the GPS antenna 50. That is, plural radiation sources present in the antenna cause the occurrence of deviation in directivity. In a rear view of FIG. 54A (view when the antenna device is seen from the front side) and a right side view of FIG. 54B, a portion having a high electric field is not present.

CITATION LIST

Patent Literature

[Patent Literature 1]: Japanese Patent No. 4992762

Patent Literature 1 discloses an on-vehicle integrated antenna which includes a plurality of antennas having frequency bands different from each other.

SUMMARY OF THE INVENTION

Technical Problem

Recently, an antenna device for vehicle called a shark fin antenna has been developed. In this antenna device for vehicle, it is necessary that plural kinds of antennas are incorporated within a limited internal space of a case. Even in this case, it is desired that deterioration in antenna electrical characteristics caused by interference between the incorporated antennas is small such that excellent antenna electrical characteristics can be maintained.

However, in the configuration of the example of the related art, when plural antennas are provided in a limited internal space of a case, the distance between the antennas is not sufficient, and there is a problem in that the antenna performance such as directivity is adversely affected. On the other hand, if the distance between the antennas in the case increases, the size of the case increases, which causes a problem in reduction in size, and thus the above-described demand cannot be satisfied.

The present invention has been made in consideration of the above-described circumstances, and an object thereof is to provide an antenna device in which, when plural antennas are provided in a common case, mutual interference between the antennas is reduced, thereby reducing the size while maintaining excellent antenna performance.

Solution to Problem

An aspect of the present invention relates to an antenna device. This antenna device includes a first antenna and a second antenna that are provided in a common case and have different frequency bands, in which an additional conductor portion extends out from a conductor main body portion of the first antenna, and the additional conductor portion includes a predetermined-length portion extending at a distance along an edge of the conductor main body portion and having a predetermined length corresponding to a frequency band of the second antenna.

In the aspect, the predetermined-length portion of the additional conductor portion may be arranged to correspond to a region having a high electric field of the conductor main body portion in the frequency band of the second antenna.

In the aspect, the predetermined-length portion of the additional conductor portion may have a length that is substantially ¼ of an effective wavelength in the frequency band of the second antenna.

In the aspect, a separation distance between the first antenna and the second antenna in a horizontal direction may be substantially within ½ of a wavelength in the frequency band of the second antenna.

In the aspect, the second antenna may be omnidirectional in a horizontal plane, and a difference between a maximum gain and a minimum gain of the second antenna at a predetermined elevation angle may be small as compared with a case where the additional conductor portion is not present.

The antenna device according to the aspect may further include a third antenna that is provided in the case, in which the third antenna may have a frequency band different from the frequencies of the first antenna and the second antenna, another additional conductor portion may extend out from the conductor main body portion, and said another additional conductor portion may include a predetermined-length portion extending at a distance along an edge of the conductor main body portion and having a predetermined length corresponding to the frequency band of the third antenna.

The predetermined-length portion of said another additional conductor portion may be arranged to correspond to a region having a high electric field of the conductor main body portion in the frequency band of the third antenna.

The predetermined-length portion of said another additional conductor portion may have a length that is substantially ¼ of an effective wavelength in the frequency band of the third antenna.

A separation distance between the first antenna and the third antenna in a horizontal direction may be substantially within ½ of a wavelength in the frequency band of the third antenna.

The third antenna may be omnidirectional in a horizontal plane, and a difference between a maximum gain and a minimum gain of the third antenna at a predetermined elevation angle may be small as compared with a case where the additional conductor portion is not present.

In the aspect, the additional conductor portion may be a separate component from the conductor main body portion and may be fixed to or integrated with the conductor main body portion.

In the aspect, the first antenna may be an AM/FM antenna, and a capacitive element of the AM/FM antenna may include the conductor main body portion and the additional conductor portion.

Any combinations of the above-described components and an expression of the present invention that are converted between a method, a system, and the like are also effective aspects of the present invention.

Advantageous Effects of the Invention

With the antenna device according to the present invention, when plural antennas are provided in a common case, the influence of interference caused by closeness of the antennas can be reduced. Therefore, the distance between the antennas can be reduced while maintaining excellent antenna characteristics (directivity and gain), thereby reducing the size of the antenna device.

DESCRIPTION OF EMBODIMENTS

Figure 1:
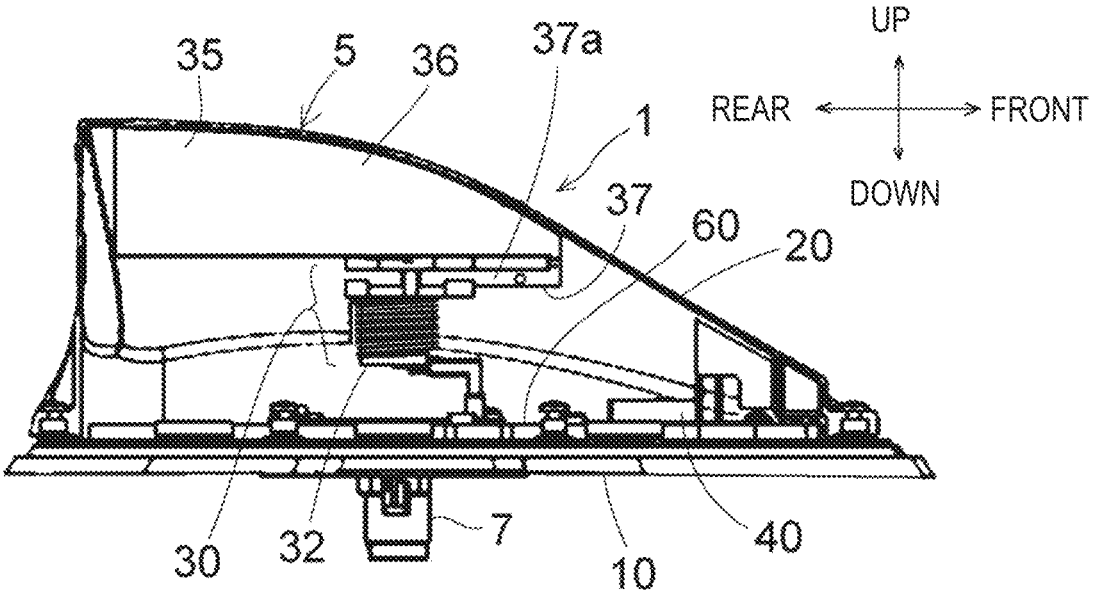
FIG. 1 is a right side cross-sectional view illustrating a structure of Embodiment 1 (case where an SDARS antenna is arranged in front of an AM/FM antenna) of an antenna device according to the present invention.

Hereinafter, preferable embodiments of the present invention will be described in detail with reference to the drawings. Identical or equivalent components, members, processes, and the like illustrated in each of the drawings are denoted by the same reference numerals, and the description thereof will be omitted. In addition, the embodiments are merely exemplary without limiting the present invention, and all the characteristics of the embodiments and combinations thereof are necessarily essential to the present invention.

Embodiment 1

FIG. 1 illustrates Embodiment 1 of an antenna device according to the present invention where an SDARS antenna as a second antenna is arranged in front of an AM/FM antenna as a first antenna. In an antenna device 1, the AM/FM antenna 30 and an SDARS antenna 40 are accommodated in an internal space surrounded by an exterior case 5 which is constituted by a base 10 and a cover 20 covering the base 10 (for example, having a shark fin-shape). On the base 10, a circuit board 60 where an amplifier amplifying a received signal of the AM/FM antenna 30 and the like are mounted is fixed. The AM/FM antenna 30 includes: a capacitively loaded plate 35 as a capacitive element; and a coil element 32 of which one end (upper end) is connected to the capacitively loaded plate 35. The capacitively loaded plate 35 is supported in the vicinity of a ceiling (an upper side) of the cover 20, and the other end (lower end) of the coil element 32 is connected to the circuit board 60. The SDARS antenna 40 is fixed to the base 10 in front of the AM/FM antenna 30. The SDARS antenna 40 is a patch antenna. A hollow attachment bracket 7 that is attached through a vehicle roof is fixed to a bottom surface of the base 10, and cables (not illustrated in the drawing) for inputting received/transmitted signals of the AM/FM antenna 30 and the SDARS antenna 40 to a vehicle body side are led into the vehicle body through the attachment bracket 7.

In FIG. 1, a right side and a left side in a left-right direction of the drawing are respectively a front side and a rear side of the antenna device, and an up-down direction of the drawing is an up-down direction of the antenna device. In addition, in FIG. 3A, a right side in a left-right direction of the drawing is a left side of the antenna device, and a right side is a left side of the antenna device. Here, a thin side of a capacitively loaded plate 35 is set as the front side of the antenna device. For convenience of description, a view illustrating the antenna device when seen from the front side is set as a rear view, a side surface on the left side when the antenna device is seen from the rear side is set as a left side surface, and a side surface on the right side when the antenna device is seen from the rear side is set as a right side surface. In addition, a front-rear direction may be expressed as a length direction, an up-down direction may be expressed as a height direction, and a left-right direction may be expressed as a width direction.

Figure 2A:
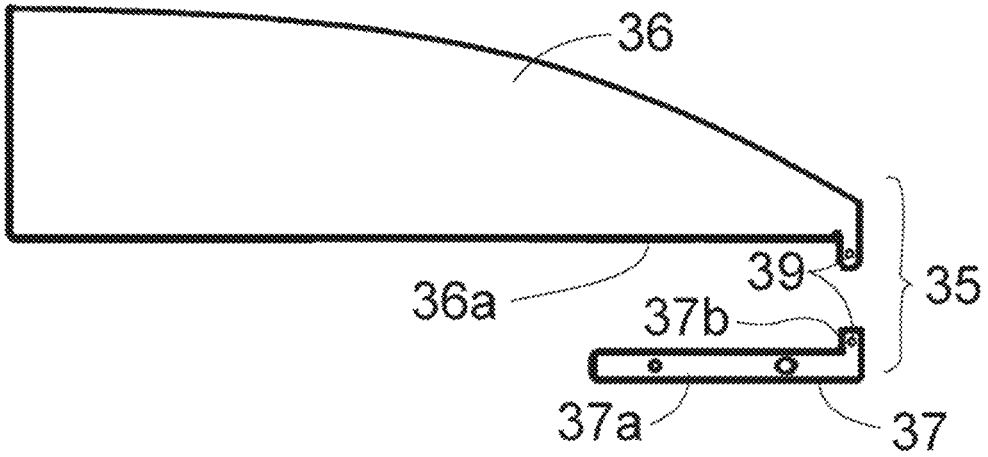
FIG. 2A is an exploded right side view illustrating a case where a separate additional conductor portion is added to a conductor main body portion of a capacitively loaded plate as a capacitive element included in the AM/FM antenna in Embodiment 1.
Figure 2B:
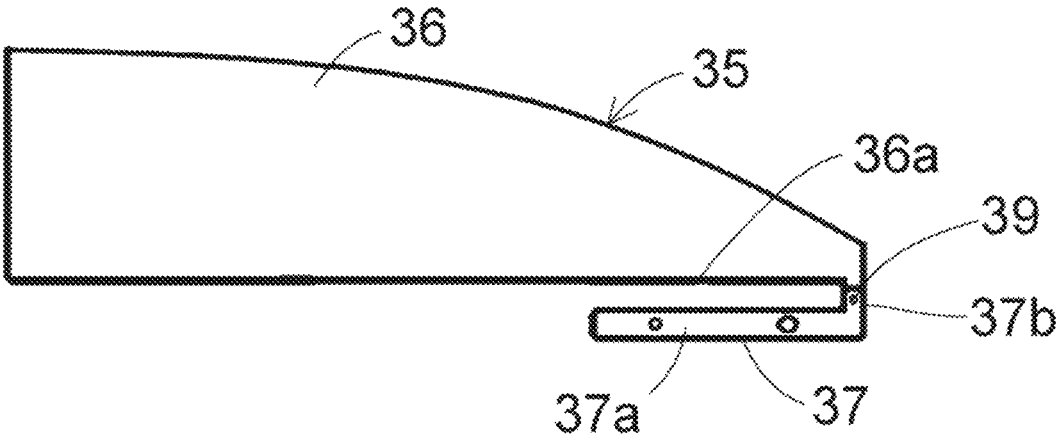
FIG. 2B is a right side view illustrating a state where a separate conductor portion is connected to and fixed to the conductor main body portion of the capacitively loaded plate in Embodiment 1.

Embodiment 1 is different from the example of the related art in that, as illustrated in FIGS. 2A and 2B, the capacitively loaded plate 35 formed of a conductor plate includes: a conductor main body portion 36 corresponding to the capacitively loaded plate 31 of the related art; and an additional conductor portion 37 including a parallel strip-shaped portion 37*a* that is formed in a strip shape with a predetermined width and extends in parallel to face a lower edge 36*a* of a right side surface of the conductor main body portion 36. The conductor main body portion 36 is formed of a conductor plate having a substantially U-shape in cross-section along the ceiling surface (upper side surface) of the cover 20. The additional conductor portion 37 includes an interconnection portion 37*b* that connects one end of the parallel strip-shaped portion 37*a* to the conductor main body portion 36 and allows the parallel strip-shaped portion 37*a* to face the front lower edge 36*a* of the right side surface of the conductor main body portion 36 at a short distance. The length of the parallel strip-shaped portion 37*a* along the lower edge 36*a* of the conductor main body portion 36 is set as a predetermined length corresponding to a frequency band of the SDARS antenna 40. Specifically, the length of the parallel strip-shaped portion 37*a* is set as a length that is ¼ of an effective wavelength in the frequency band of the SDARS antenna 40 (may be set as a length that is substantially ¼ of the effective wavelength). In addition, it is necessary that the predetermined-length portion of the additional conductor portion 37, that is, the parallel strip-shaped portion 37*a* is arranged to correspond to a region having a high electric field of the conductor main body portion 36 in the frequency band of the SDARS antenna 40. As described below, the front lower edge portion of the right side surface of the conductor main body portion 36 is the region having a high electric field. Therefore, the parallel strip-shaped portion 37*a* faces the front lower edge 36*a* of the right side surface of the conductor main body portion 36.

In the capacitively loaded plate 35, the additional conductor portion 37 separate from the conductor main body portion 36 is prepared as illustrated in FIG. 2A, and the conductor main body portion 36 and the additional conductor portion 37 are electrically connected to each other by welding, soldering, riveting, spring contact, or the like on a connection portion 39 therebetween as illustrated in FIG. 2B. The conductor main body portion 36 and the additional conductor portion 37 may be formed and processed as an integrated product in advance.

Figure 3A:
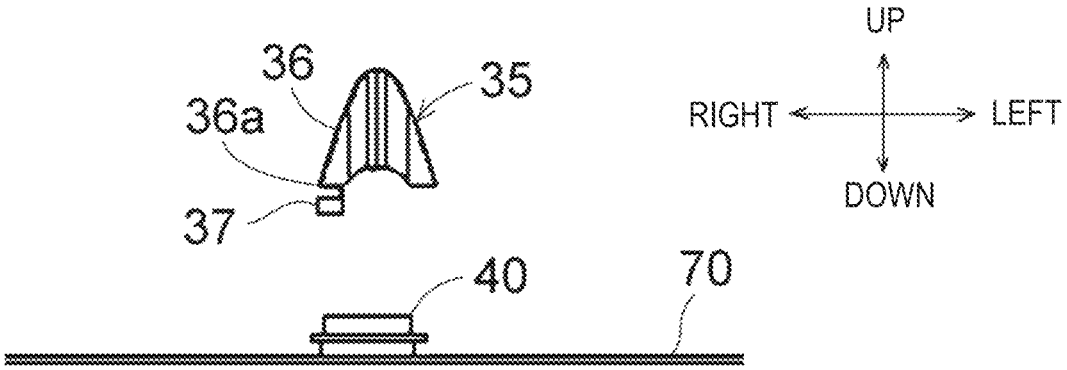
FIG. 3A is a rear view illustrating the alignment of major structural portions of Embodiment 1 (view when the antenna device is seen from the front side).
Figure 3B:
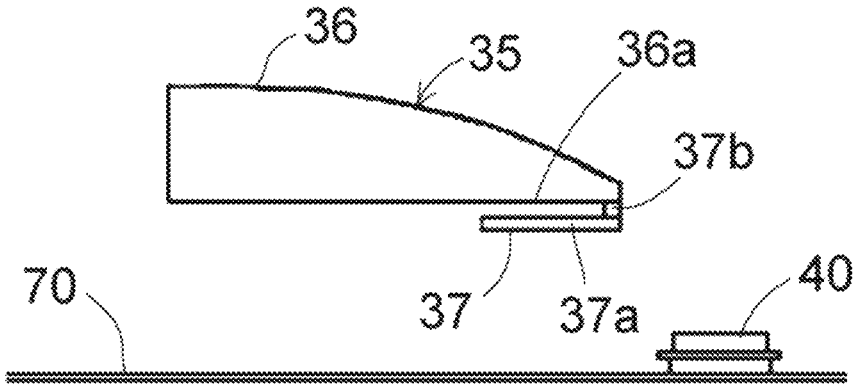
FIG. 3B is a right side view under the same conditions.
Figure 3C:
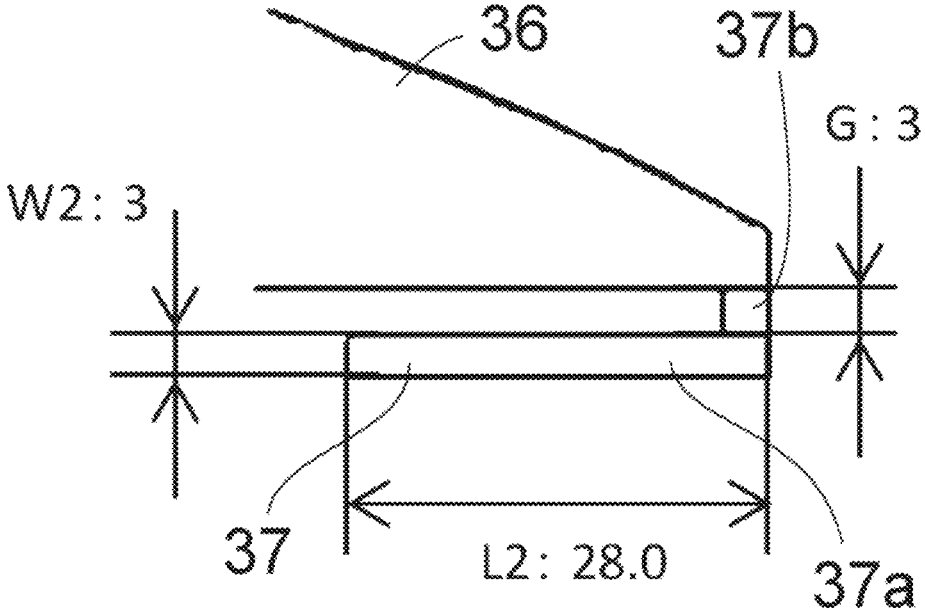
FIG. 3C is a diagram explaining a dimensional relationship between the major structural portions of Embodiment 1.

FIG. 3A is a rear view (view when the antenna device is seen from the front side) illustrating the alignment of the capacitively loaded plate 35 and the SDARS antenna 40, which are major structural portions according to Embodiment 1, on a ground plane 70. FIG. 3B is a right side view under the same conditions. FIG. 3C is a diagram illustrating a dimensional relationship of the additional conductor portion 37 included in the capacitively loaded plate 35 according to Embodiment 1. The coil element connected to the capacitively loaded plate 35 is not illustrated in the drawing. The ground plane 70 is a metal plate corresponding to the vehicle roof. A dimension of the conductor main body portion 36 of the capacitively loaded plate 35 and a height position thereof from the ground plane 70 are the same as those of the capacitively loaded plate 31 in the example of the related art. Regarding the parallel strip-shaped portion 37*a* of the additional conductor portion 37 illustrated in FIG. 3C, a length L2 is 28 mm, a width W2 is 3 mm, and a length G of the interconnection portion 37*b* (distance between the conductor main body portion 36 and the parallel strip-shaped portion 37*a* facing each other) is 3 mm. In consideration of a free space, the length L2 of the parallel strip-shaped portion 37*a* may be ¼ (≅32 mm) of a wavelength of an SDARS frequency. However, in the case of Embodiment 1, the parallel strip-shaped portion 37*a* is accommodated in the exterior case 5 including the base 10 and the cover 20 formed of a resin. Therefore, due to a wavelength shortening effect, L2 is 28 mm that is substantially ¼ of the effective wavelength and is shorter than that in the case of the free space. A dimensional relationship between structural components other than the additional conductor portion 37 is the same as that illustrated in FIG. 36E of the example of the related art.

Figure 4A:
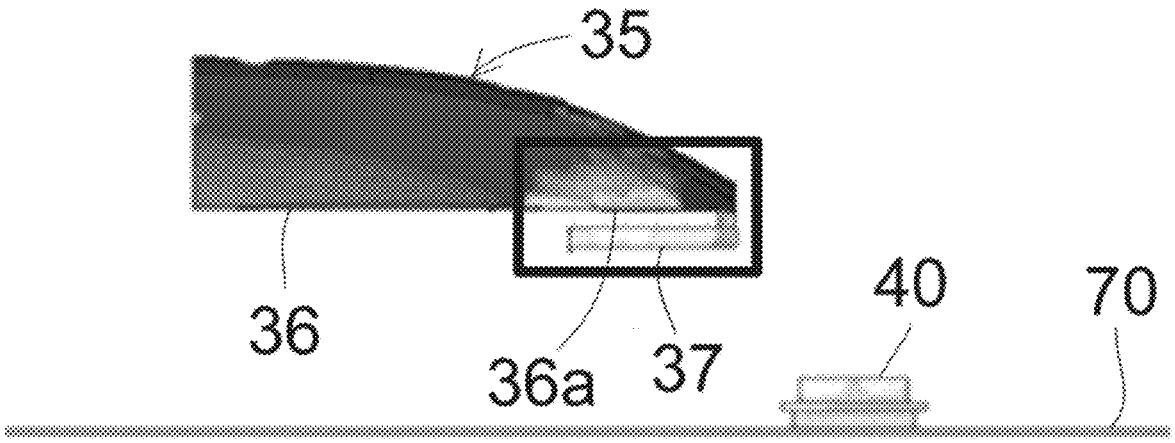
FIG. 4A is a right side view illustrating an electric field distribution in the conductor main body portion of the capacitively loaded plate and the additional conductor portion integrated therewith when a radio wave in an SDARS band is transmitted from the SDARS antenna in Embodiment 1.
Figure 4B:
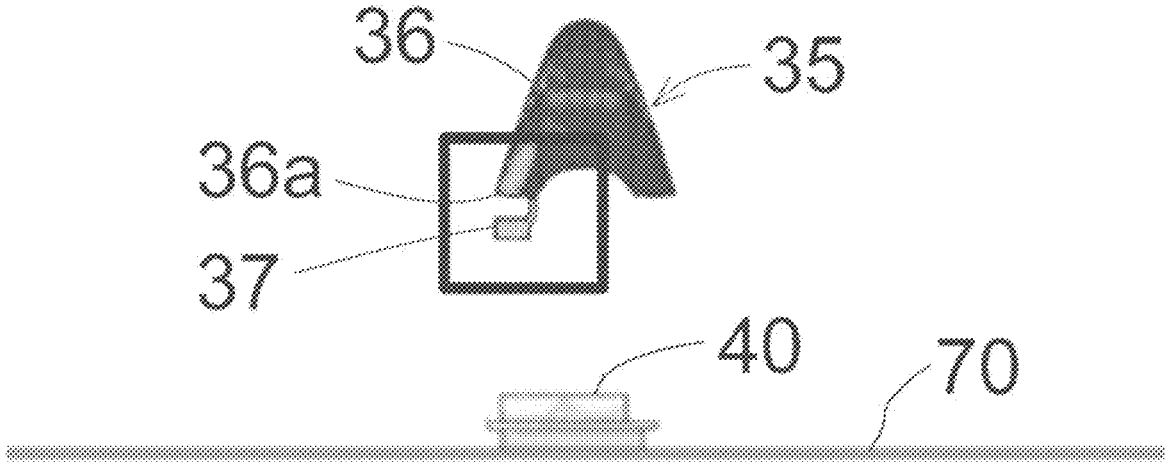
FIG. 4B is a rear view under the same conditions.
Figure 4C:
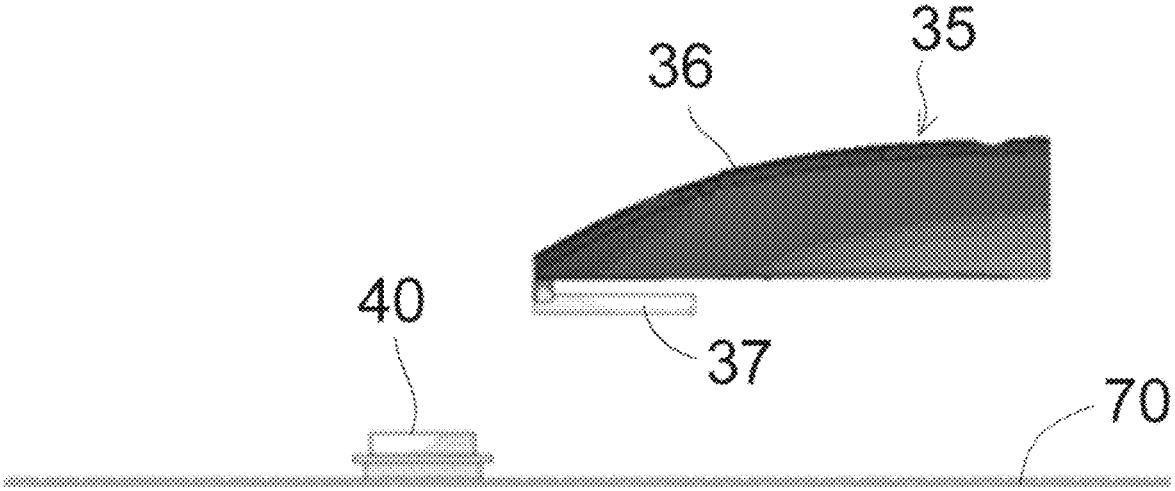
FIG. 4C is a left side view under the same conditions.

In the alignment and the dimensional relationship illustrated in FIGS. 3A to 3C, when a radio wave (left circularly polarized wave) in an SDARS band is transmitted from the SDARS antenna 40, an electric field distribution in the capacitively loaded plate 35 (the conductor main body portion 36 and the additional conductor portion 37) of the AM/FM antenna is illustrated in FIGS. 4A to 4C. FIG. 4A is a right side view, FIG. 4B is a rear view, and FIG. 4C is a left side view. In FIGS. 4A to 4C, a bright portion (light-colored portion) is a portion having a high electric field. It is understood from FIG. 4A that the electric field of the lower edge portion of the right side front surface of the conductor main body portion 36 is high, and the electric field of the additional conductor portion 37 facing the lower edge portion is also high (refer to the inside of frames in FIGS. 4A and 4B).

Figure 5A:
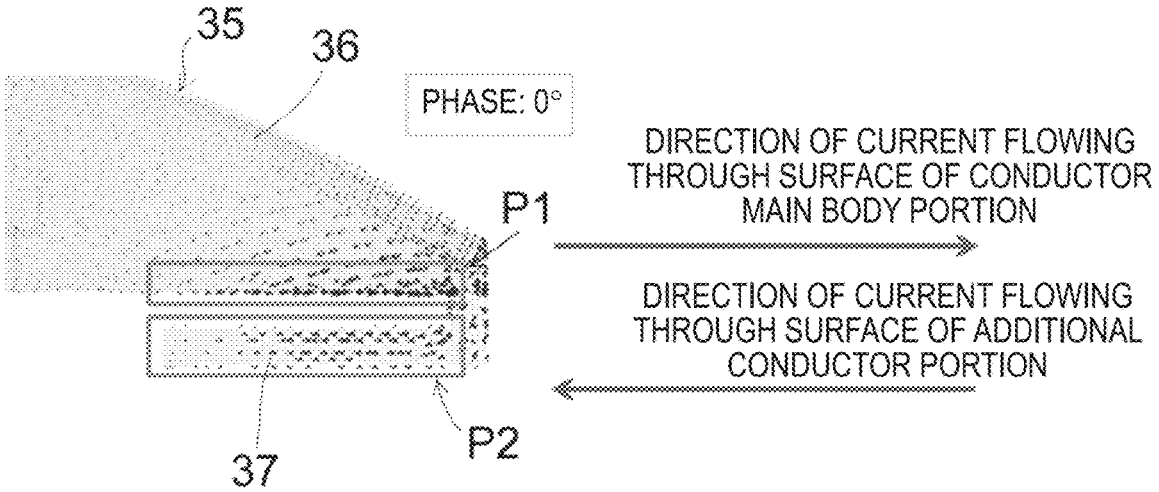
FIG. 5A is a diagram explaining a current state (phase: 0°) on a right side surface of the additional conductor portion and the conductor main body portion of the capacitively loaded plate in Embodiment 1.
Figure 5B:
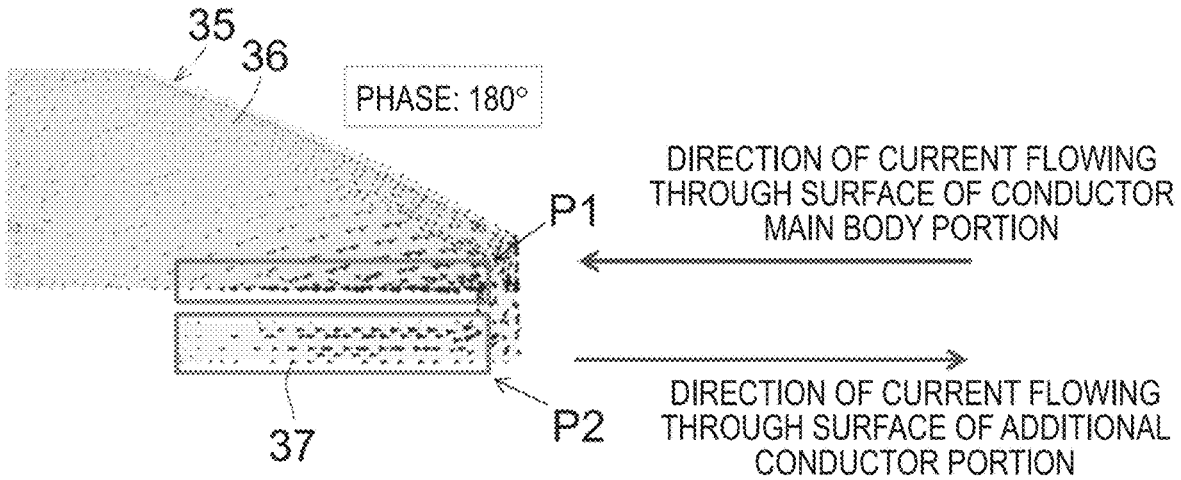
FIG. 5B is a diagram explaining a current state (phase: 180°) on the right side surface of the conductor portion under the same conditions.

In addition, FIG. 5A illustrates a current distribution (phase: 0°) of the right side surface of the capacitively loaded plate 35 (the conductor main body portion 36 and the additional conductor portion 37), and FIG. 5B illustrates a current distribution (phase: 180°) of the right side surface of the capacitively loaded plate. The size of an arrow represents the amount of a current, and the direction of an arrow represents a flowing direction of a current. In addition, the density of arrows represents the intensity of a current. It is understood from these drawings that the direction of a current flowing through a portion (in a rectangular frame P2) of the additional conductor portion 37 is opposite to the direction of a current flowing through the surface of the conductor main body portion of the lower edge portion (in a rectangular frame P1 of FIGS. 5A and 5B) of the right side front surface of the conductor main body portion 36 in the capacitively loaded plate 35. That is, the direction of the current in the lower edge portion (in the rectangular frame P1) of the right side front surface of the conductor main body portion 36 is opposite to the direction of the current flowing through the surface of the portion (in the rectangular frame P2) of the additional conductor portion 37 facing the lower edge portion, and the current in the rectangular frame P1 and the current in the rectangular frame P2 offset each other. As a result, disturbance (deviation) in directional characteristics caused by the high electric field in the lower edge portion of the right side front surface of the conductor main body portion 36 can be reduced. This verified data will be described below with reference to FIGS. 7 to 24.

Figure 6:
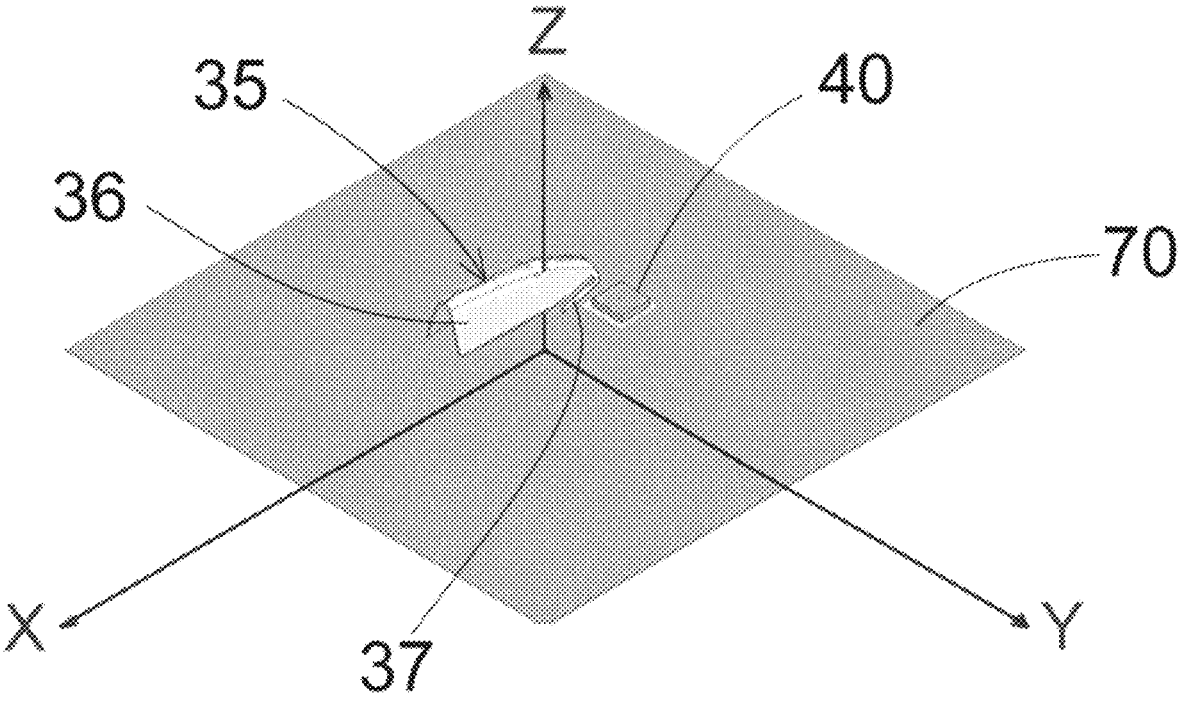
FIG. 6 is a diagram explaining a measurement model for verifying effects of Embodiment 1.

FIG. 6 is a diagram explaining a measurement model for verifying effects of Embodiment 1, in which the SDARS antenna 40 as a patch antenna, the capacitively loaded plate 35 (including the conductor main body portion 36 and the additional conductor portion 37), and the coil element (not illustrated in the drawing) are provided on the ground plane 70, and the three orthogonal axes X, Y, and Z are defined as illustrated in the drawing. The XY plane is positioned on the ground plane 70, the X axis is a front-rear direction of the capacitively loaded plate 35 (the rear direction is +), the Y axis is a left-right direction of the capacitively loaded plate 35, and the Z axis is a direction perpendicular to the ground plane 70. Dimensions and position relationships (mutual distances) of the respective members of the measurement model of FIG. 6 other than the additional conductor portion 37 are the same as those of the standard model of FIG. 36E.

Figure 7:
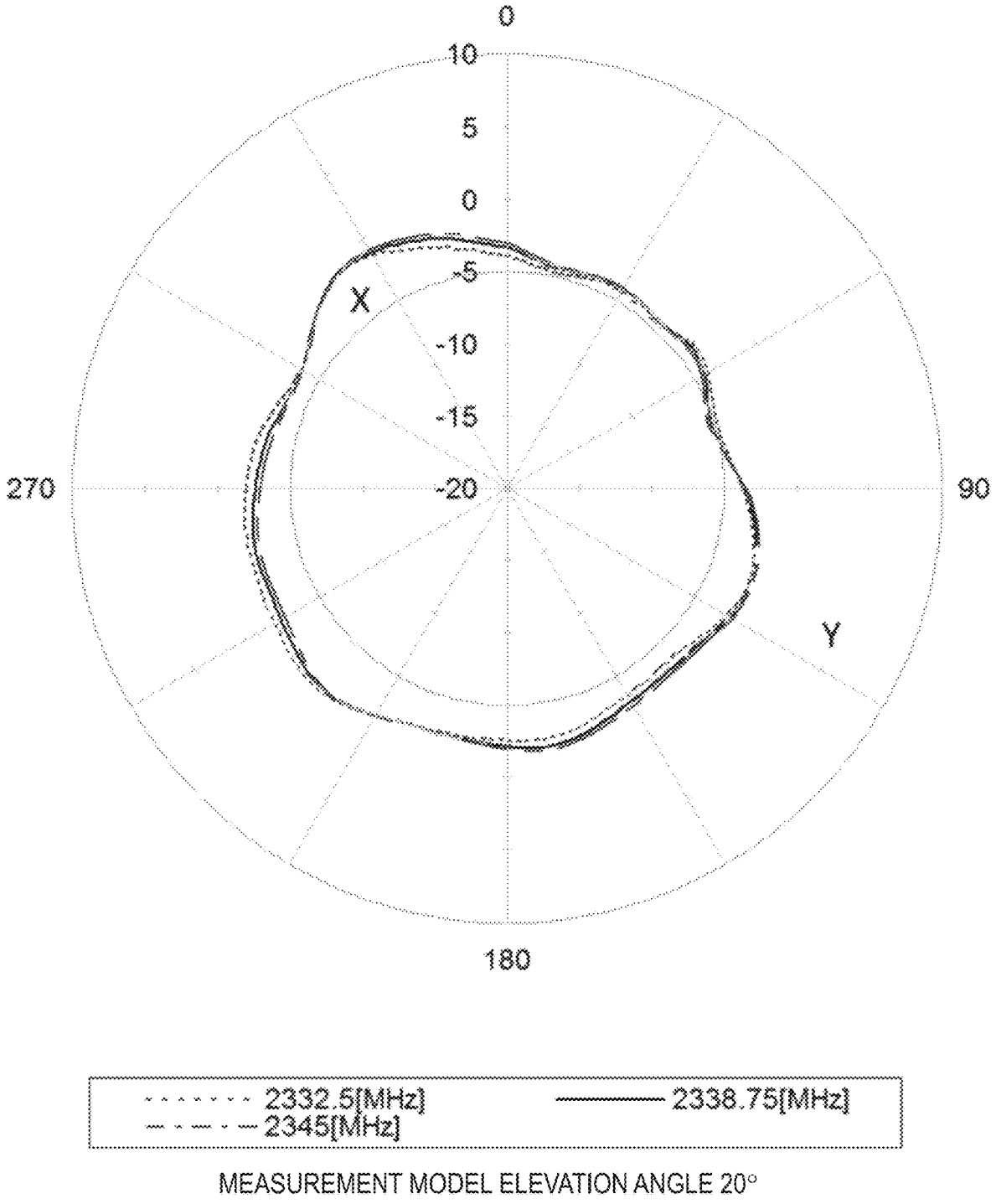
FIG. 7 is a directivity characteristic diagram illustrating a relationship between an azimuth and a gain (dBic) at an elevation angle of 20°, which is directivity in a horizontal plane (XY plane) of the SDARS antenna as a patch antenna in the measurement model for verifying the effects of Embodiment 1.
Figure 8:
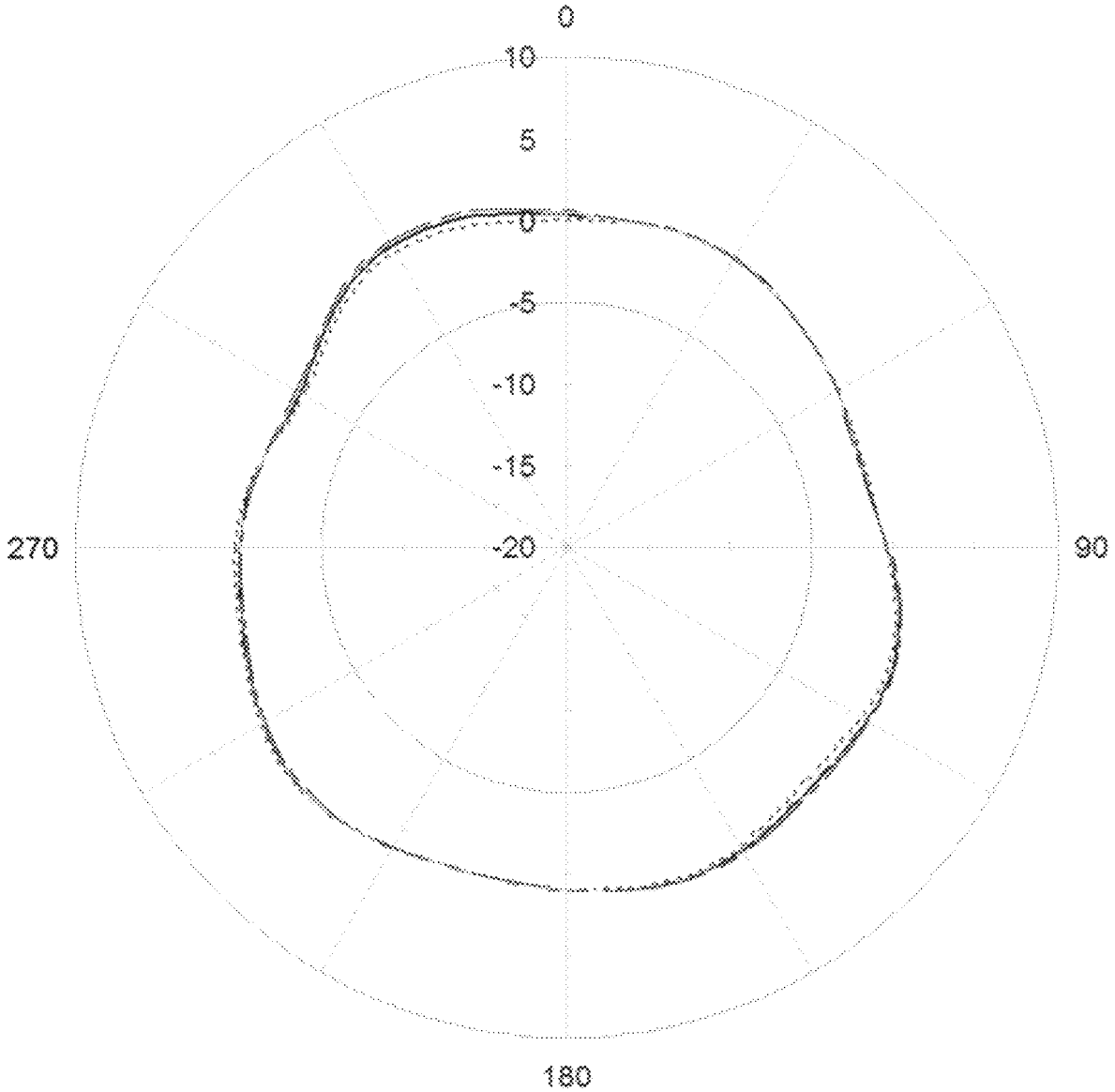
FIG. 8 is a directivity characteristic diagram illustrating a case where the elevation angle is 40° under the same conditions.
Figure 9:
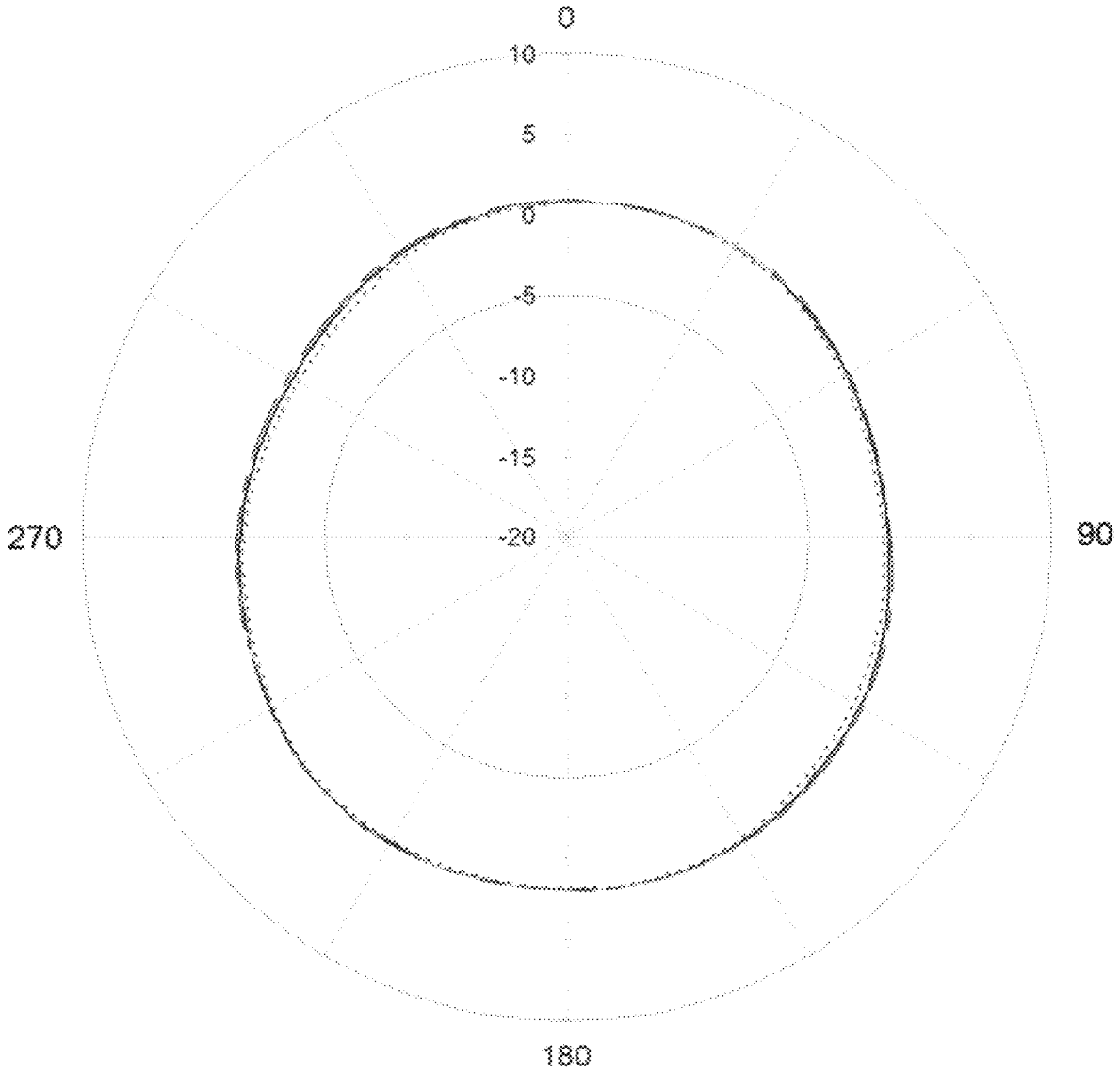
FIG. 9 is a directivity characteristic diagram illustrating a case where the elevation angle is 60° under the same conditions.

FIG. 7 is a directivity characteristic diagram illustrating a relationship between an azimuth and a circular polarization gain (dBic) at an elevation angle of 20°, which is directivity on a horizontal plane (XY plane) of the SDARS antenna as a patch antenna in the measurement model of FIG. 6. FIG. 8 is a directivity characteristic diagram illustrating a case where the elevation angle is 40° under the same conditions. FIG. 9 is a directivity characteristic diagram illustrating a case where the elevation angle is 60° under the same conditions. In particular, in the case of the elevation angle of 60° in FIG. 9, it is understood that the horizontal plane directional characteristics in a frequency band of 2332.5 MHz to 2345 MHz are similar to a circle. That is, it can be seen that the directivity can be improved to be equivalent to the directivity of the SDARS antenna alone.

Figure 10:
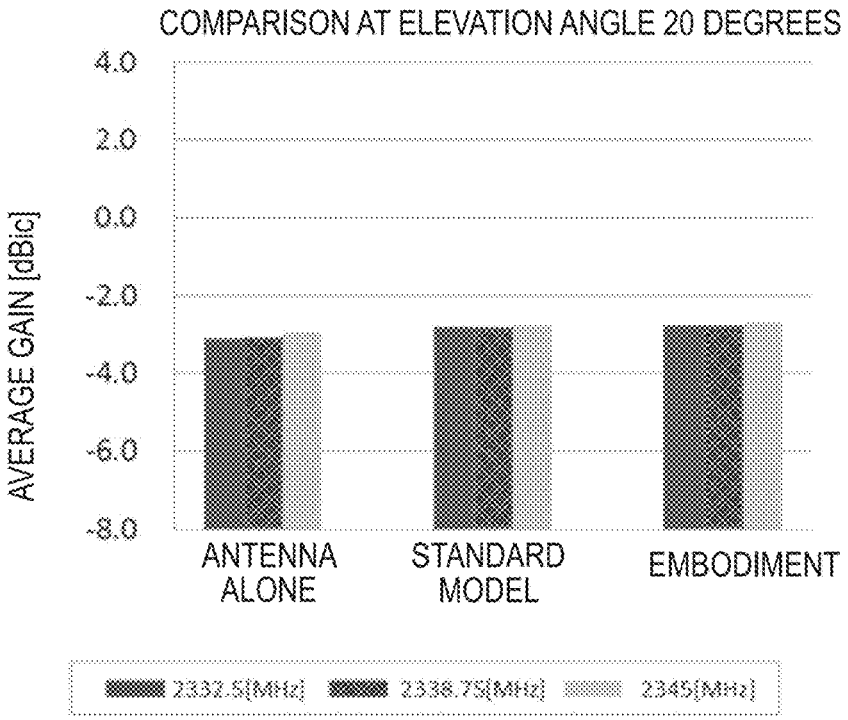
FIG. 10 is a diagram illustrating a comparison in average gain (unit: dBic) at an elevation angle of 20° among the SDARS antenna alone, a standard model (example of the related art) where the conductor portion is not added, and Embodiment 1 (measurement model).
Figure 11:
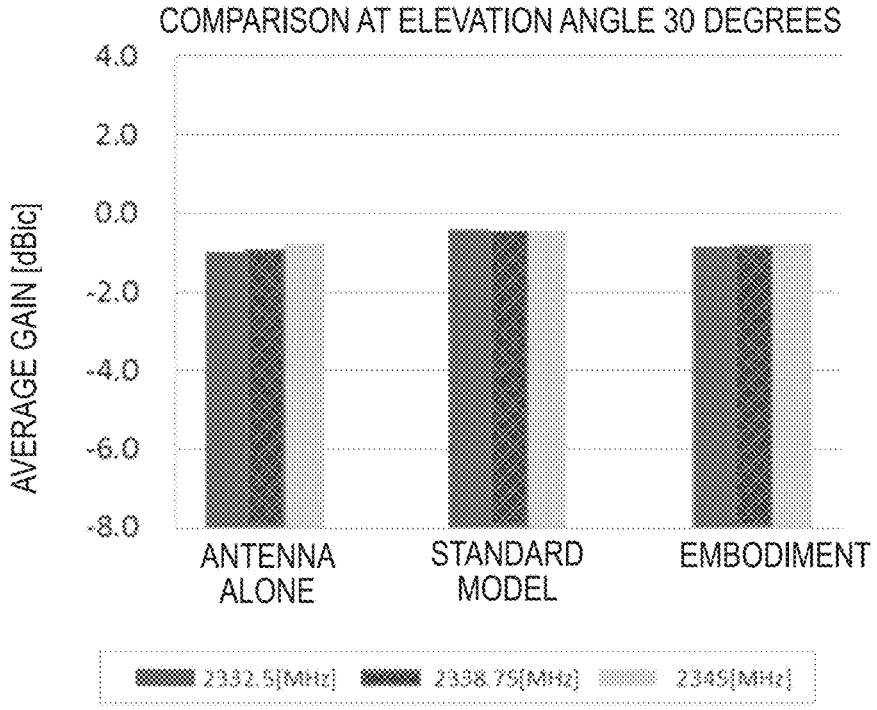
FIG. 11 is a diagram illustrating a case where the elevation angle is 30° under the same conditions.
Figure 12:
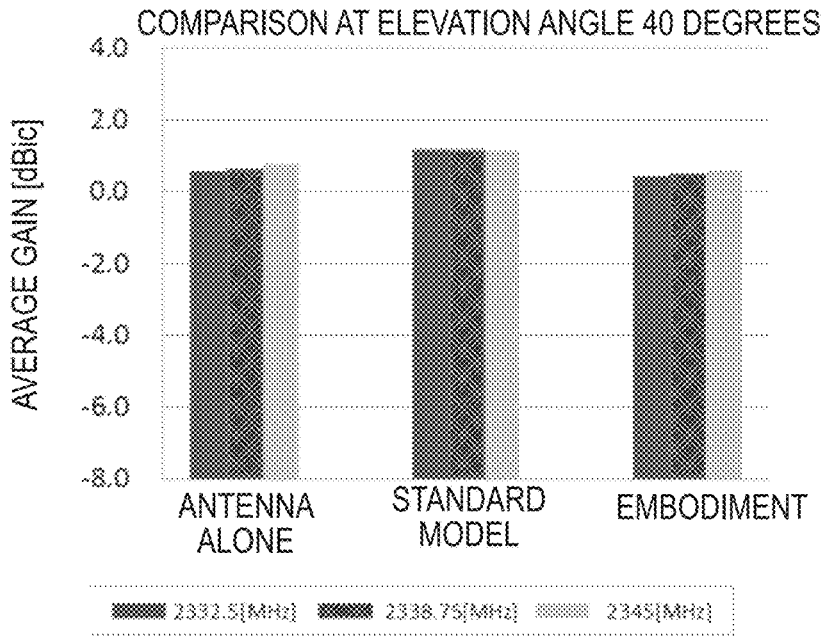
FIG. 12 is a diagram illustrating a case where the elevation angle is 40° under the same conditions.
Figure 13:
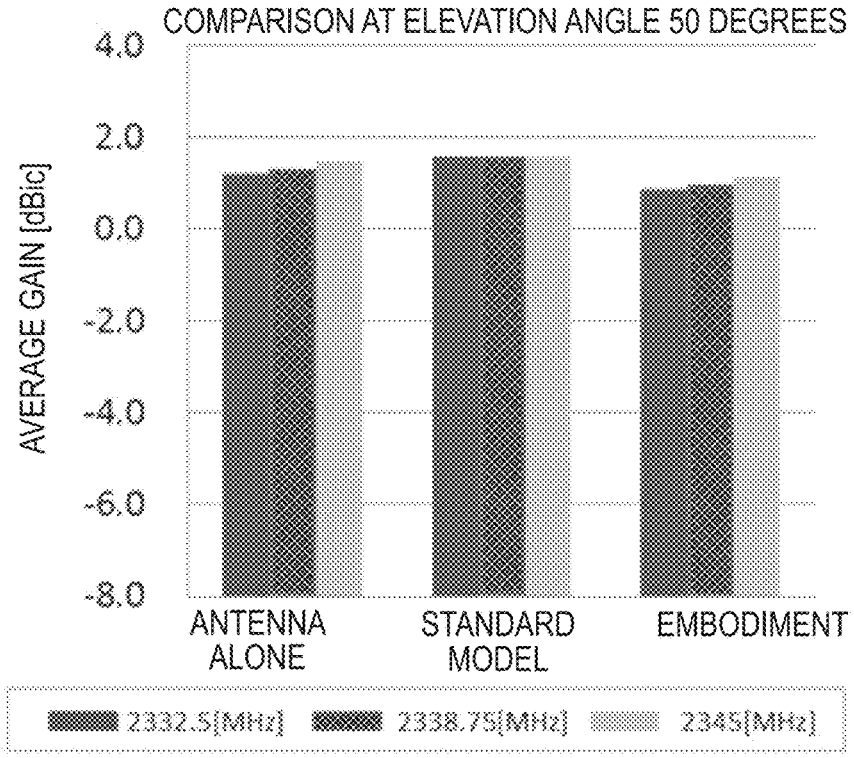
FIG. 13 is a diagram illustrating a case where the elevation angle is 50° under the same conditions.
Figure 14:
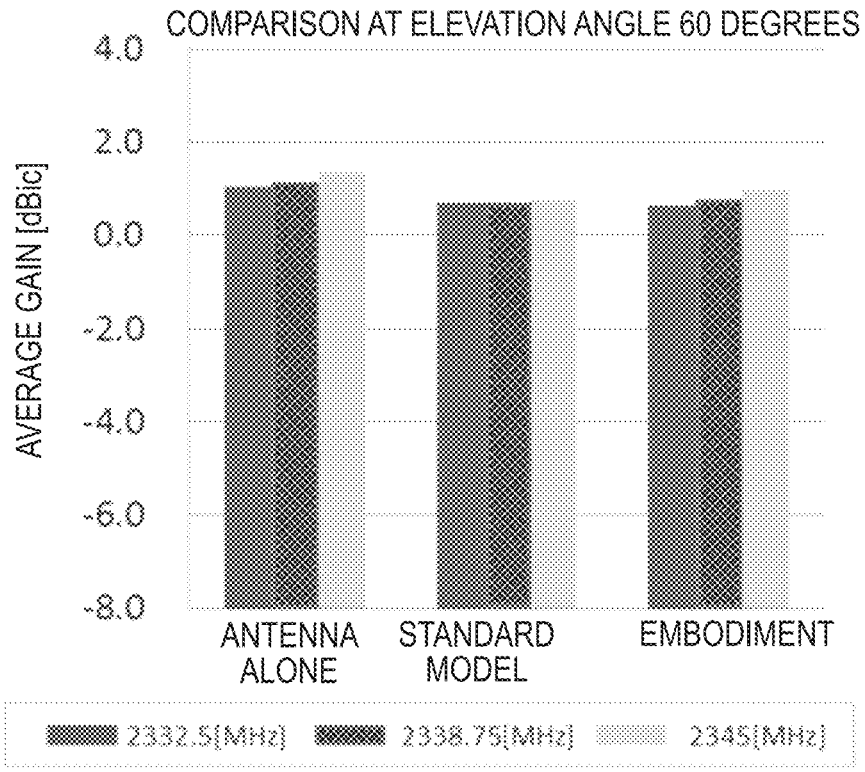
FIG. 14 is a diagram illustrating a case where the elevation angle is 60° under the same conditions.

FIG. 10 is a diagram explaining a comparison in circular polarization average gain (unit: dBic) at an elevation angle of 20° among the SDARS antenna alone, the standard model (example of the related art) where the conductor portion is not added, and Embodiment 1 (measurement model). FIG. 11 is a diagram illustrating a case where the elevation angle is 30° under the same conditions. FIG. 12 is a diagram illustrating a case where the elevation angle is 40° under the same conditions. FIG. 13 is a diagram illustrating a case where the elevation angle is 50° under the same conditions. FIG. 14 is a diagram illustrating a case where the elevation angle is 60° under the same conditions. As seen in FIGS. 10 to 14, regarding the circular polarization average gain, there is no significant difference among the antenna alone, the standard model, and Embodiment 1 (measurement model) in a frequency band of 2332.5 MHz to 2345 MHz.

Figure 15:
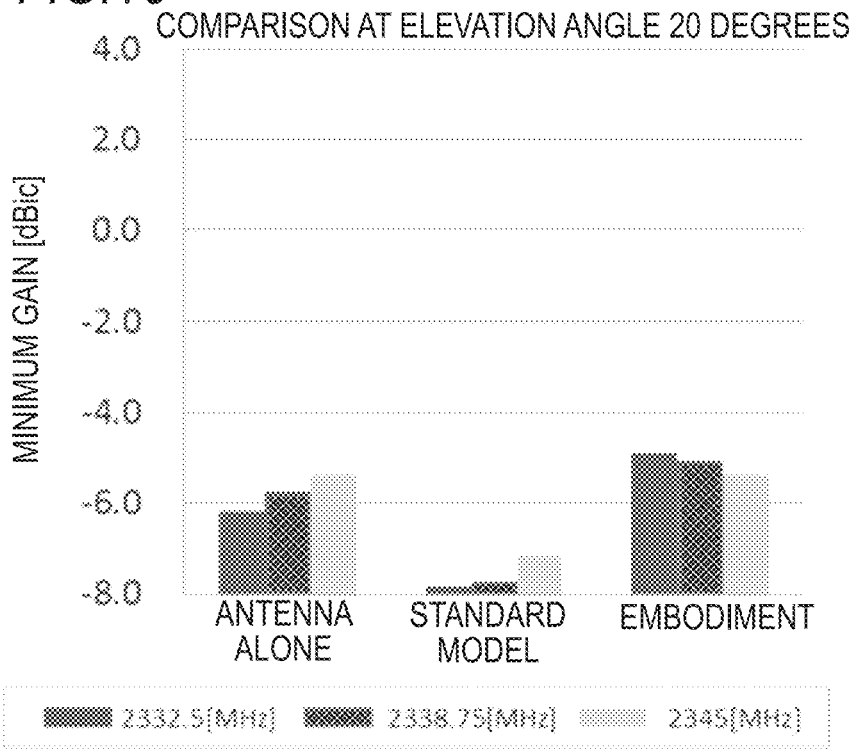
FIG. 15 is a diagram illustrating a comparison in minimum gain (unit: dBic) at an elevation angle of 20° among the SDARS antenna alone, the standard model (example of the related art) where the conductor portion is not added, and Embodiment 1 (measurement model).
Figure 16:
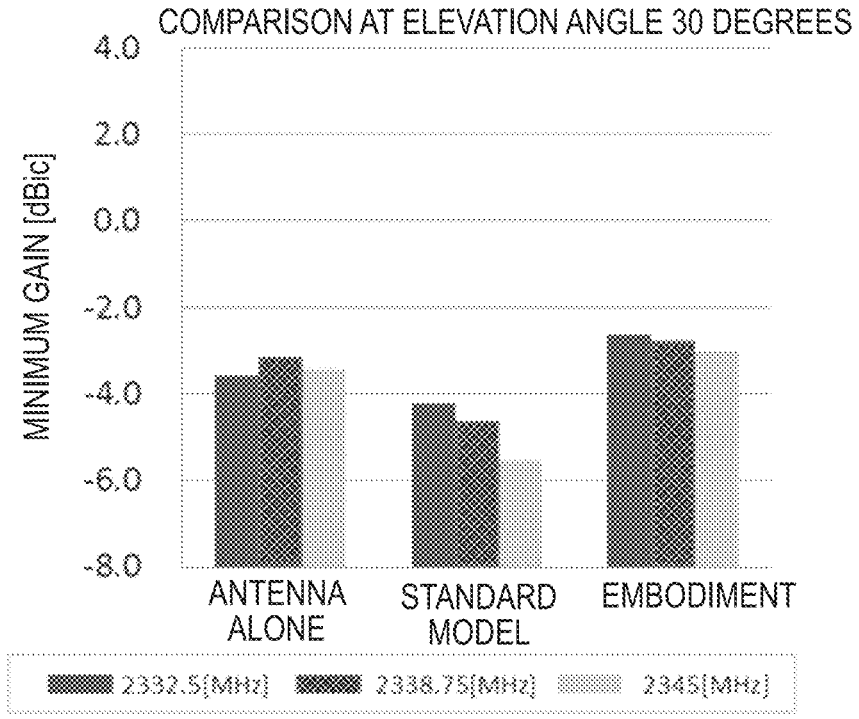
FIG. 16 is a diagram illustrating a case where the elevation angle is 30° under the same conditions.
Figure 17:
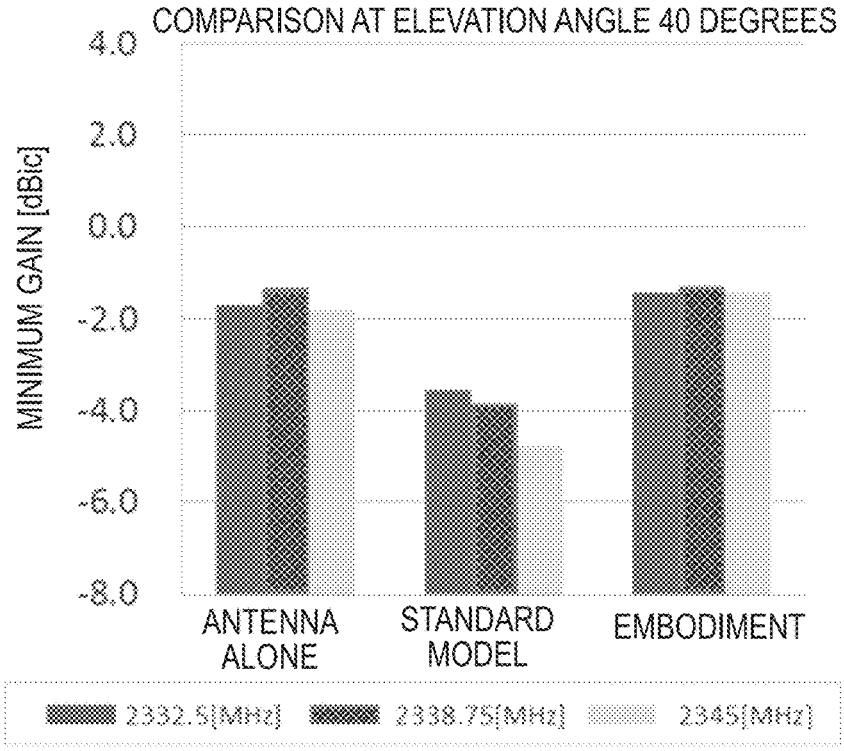
FIG. 17 is a diagram illustrating a case where the elevation angle is 40° under the same conditions.
Figure 18:
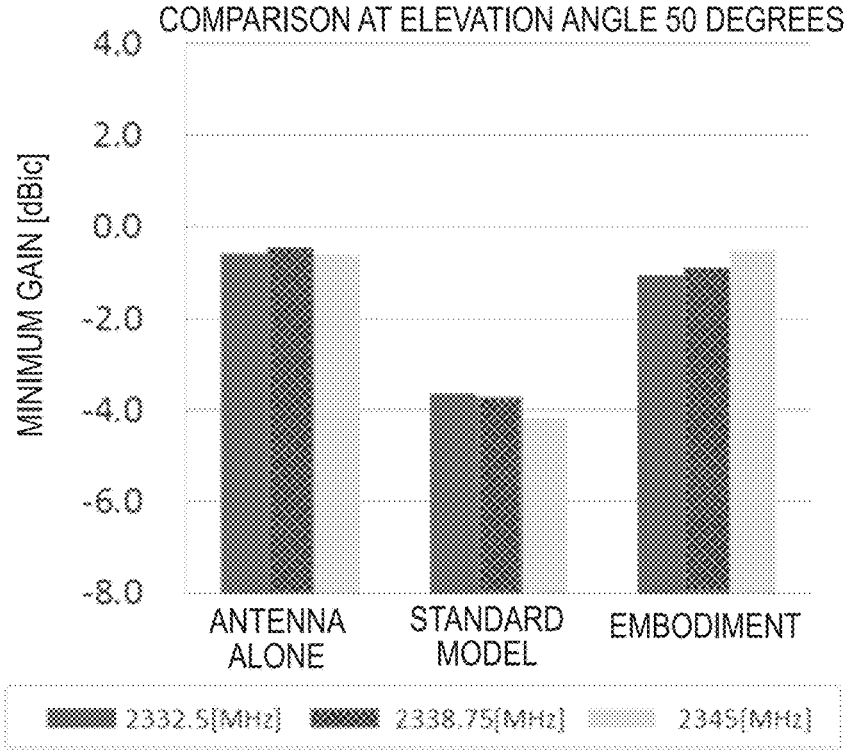
FIG. 18 is a diagram illustrating a case where the elevation angle is 50° under the same conditions.
Figure 19:
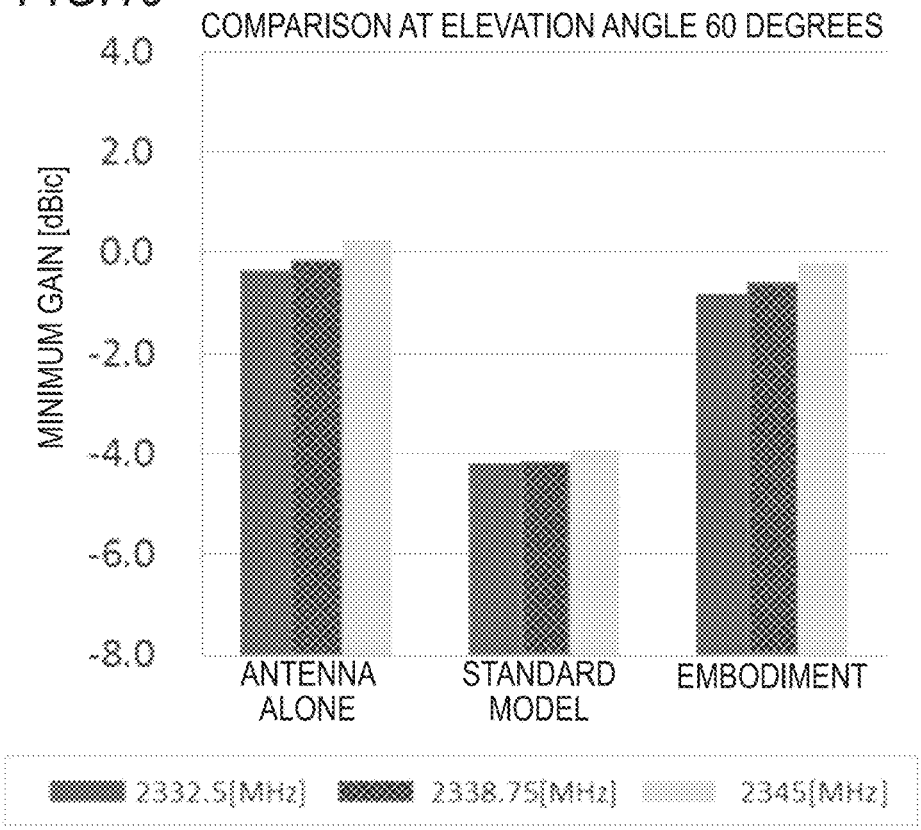
FIG. 19 is a diagram illustrating a case where the elevation angle is 60° under the same conditions.

FIG. 15 is a diagram explaining a comparison in circular polarization minimum gain (unit: dBic) at an elevation angle of 20° among the SDARS antenna alone, the standard model (example of the related art) where the conductor portion is not added, and Embodiment 1 (measurement model). FIG. 16 is a diagram illustrating a case where the elevation angle is 30° under the same conditions. FIG. 17 is a diagram illustrating a case where the elevation angle is 40° under the same conditions. FIG. 18 is a diagram illustrating a case where the elevation angle is 50° under the same conditions. FIG. 19 is a diagram illustrating a case where the elevation angle is 60° under the same conditions. As seen in FIGS. 15 to 19, the circular polarization minimum gain of Embodiment 1 (measurement model) is significantly improved as compared to that of the standard model and is equivalent to that of the SDARS antenna alone in a frequency band of 2332.5 MHz to 2345 MHz.

Figure 20:
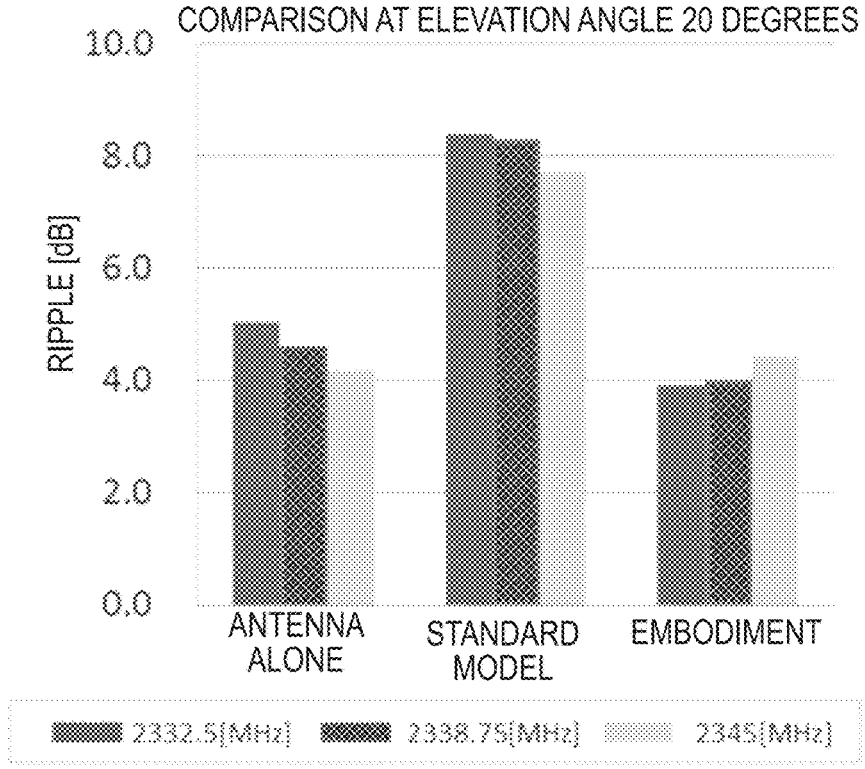
FIG. 20 is a diagram illustrating a comparison in ripple (maximum gain-minimum gain) at an elevation angle of 20° among the SDARS antenna alone, the standard model (example of the related art) where the conductor portion is not added, and Embodiment 1 (measurement model).
Figure 21:
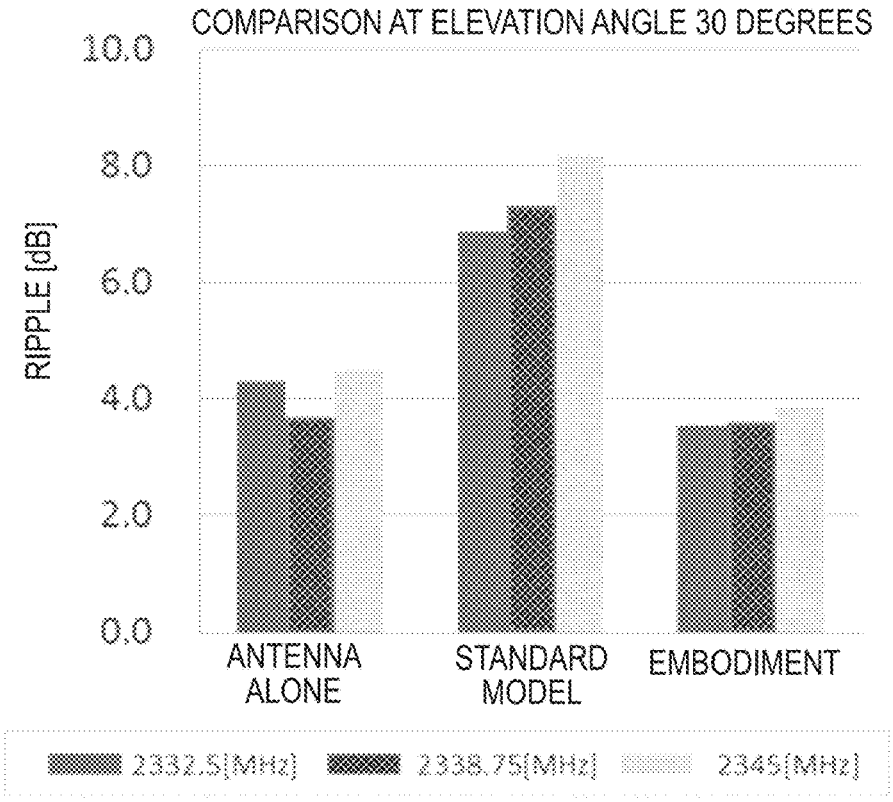
FIG. 21 is a diagram illustrating a comparison in ripple when the elevation angle is 30° under the same conditions.
Figure 22:
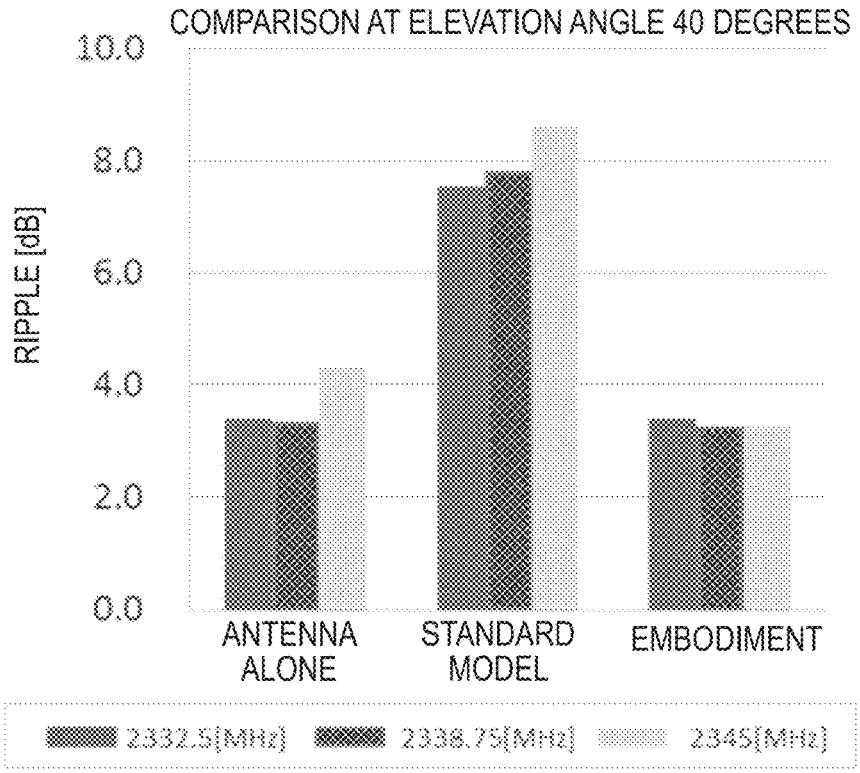
FIG. 22 is a diagram illustrating a comparison in ripple when the elevation angle is 40° under the same conditions.
Figure 23:
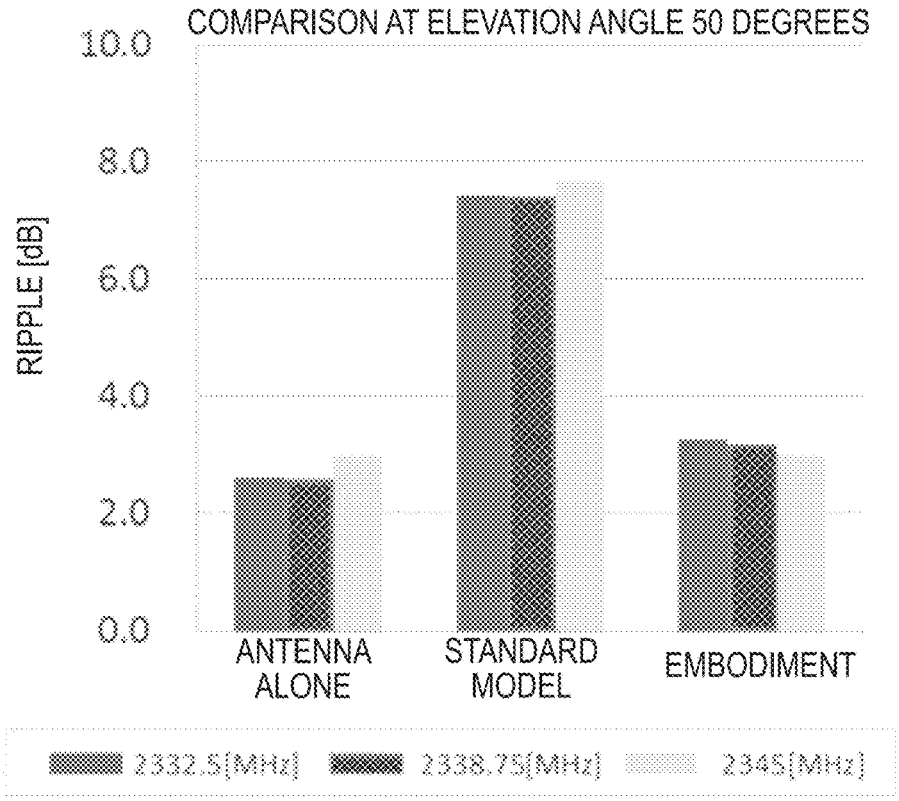
FIG. 23 is a diagram illustrating a comparison in ripple when the elevation angle is 50° under the same conditions.
Figure 24:
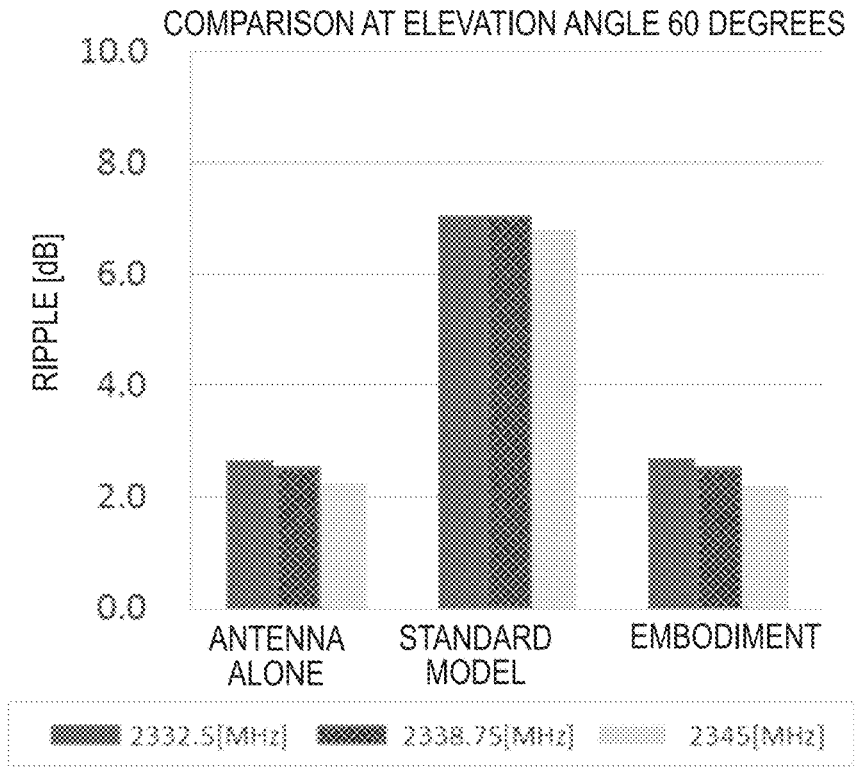
FIG. 24 is a diagram illustrating a comparison in ripple when the elevation angle is 60° under the same conditions.

FIG. 20 is a diagram explaining a comparison in ripple (maximum gain-minimum gain) at an elevation angle of 20° among the SDARS antenna alone, the standard model (example of the related art) where the conductor portion is not added, and Embodiment 1 (measurement model). FIG. 21 is a diagram illustrating a comparison in ripple when the elevation angle is 30° under the same conditions. FIG. 22 is a diagram illustrating a comparison in ripple when the elevation angle is 40° under the same conditions. FIG. 23 is a diagram illustrating a comparison in ripple when the elevation angle is 50° under the same conditions. FIG. 24 is a diagram illustrating a comparison in ripple when the elevation angle is 60° under the same conditions. As seen in FIGS. 20 to 24, the ripple of Embodiment 1 (measurement model) is significantly improved as compared to that of the standard model and is equivalent to that of the SDARS antenna alone in a frequency band of 2332.5 MHz to 2345 MHz. That is, it is possible to make a configuration that the presence of the capacitively loaded plate 35 does not have an adverse influence on the directional characteristic of the SDARS antenna.

According to the embodiment, the following effects can be exhibited.

(1) As illustrated in FIGS. 1 to 5A and 5B, when the first antenna (AM/FM antenna 30) and the second antenna (SDARS antenna 40) having different frequency bands are provided in the common exterior case 5, the additional conductor portion 37 extends out from the conductor main body portion 36 as the capacitively loaded plate of the AM/FM antenna 30, the parallel strip-shaped portion 37*a* of the additional conductor portion 37 is arranged to correspond to a region having a high electric field of the conductor main body portion 36 in the frequency band of the SDARS antenna 40, and the length of the parallel strip-shaped portion 37*a* is set as a length that is substantially ¼ of the effective wavelength in the frequency band of the SDARS antenna 40. Therefore, the horizontal plane directivity of the SDARS antenna 40 can be made to approach to theoretical non-directivity. That is, the current in a direction opposite to the current direction in the region having a high electric field of the conductor main body portion 36 is induced to the parallel strip-shaped portion 37*a*. As a result, the current in the region having a high electric field of the conductor main body portion 36 is canceled out, and a variation in directivity caused by the region can be reduced.

Figure 36A:
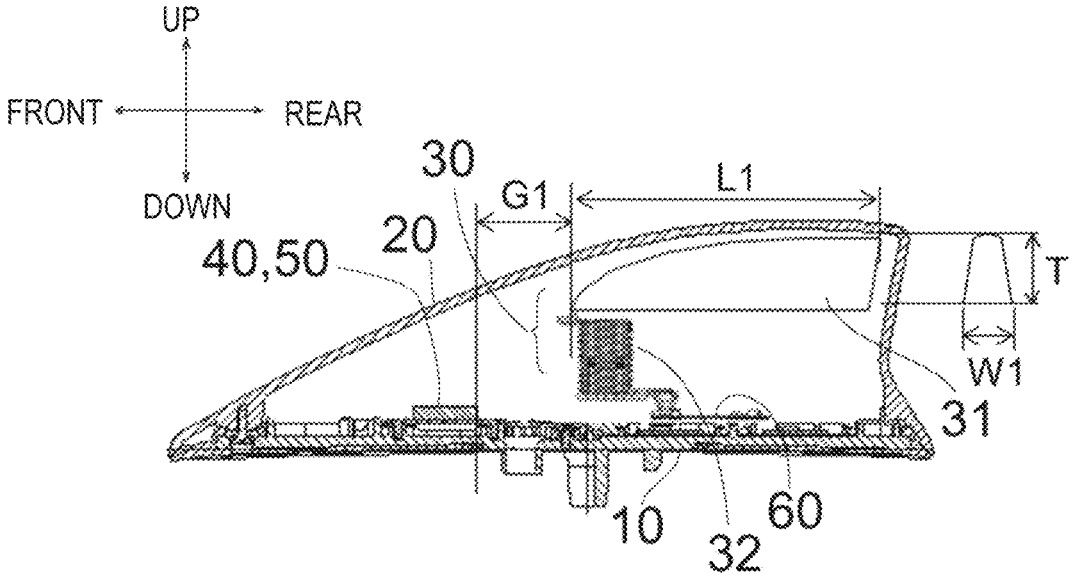
FIG. 36A is a left side view illustrating an example of the related art of an antenna device when an SDARS antenna or a GPS antenna is arranged in front of an AM/FM antenna.
Figure 36B:
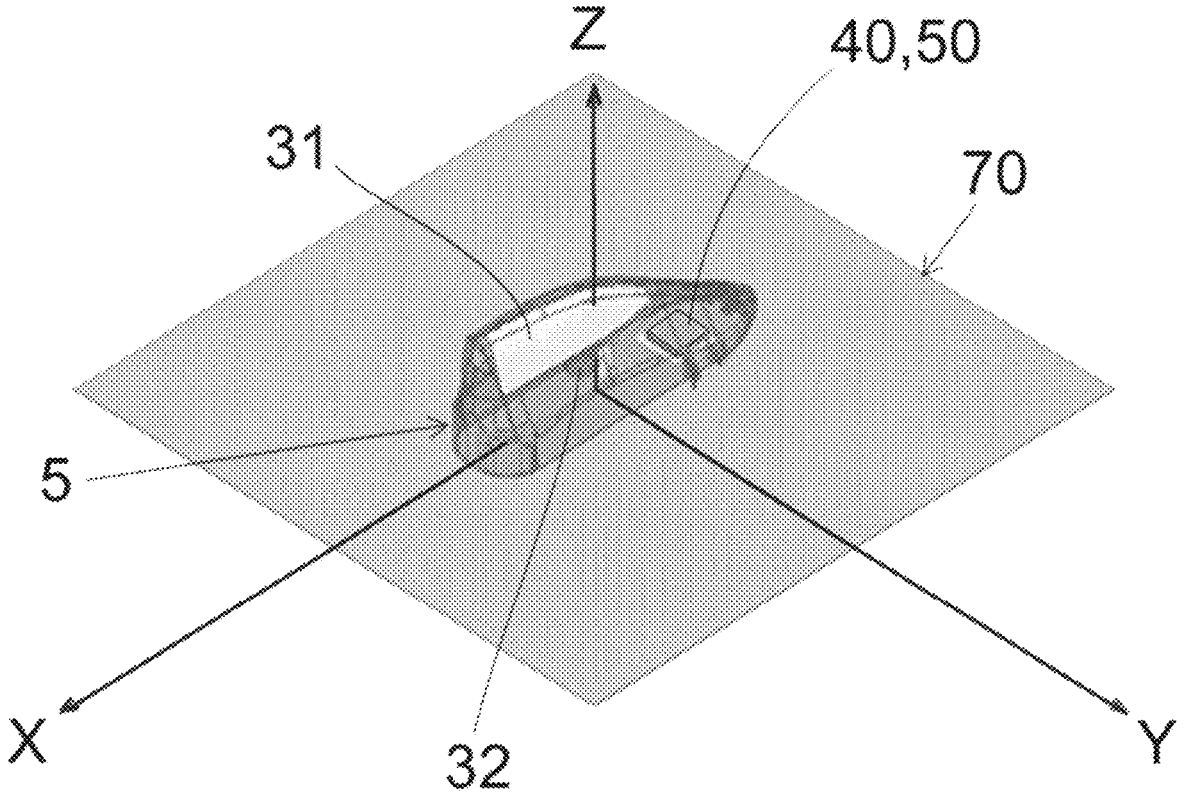
FIG. 36B is a perspective view illustrating a standard model in which the AM/FM antenna of the example of the related art, and an SDARS antenna or a GPS antenna are arranged on a ground plane.
Figure 36C:
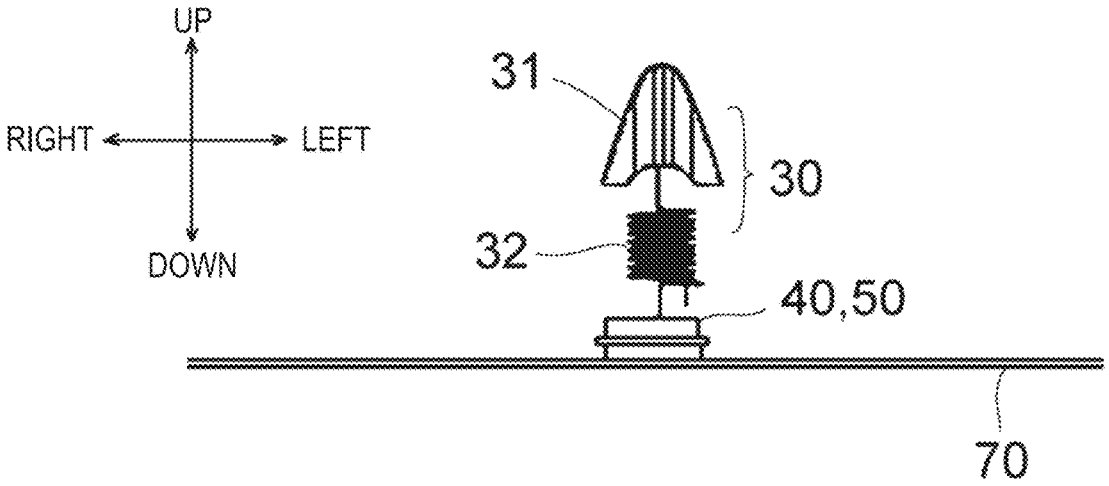
FIG. 36C is a rear view under the same conditions.
Figure 36D:
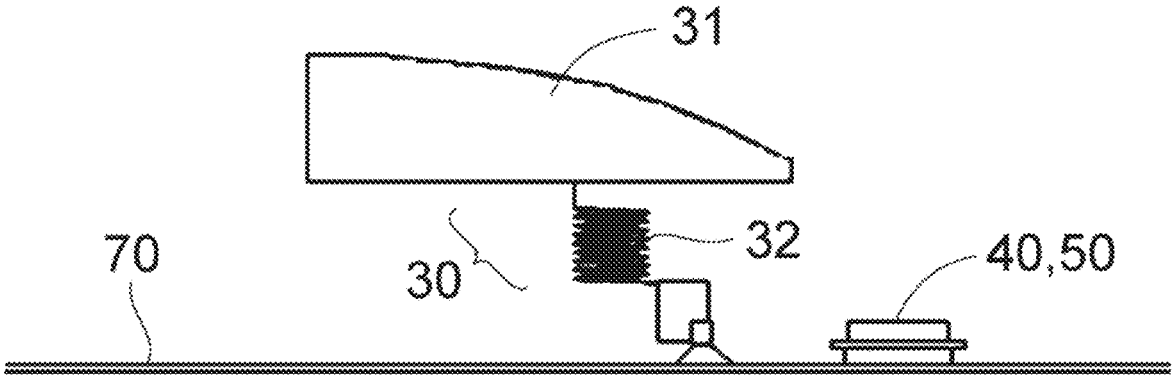
FIG. 36D is a right side view under the same conditions.
Figure 36E:
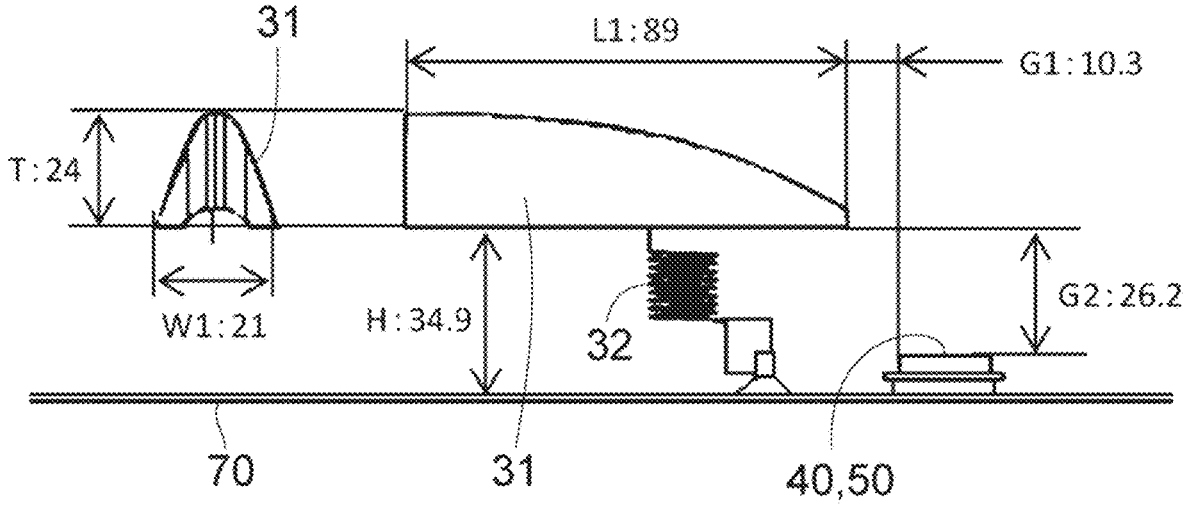
FIG. 36E is a diagram explaining the dimensions of respective portions of the standard model.
Figure 37:
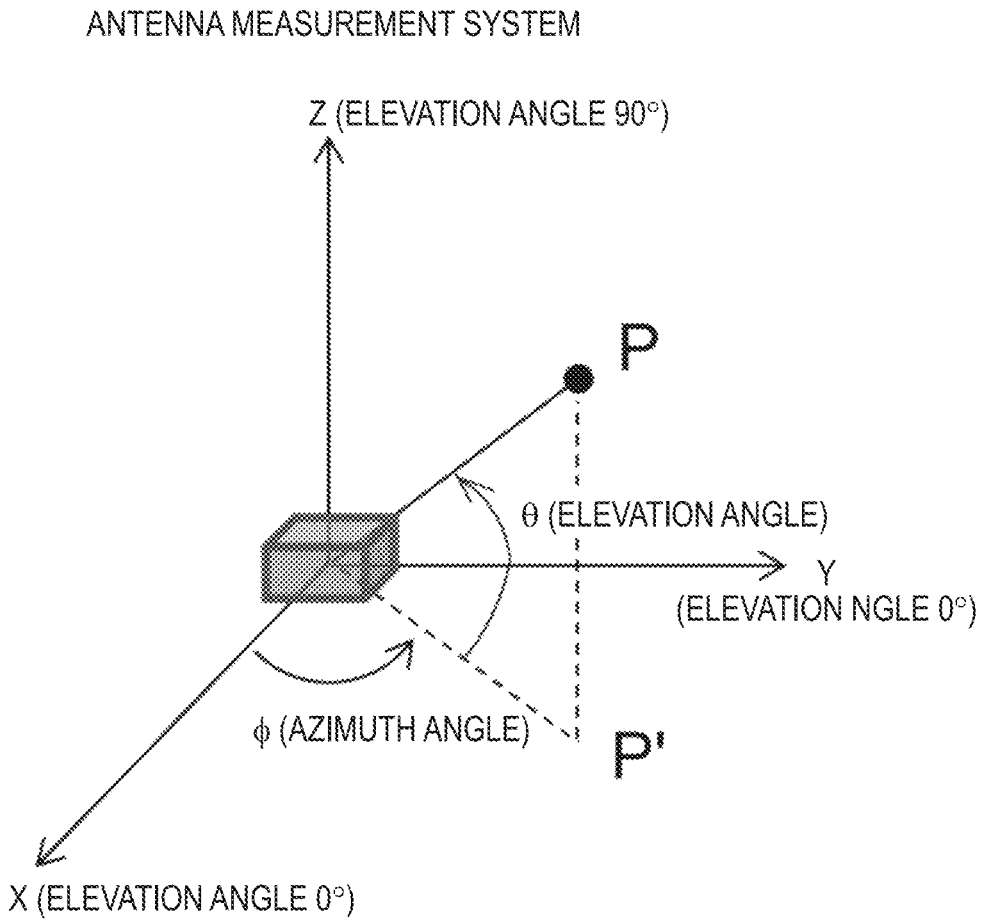
FIG. 37 is a diagram illustrating an antenna measurement system.
Figure 38:
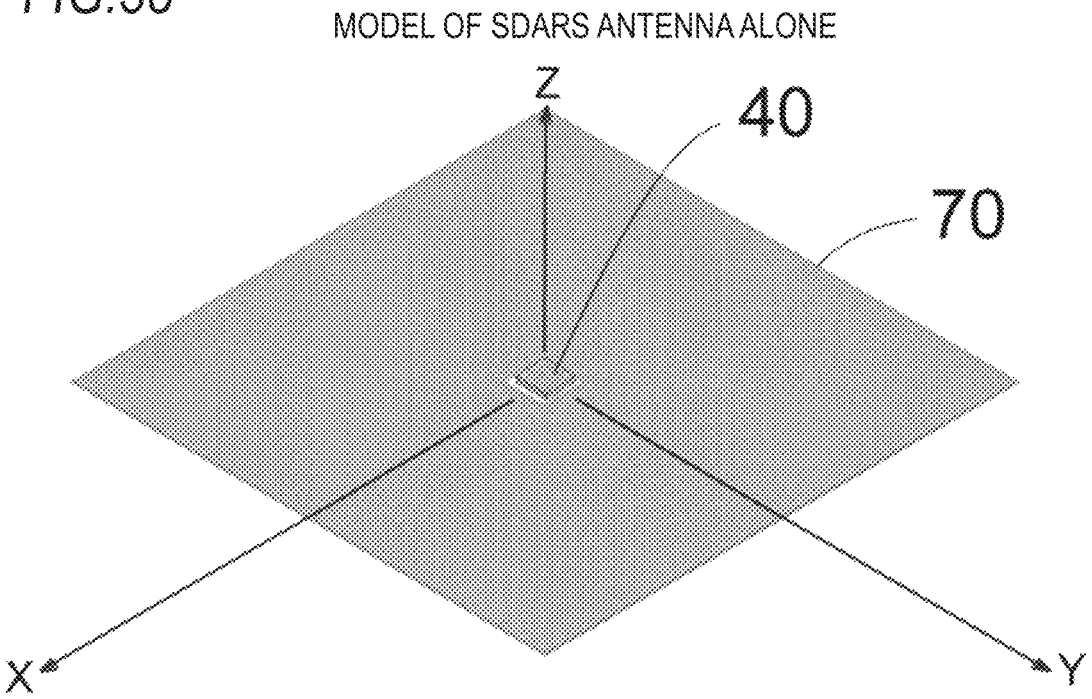
FIG. 38 is a diagram explaining a reference model of the SDARS antenna alone as a patch antenna.
Figure 39:
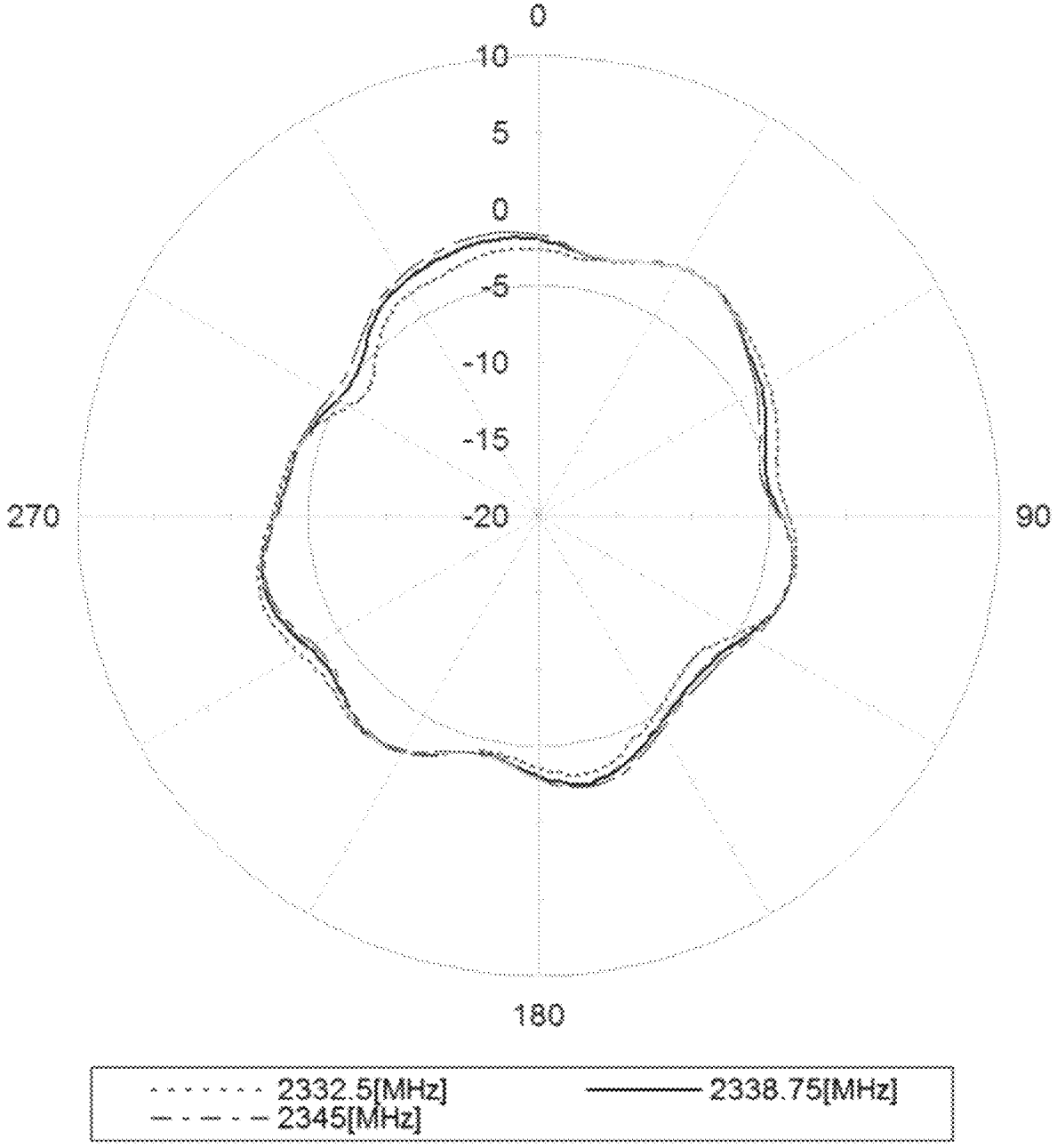
FIG. 39 is a directivity characteristic diagram illustrating a relationship between an azimuth and a gain at an elevation angle of 20°, which is horizontal plane directivity of the reference model.
Figure 40:
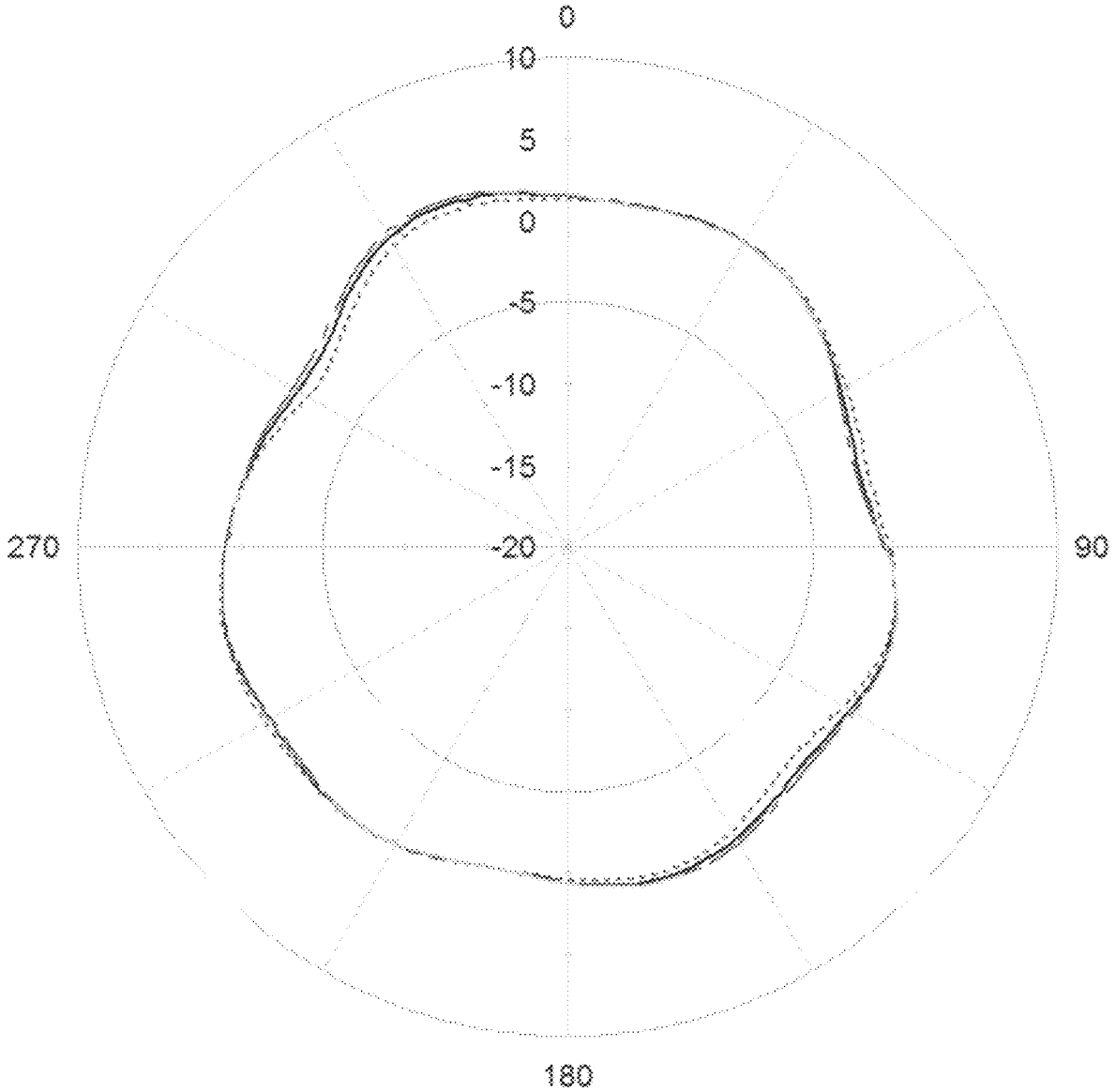
FIG. 40 is a directivity characteristic diagram illustrating a case where the elevation angle is 40° under the same conditions.
Figure 41:
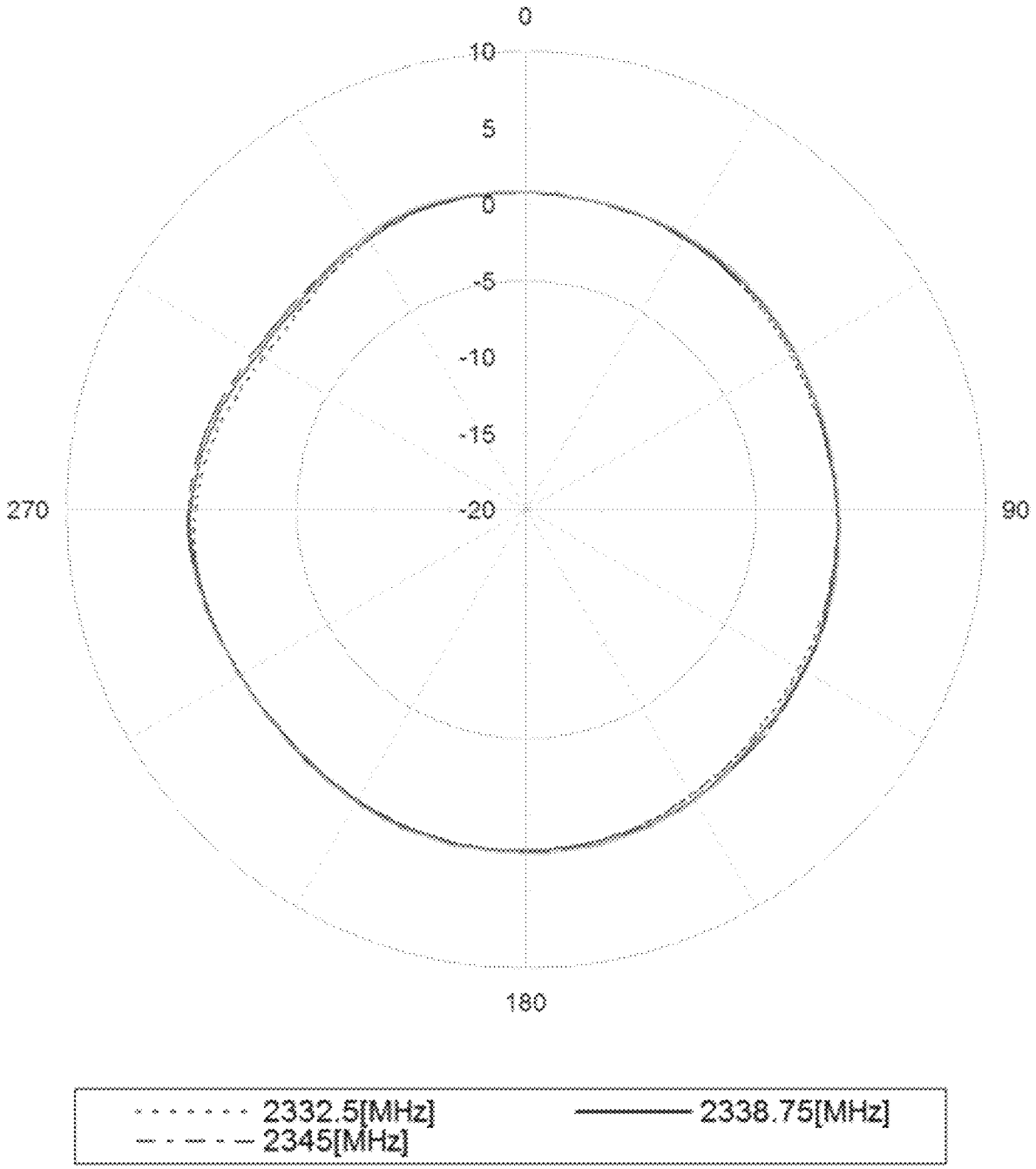
FIG. 41 is a directivity characteristic diagram illustrating a case where the elevation angle is 60° under the same conditions.
Figure 42:
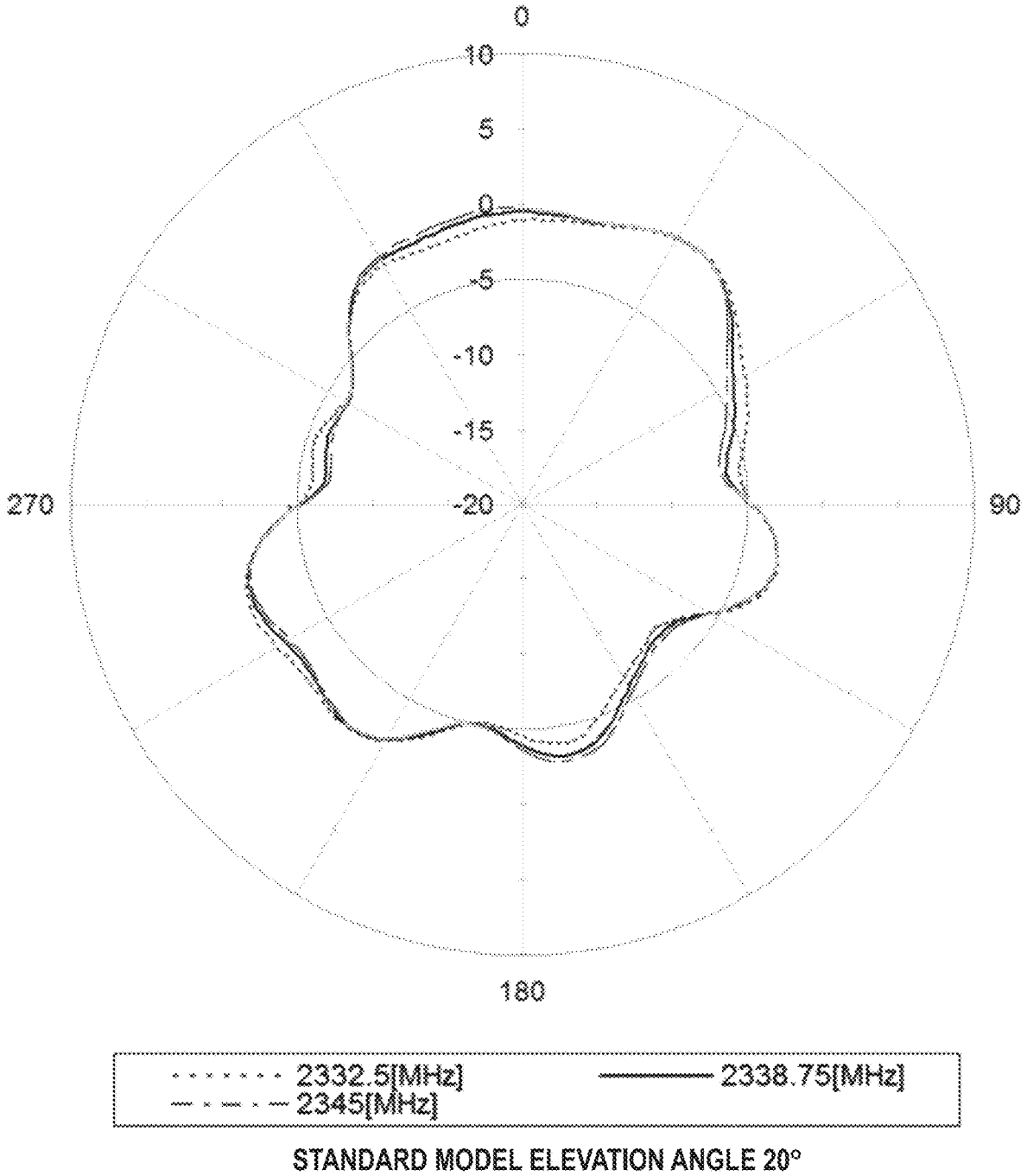
FIG. 42 is a directivity characteristic diagram illustrating a relationship between an azimuth and a gain at an elevation angle of 20°, which is horizontal plane directivity of the SDARS antenna in the standard model of FIG. 33B.
Figure 43:
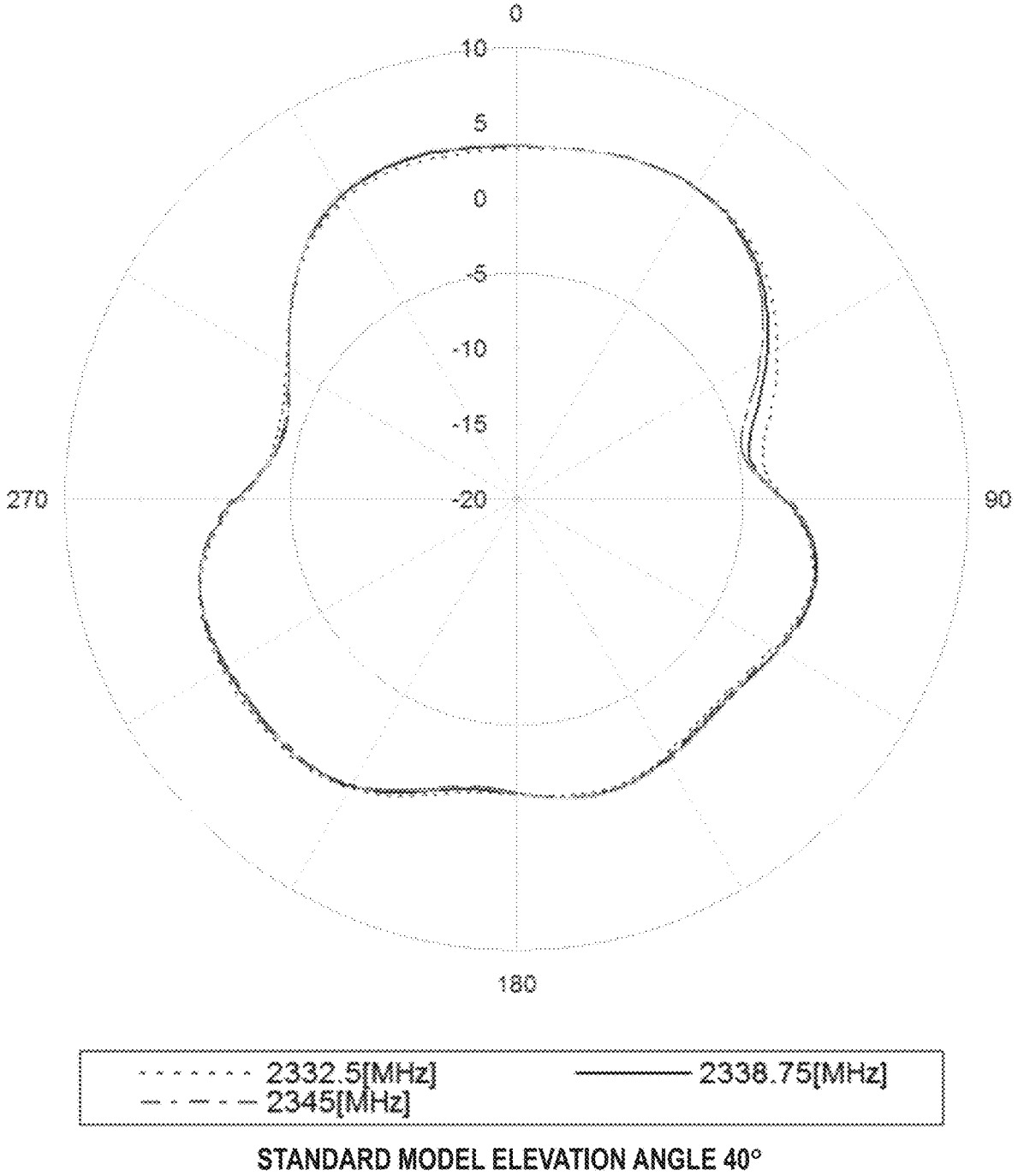
FIG. 43 is a directivity characteristic diagram illustrating a case where the elevation angle is 40° under the same conditions.
Figure 44:
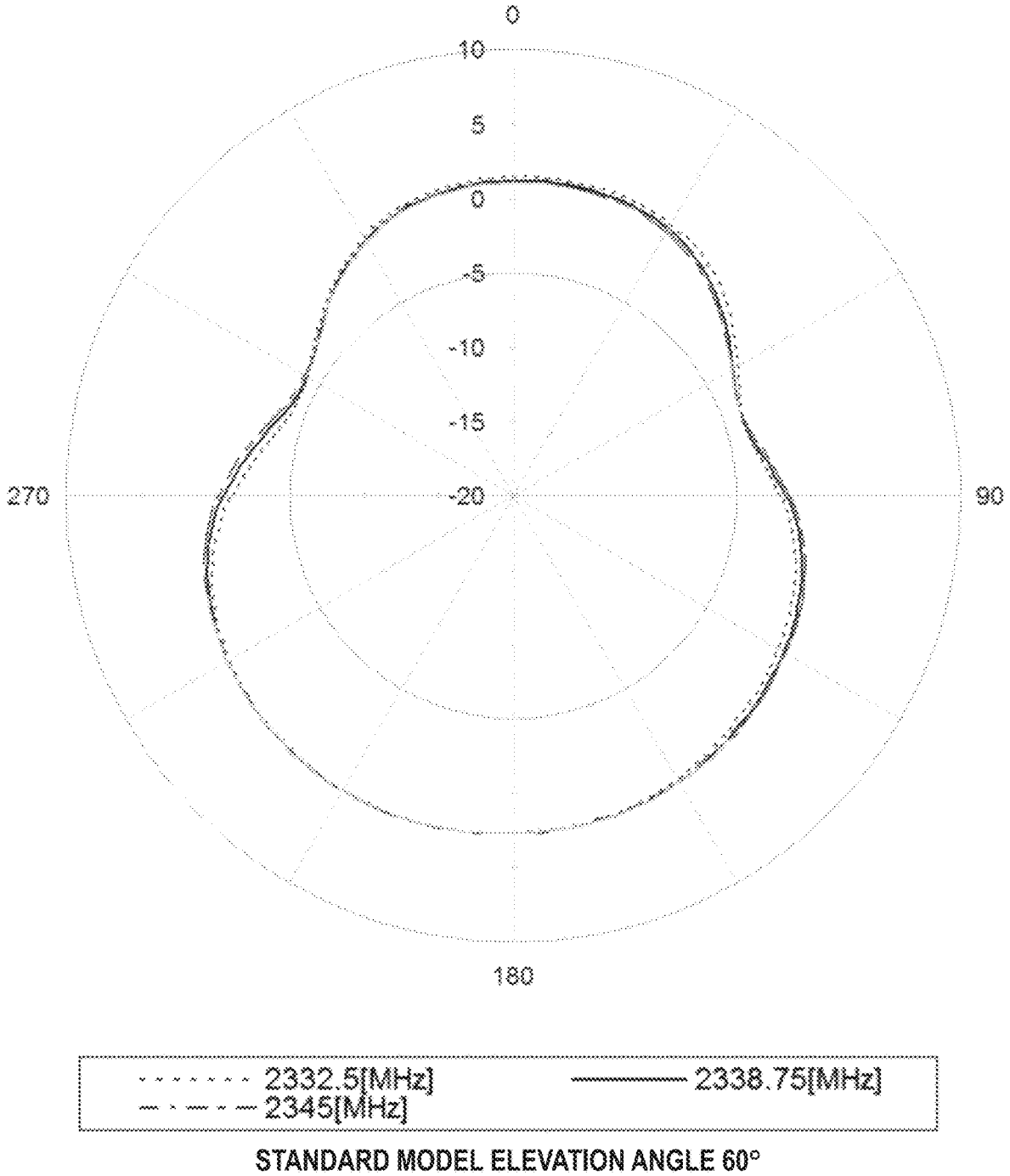
FIG. 44 is a directivity characteristic diagram illustrating a case where the elevation angle is 60° under the same conditions.
Figure 45:
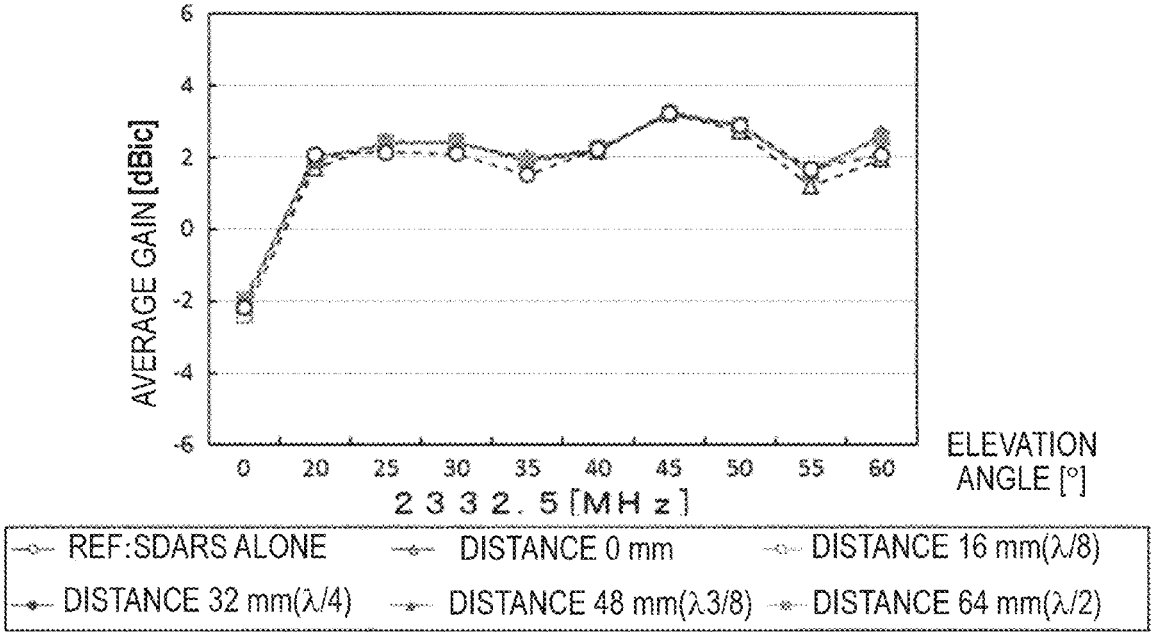
FIG. 45 is a graph illustrating a relationship between an elevation angle and an average gain at a frequency of 2332.5 MHz in the reference model of the SDARS antenna alone, and a case in which the distance between the capacitively loaded plate of the AM/FM antenna and the SDARS antenna is 0 mm to 64 mm (substantially $\lambda/2$).
Figure 46:
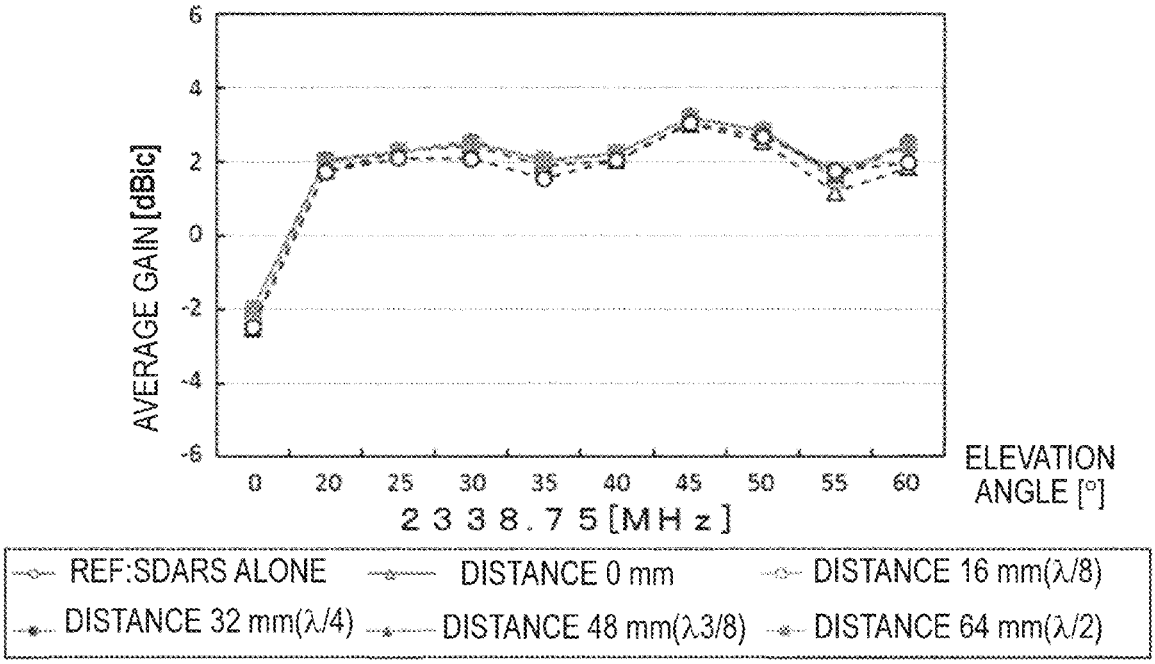
FIG. 46 is a graph illustrating a relationship between an elevation angle and an average gain at a frequency of 2338.75 MHz under the same conditions.
Figure 47:
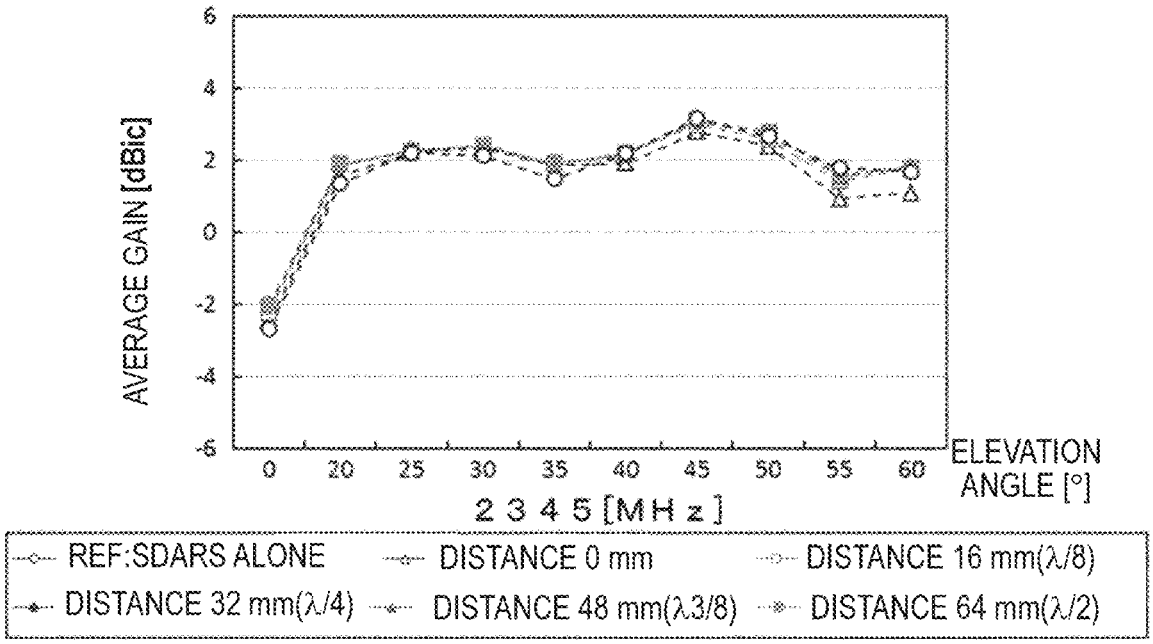
FIG. 47 is a graph illustrating a relationship between an elevation angle and an average gain at a frequency of 2345 MHz under the same conditions.
Figure 48:
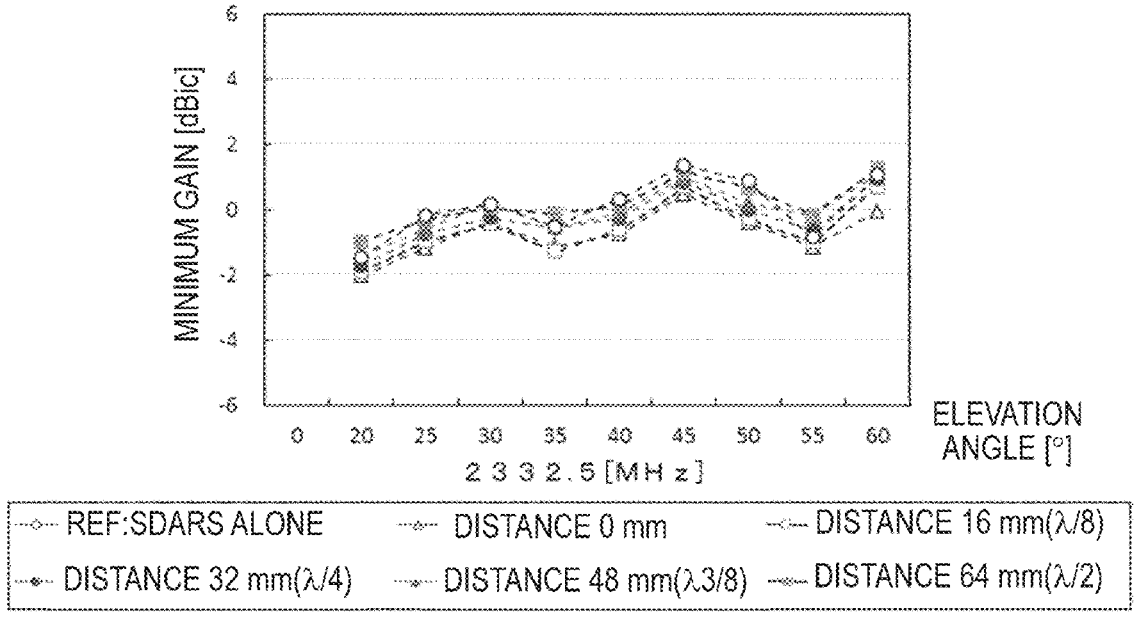
FIG. 48 is a graph illustrating a relationship between an elevation angle and a minimum gain at a frequency of 2332.5 MHz in the reference model of the SDARS antenna alone, and a case in which the distance between the capacitively loaded plate of the AM/FM antenna and the SDARS antenna is 0 mm to 64 mm.
Figure 49:
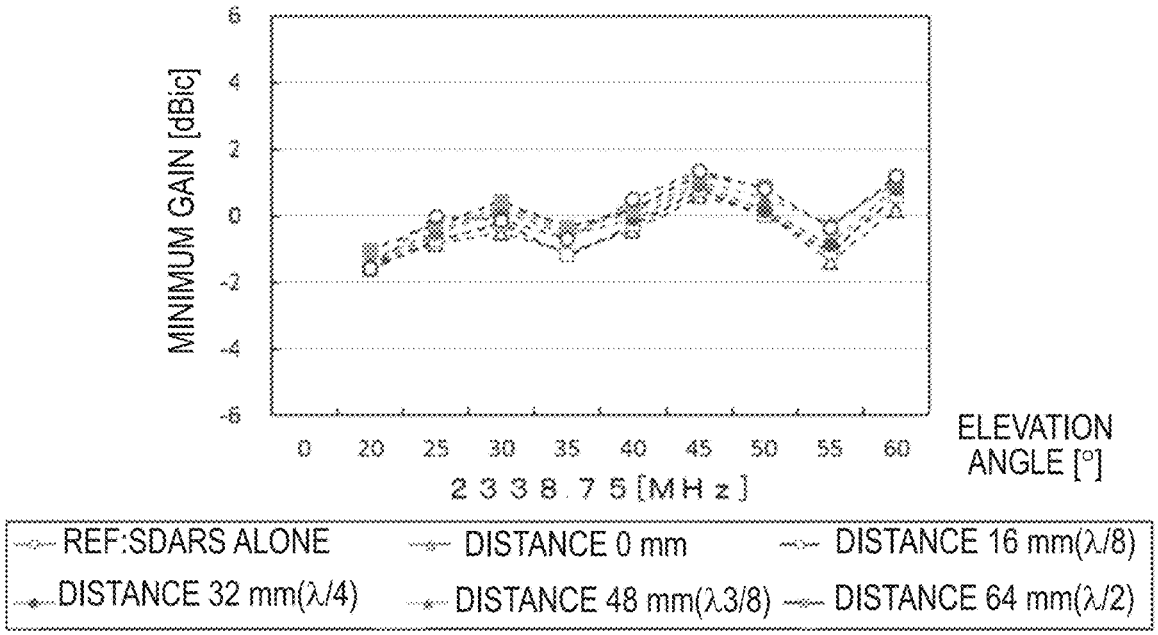
FIG. 49 is a graph illustrating a relationship between an elevation angle and a minimum gain at a frequency of 2338.75 MHz under the same conditions.
Figure 50:
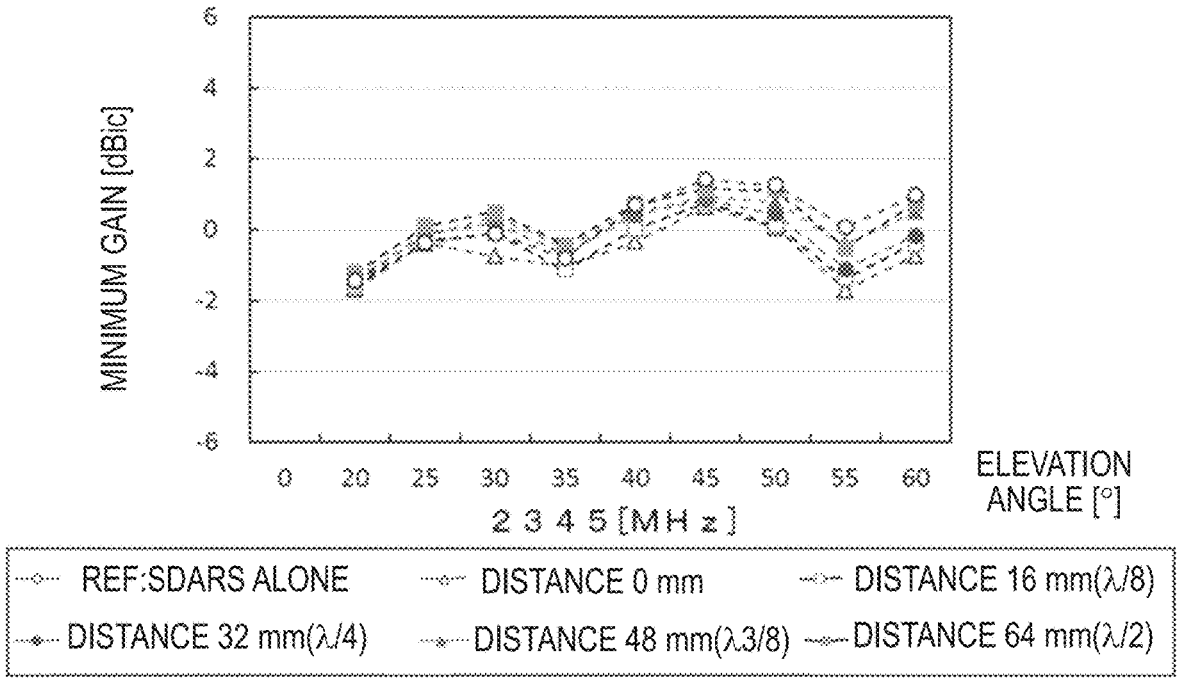
FIG. 50 is a graph illustrating a relationship between an elevation angle and a minimum gain at a frequency of 2345 MHz under the same conditions.
Figure 51:
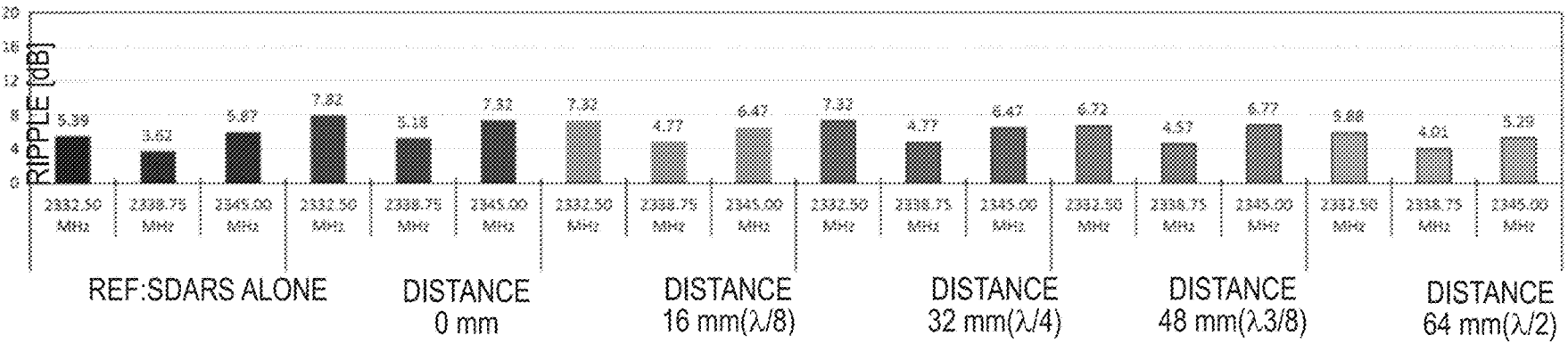
FIG. 51 is a graph illustrating a ripple (maximum gain-minimum gain) at each frequency in a frequency band of 2332.50 MHz to 2345.00 MHz when the elevation angle is 0°.
Figure 52:
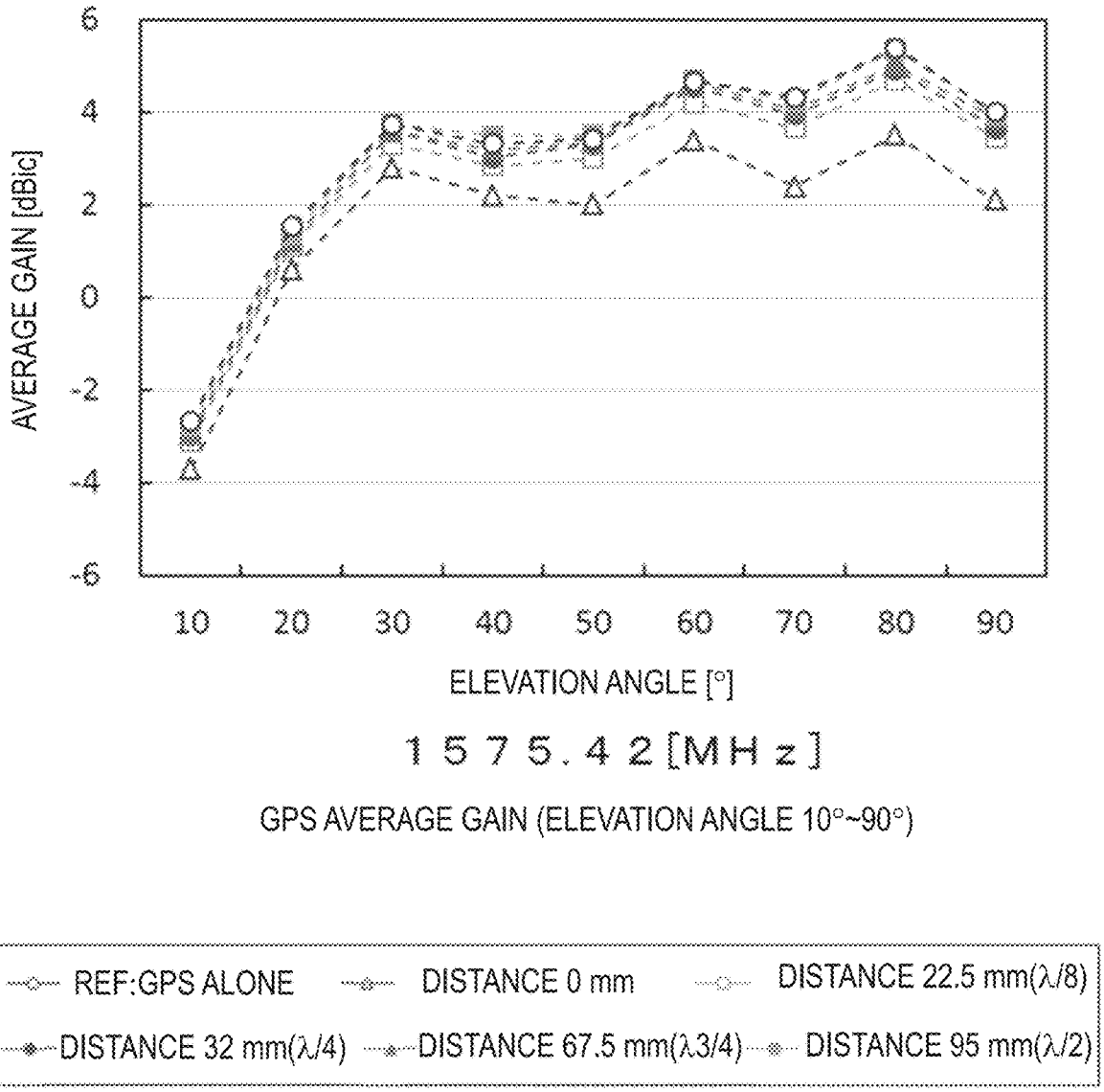
FIG. 52 is a graph illustrating a relationship between an elevation angle and an average gain at a frequency of 1575.42 MHz in the reference model of the GPS antenna alone, and a case in which the distance between the capacitively loaded plate and the GPS antenna is 0 mm to 95 mm (substantially $\lambda/2$).
Figure 53A:
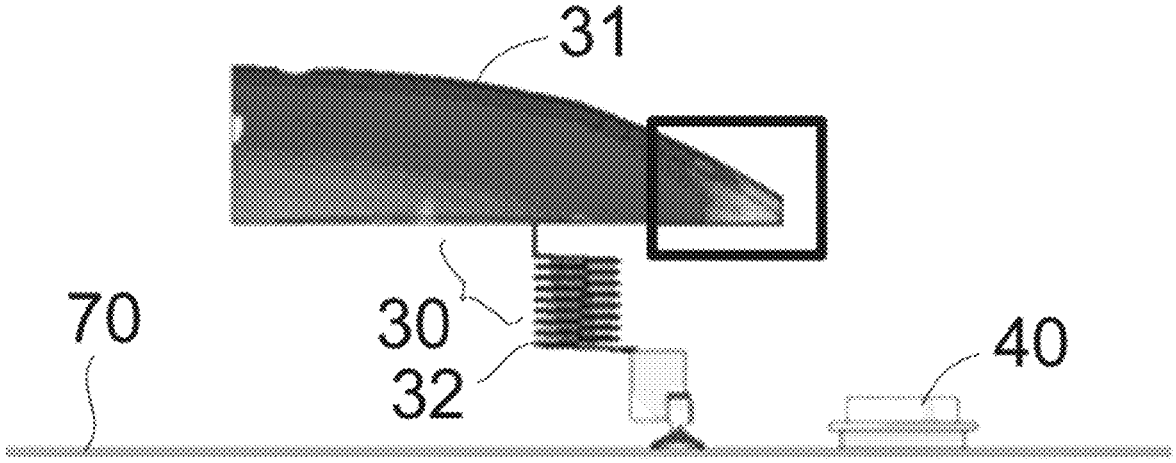
FIG. 53A is a right side view illustrating an electric field distribution in the capacitively loaded plate in the standard model in which the AM/FM antenna and the SDARS antenna are combined.
Figure 53B:
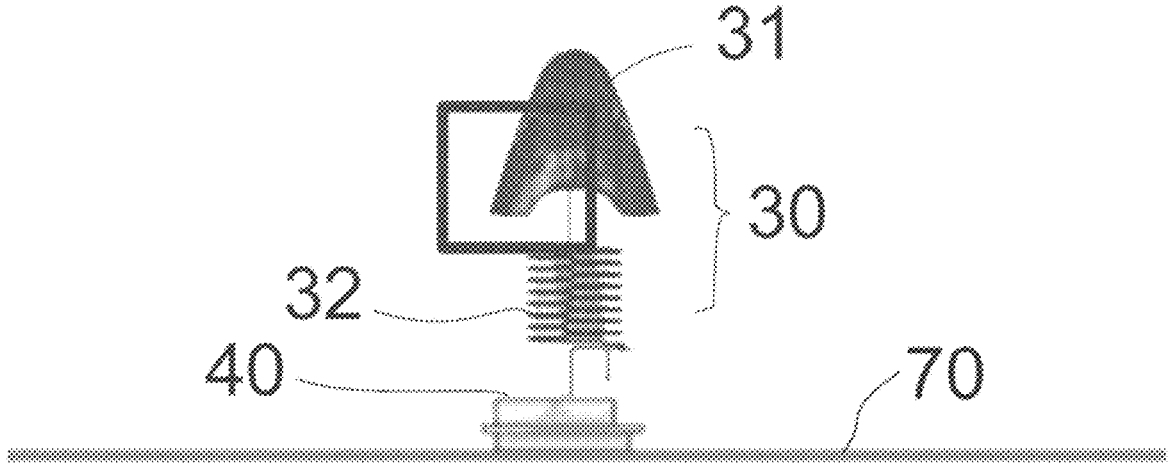
FIG. 53B is a rear view under the same conditions.
Figure 53C:
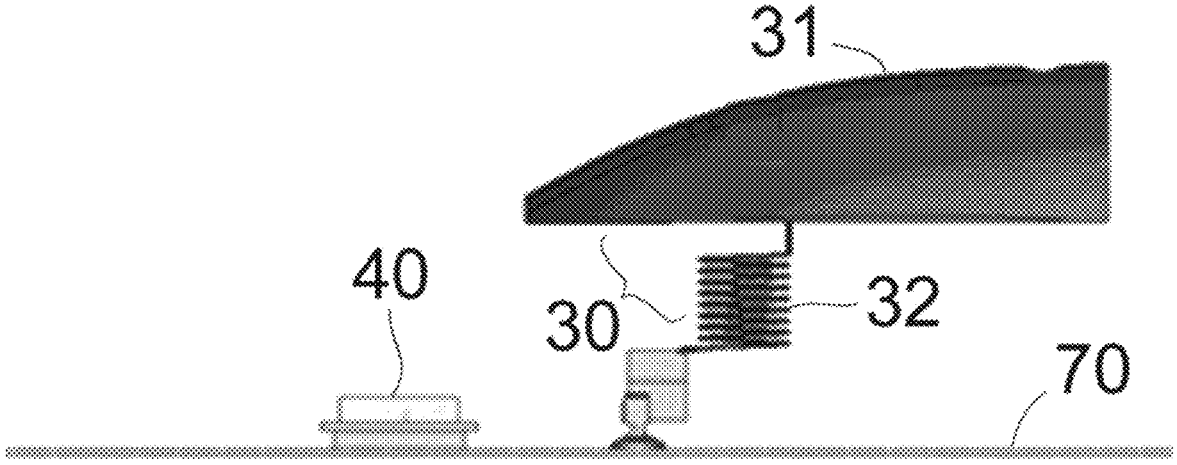
FIG. 53C is a left side view under the same conditions.
Figure 54A:
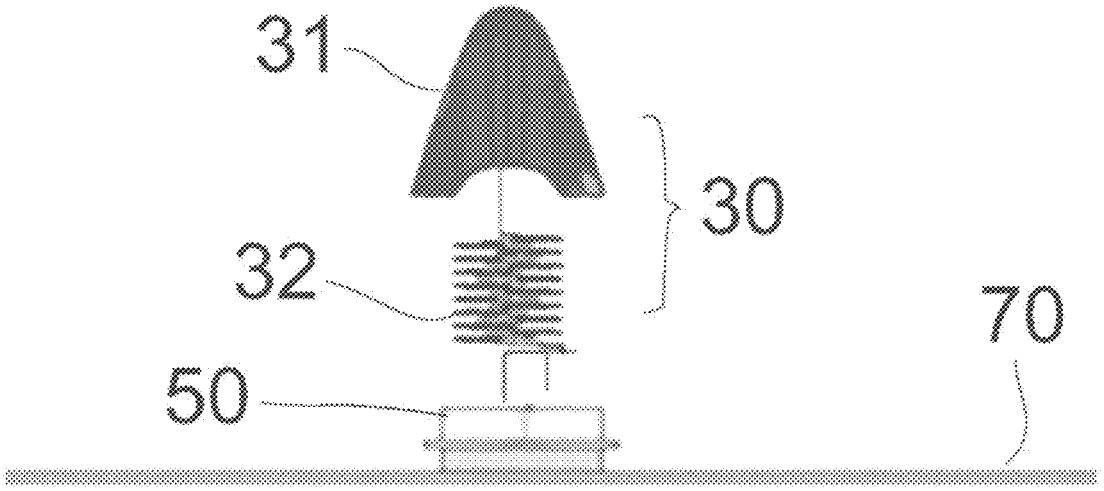
FIG. 54A is a rear view illustrating an electric field distribution in the capacitively loaded plate in the standard model in which the AM/FM antenna and the GPS antenna are combined.
Figure 54B:
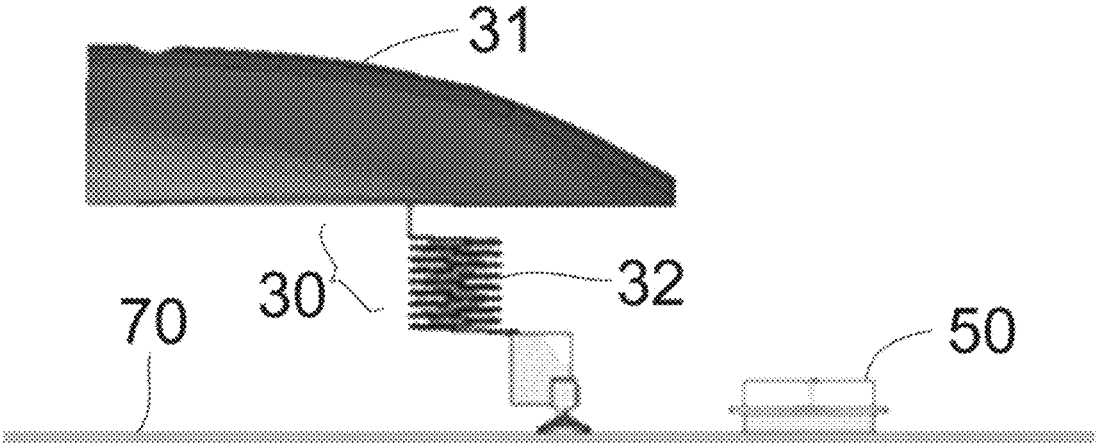
FIG. 54B is a right side view under the same conditions.
Figure 54C:
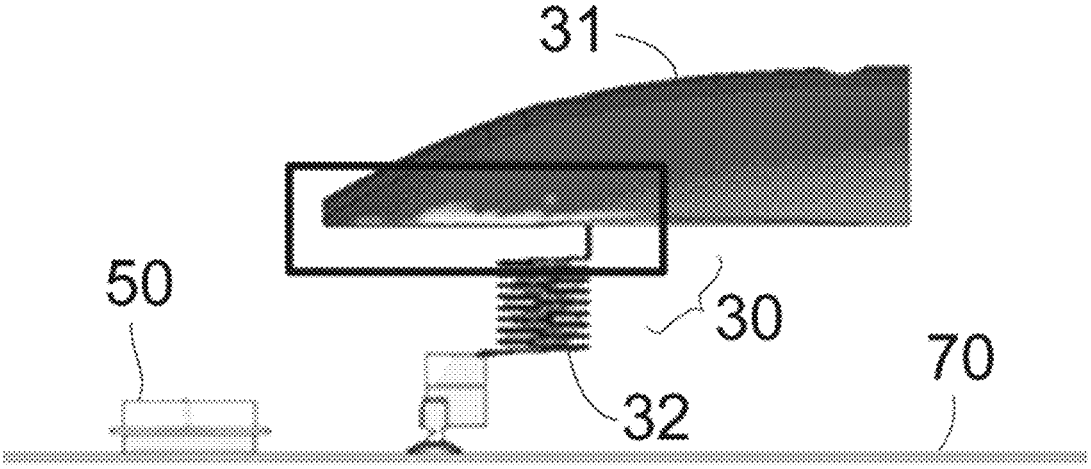
FIG. 54C is a left side view under the same conditions.

(2) Accordingly, even when the separation distance between the AM/FM antenna 30 and the SDARS antenna 40 is not sufficiently large, excellent directional characteristics close to non-directivity in which a difference between the maximum gain and the minimum gain of the SDARS antenna 40 is small can be obtained. For example, even when the separation distance between the AM/FM antenna 30 and the SDARS antenna 40 is substantially within ½ of a wavelength $\lambda_{SDARS}$ in the frequency band of the SDARS antenna 40, excellent directional characteristics close to non-directivity can be secured, and the size of the exterior case 5 can be reduced. In the measurement model of FIG. 6, the distance G1 between the capacitively loaded plate of the AM/FM antenna and the SDARS antenna defined by FIG. 36A is 10.3 mm (shorter than $\lambda_{SDARS}/8$), and antenna characteristics that are significantly shorter than the ½ wavelength of the SDARS band but are equivalent to those of the reference model of the SDARS antenna alone can be obtained.

Embodiment 2

Figure 25A:
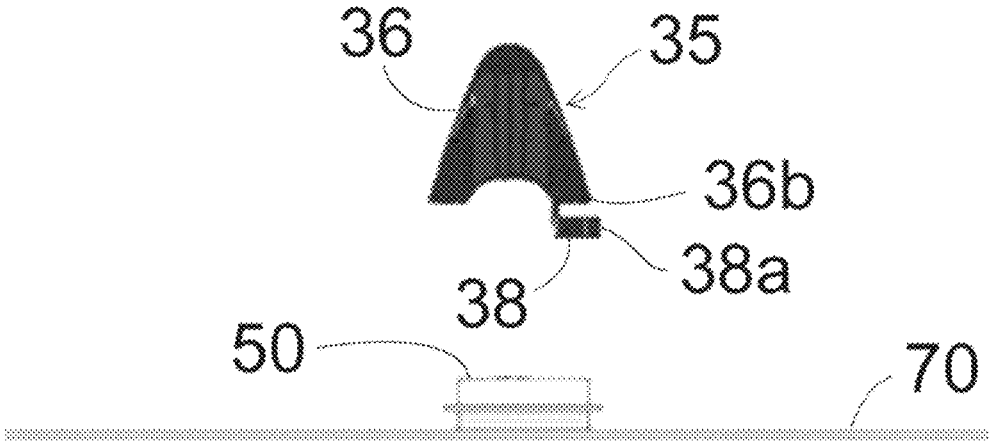
FIG. 25A is a rear view illustrating an electric field distribution in the conductor main body portion of the capacitively loaded plate and the additional conductor portion integrated therewith when a radio wave in a frequency band of a GPS antenna is transmitted in a measurement model where major structural portions of Embodiment 2 (case where the GPS antenna is arranged in front of the AM/FM antenna) according to the present invention are arranged on a ground plane.
Figure 25B:
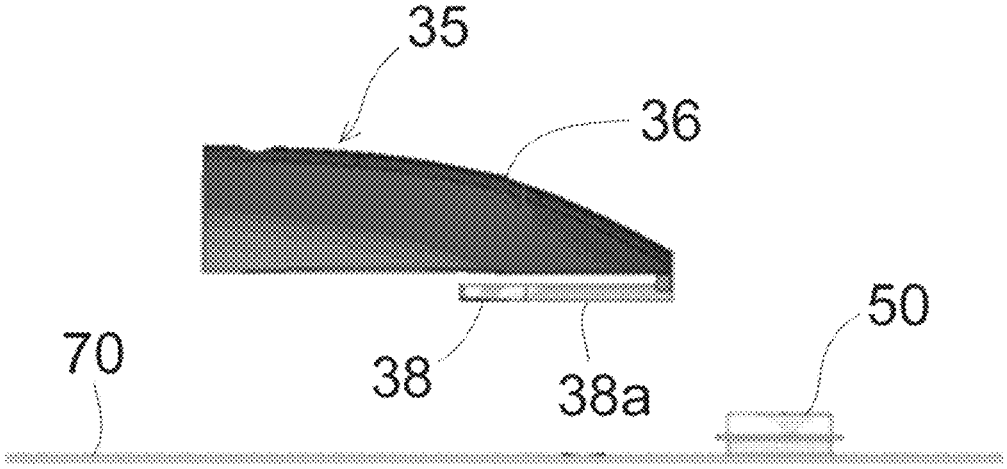
FIG. 25B is a right side view under the same conditions.
Figure 25C:
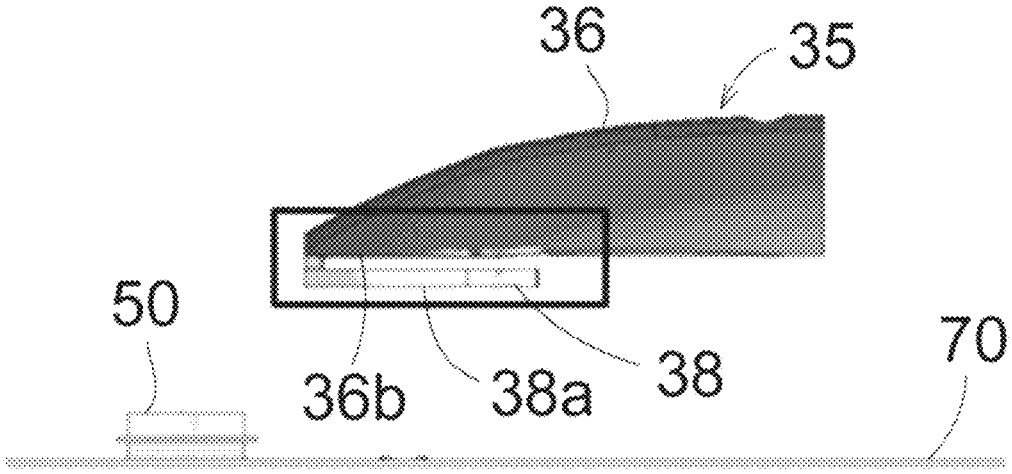
FIG. 25C is a left side view under the same conditions.

Embodiment 2 of the antenna device according to the present invention has a configuration in which the GPS antenna 50 as the second antenna is provided instead of the SDARS antenna according to Embodiment 1 illustrated in FIG. 1 (that is, the GPS antenna 50 is arranged in front of the AM/FM antenna). In this case, as illustrated in FIGS. 25A to 25C, the capacitively loaded plate 35 includes: the conductor main body portion 36; and an additional conductor portion 38 including a parallel strip-shaped portion 38*a* extending in parallel to face a front lower edge 36*b* of a left side surface of the conductor main body portion 36. The length of the parallel strip-shaped portion 38*a* along the front lower edge 36*b* of the conductor main body portion 36 is set as a length 45 mm) that is ¼ of an effective wavelength in the frequency band of the GPS antenna 50 (may be set as a length that is substantially ¼ of the effective wavelength). In addition, it is necessary that the parallel strip-shaped portion 38*a* is arranged to correspond to a region having a high electric field of the conductor main body portion 36 in the frequency band of the GPS antenna 50.

FIG. 25A is a rear view (view when the antenna device is seen from the front side) illustrating an electric field distribution on the capacitively loaded plate (the conductor main body portion and the conductor portion) when a radio wave (right circularly polarized wave) in the frequency band of the GPS antenna is transmitted in a measurement model where major structural portions of Embodiment 2 are arranged on the ground plane 70. FIG. 25B is a right side view under the same conditions. FIG. 25C is a left side view under the same conditions. In FIGS. 25A to 25C, a bright portion (light-colored portion) is a portion having a high electric field. It is understood from FIGS. 25A to 25C that the electric field of a lower edge portion of a left side front surface of the conductor main body portion 36 is high, and the electric field of the additional conductor portion 38 facing the lower edge portion is also high.

Figure 26A:
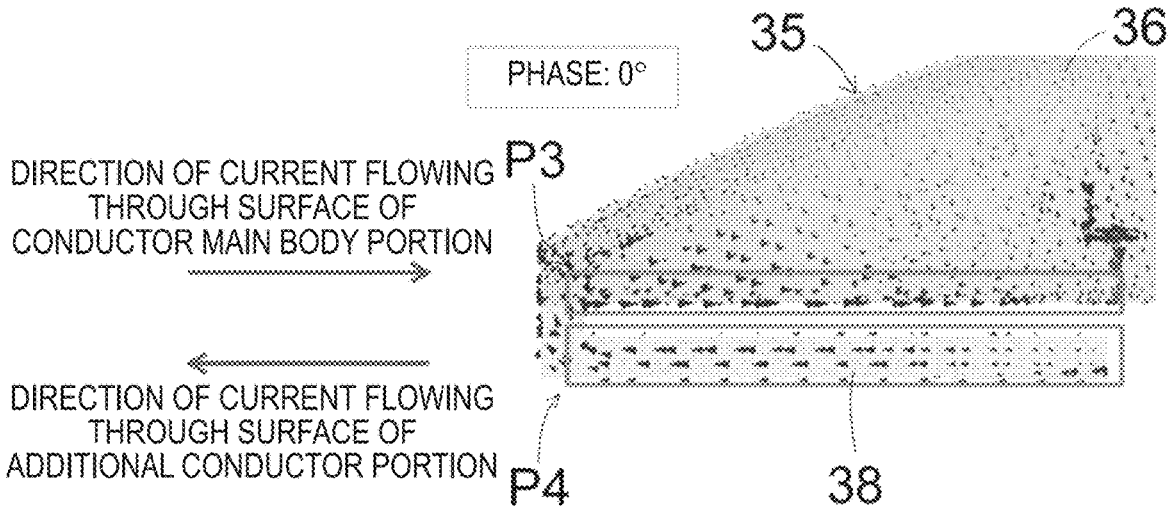
FIG. 26A is a diagram illustrating a current state (phase: 0°) in a left side surface of the capacitively loaded plate and the additional conductor portion integrated therewith in Embodiment 2.
Figure 26B:
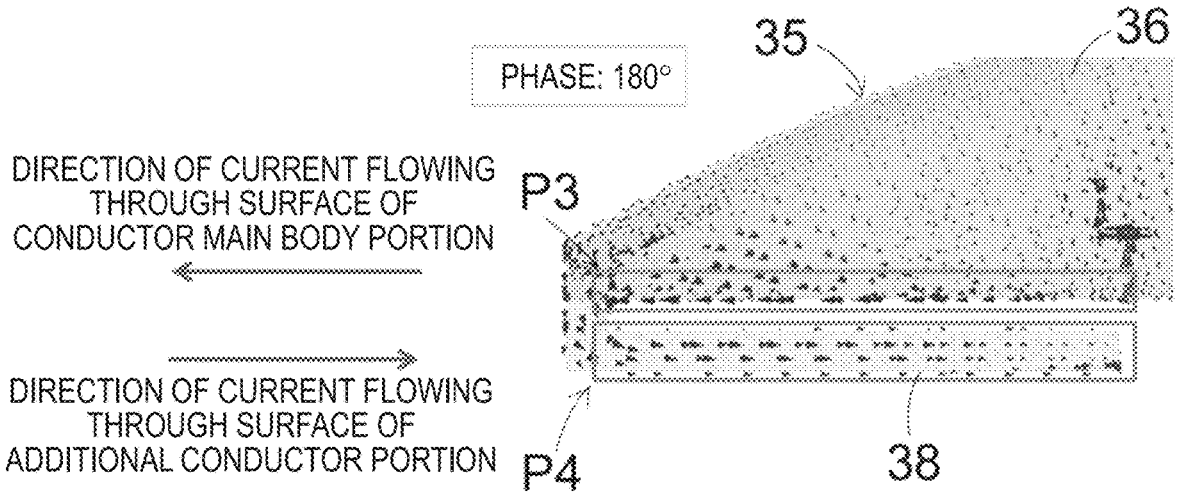
FIG. 26B is a diagram illustrating a current state (phase: 180°) in the left side surface of the conductor portion under the same conditions.

In addition, FIG. 26A illustrates a current distribution (phase: 0°) of the left side surface of the capacitively loaded plate 35 (the conductor main body portion 36 and the additional conductor portion 38), and FIG. 26B illustrates a current distribution (phase: 180°) of the left side surface of the capacitively loaded plate 35. It is understood from these diagrams that the direction of a current (current flowing through the surface of the conductor main body portion) of the lower edge portion (in a rectangular frame P3 of FIGS. 26A and 26B) of the left side front surface of the conductor main body portion 36 in the capacitively loaded plate 35 is opposite to the direction of a current (current flowing through the surface of the additional conductor portion) of a portion (in a rectangular frame P4 of FIGS. 26A and 26B) of the additional conductor portion 38 facing the lower edge portion. The current in the rectangular frame P3 and the current in the rectangular frame P4 offset each other, and thus disturbance (deviation) in directional characteristics caused by the high electric field in the lower edge portion of the left side front surface of the conductor main body portion 36 can be reduced.

Figure 27:
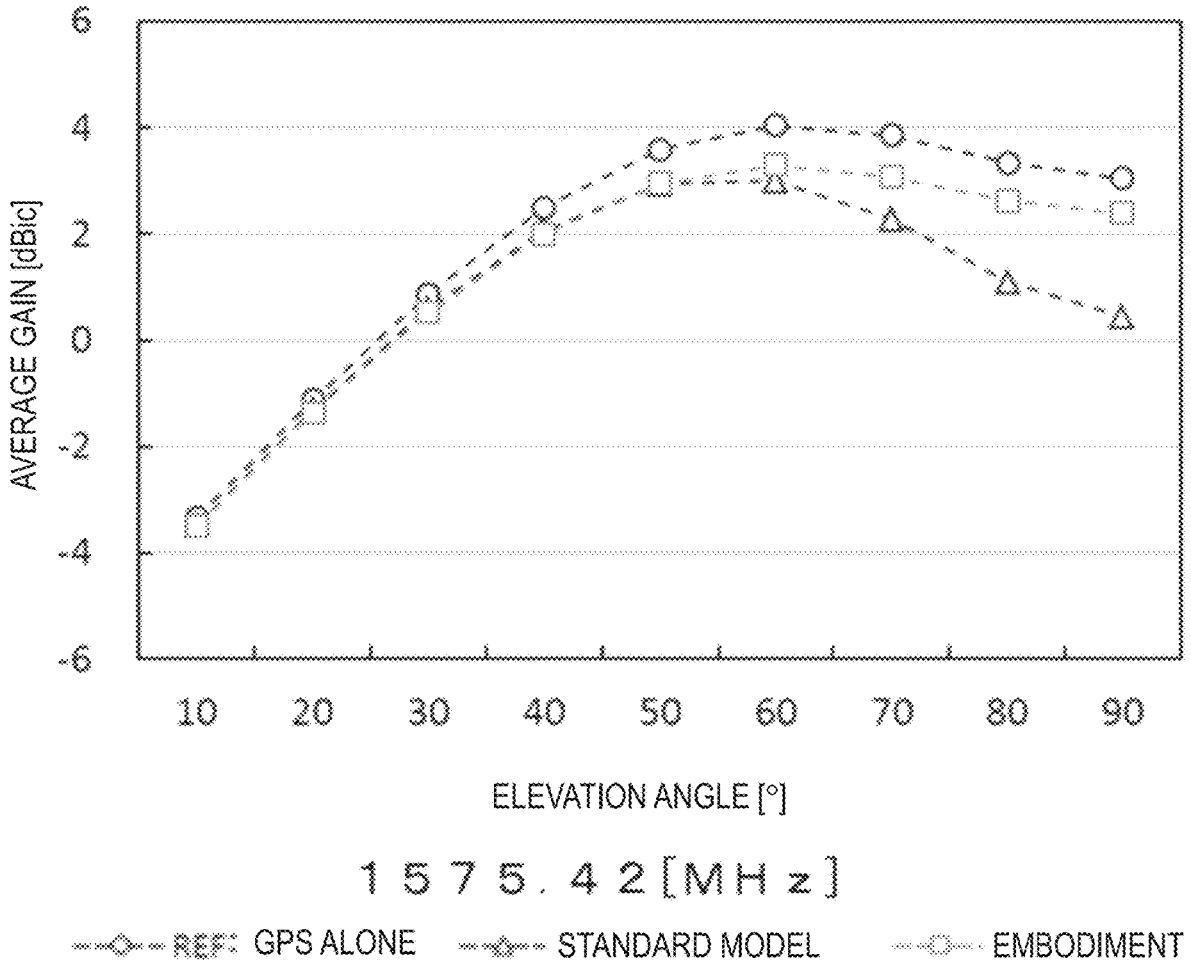
FIG. 27 is a graph illustrating a relationship an elevation angle of 10° to 90° and an average gain in the GPS antenna alone as a patch antenna, the standard model (example of the related art) where the conductor portion is not added, and a measurement model of Embodiment 2.

FIG. 27 is a graph illustrating a relationship an elevation angle of 10° to 90° and a circular polarization average gain (dBic) in the GPS antenna alone as a patch antenna, the standard model (example of the related art) where the conductor portion is not added, and Embodiment 2 (measurement model). It is understood from this diagram that the circular polarization average gain of the measurement model of Embodiment 2 is higher than that of the standard model and is a value close to that of the GPS antenna alone. In particular, it can be confirmed that the improvement degree becomes more significant at a larger evaluation angle and the circular polarization average gain is improved by 1.9 dBic at an elevation angle of 90°, by 1.5 dBic at an elevation angle of 80°, by 0.8 dBic at an elevation angle of 70°, and by 0.3 dBic at an elevation angle of 60°. In addition, at an elevation angle of 90° axis ratio, the average gain of the model of the GPS antenna alone is 1.5 dB as a target value, whereas the average gain of the standard model is 7.7 dB, and the average gain of Embodiment 2 is 2.0 dB. Therefore, it is confirmed that the average gain of Embodiment 2 is improved.

As described above, it can be seen from FIG. 27 that, according to the Embodiment 2, even when the separation distance between the AM/FM antenna 30 and the GPS antenna 50 is substantially ½ or less of $\lambda_{GPS}$, excellent antenna characteristic as the GPS antenna can be obtained.

Embodiment 3

Embodiment 3 of the antenna device according to the present invention has a configuration in which the SDARS antenna is arranged behind the AM/FM antenna instead of being disposed in front of the AM/FM antenna as in Embodiment 1 illustrated in FIG. 1.

Figure 28A:
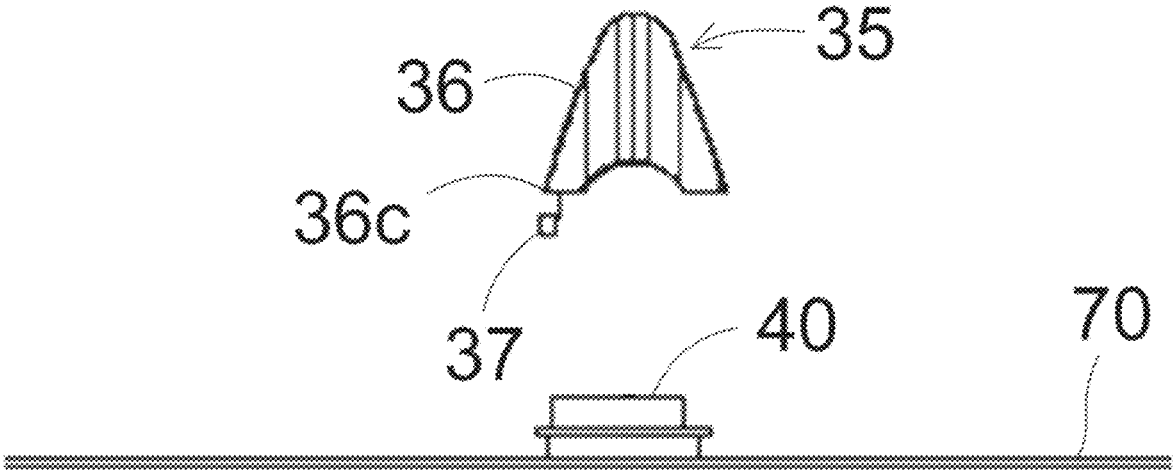
FIG. 28A is a rear view illustrating major structural portions of Embodiment 3 (case where the SDARS antenna is arranged behind the AM/FM antenna).
Figure 28B:
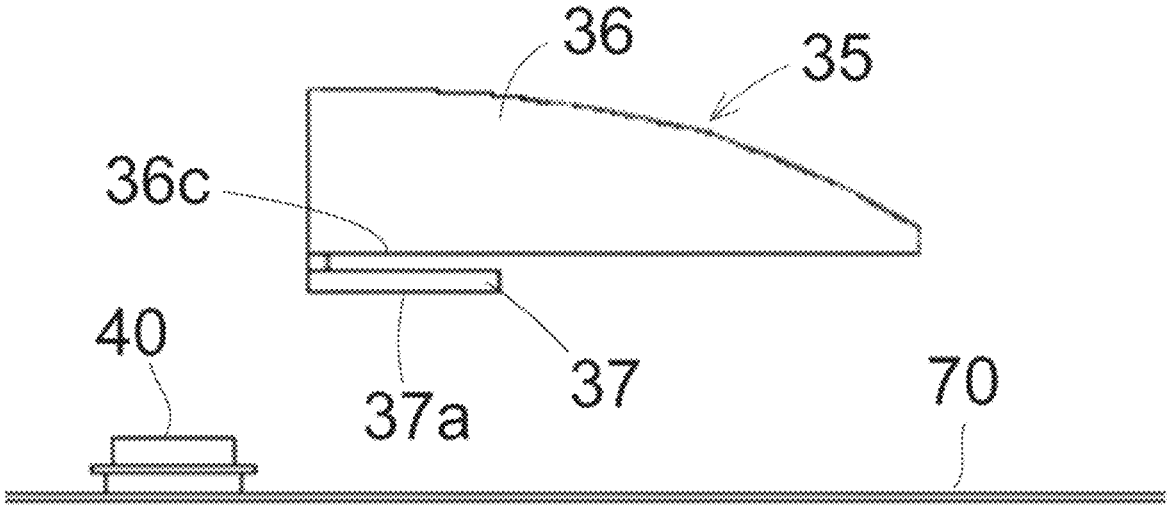
FIG. 28B is a right side view under the same conditions.
Figure 28C:
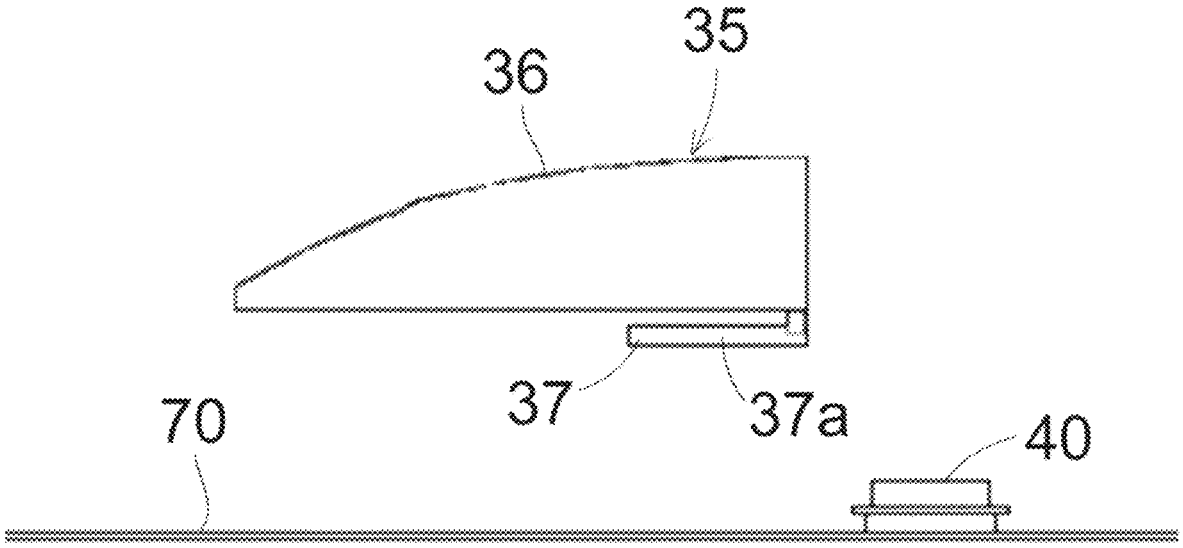
FIG. 28C is a left side view under the same conditions.

FIG. 28A is a rear view (view when the antenna device is seen from the front side) illustrating a model in which major structural portions of Embodiment 3 of the antenna device according to the present invention are arranged on the ground plane 70, and the SDARS antenna is arranged behind the AM/FM antenna. FIG. 28B is a right side view under the same conditions. FIG. 28C is a left side view under the same conditions. In this antenna device, as illustrated in FIG. 1, the AM/FM antenna 30 and the SDARS antenna 40 therebehind are accommodated in an internal space surrounded by the exterior case 5 which is constituted by the base 10 and the cover 20 covering the base (for example, having a shark fin-shape).

In this case, the capacitively loaded plate 35 formed of a conductor plate includes: the conductor main body portion 36; and the additional conductor portion 37 including the parallel strip-shaped portion 37*a* extending in parallel to a rear side lower edge 36*c* of the conductor main body portion 36. A region having a high electric field of the conductor main body portion 36 is the rear side lower edge portion of the right side surface of the conductor main body portion 36. Therefore, the parallel strip-shaped portion 37*a* of the additional conductor portion 37 is arranged to face the rear side lower edge 36*c* of the right side surface of the conductor main body portion 36 at a short distance. The length of the parallel strip-shaped portion 37*a* along the rear side lower edge 36*c* of the conductor main body portion 36 is set as a length that is ¼ of an effective wavelength in the frequency band of the SDARS antenna 40 (may be set as a length that is substantially ¼ of the effective wavelength).

The other configurations are similar to those of Embodiment 1, and the similar effects as those of Embodiment 1 can be obtained.

Embodiment 4

Embodiment 4 of the antenna device according to the present invention has a configuration in which the GPS antenna is arranged behind the AM/FM antenna instead of being disposed in front of the AM/FM antenna as in Embodiment 2 illustrated in FIGS. 25A to 25C.

Figure 29A:
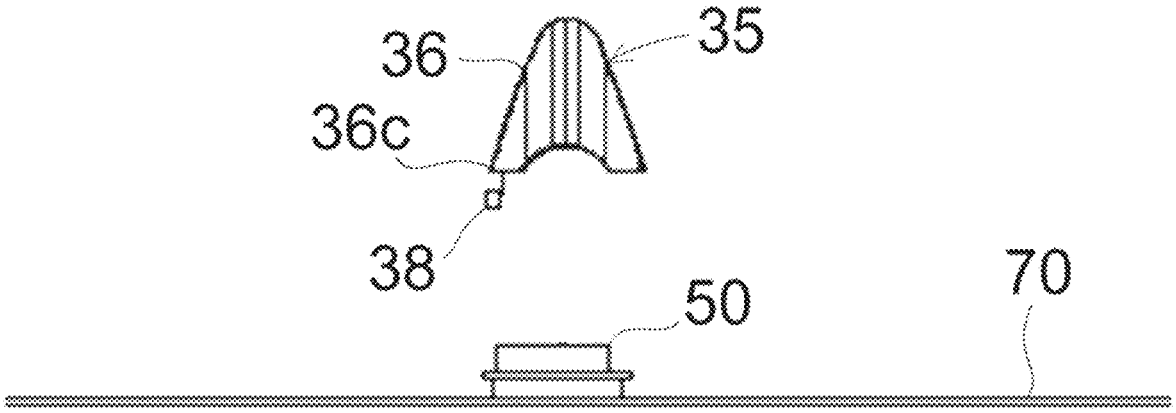
FIG. 29A is a rear view illustrating major structural portions of Embodiment 4 (case where the GPS antenna is arranged behind the AM/FM antenna).
Figure 29B:
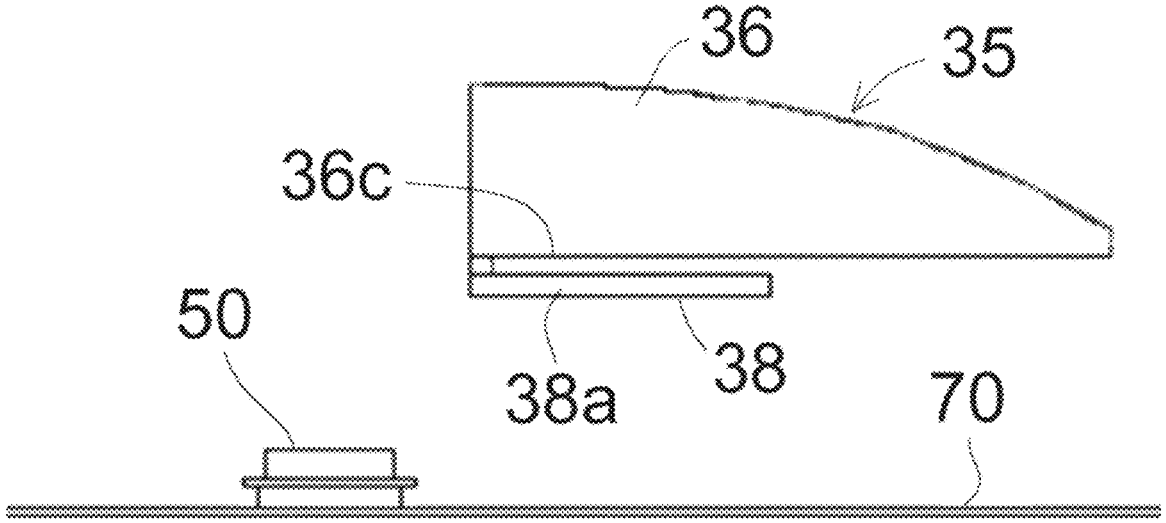
FIG. 29B is a right side view under the same conditions.
Figure 29C:
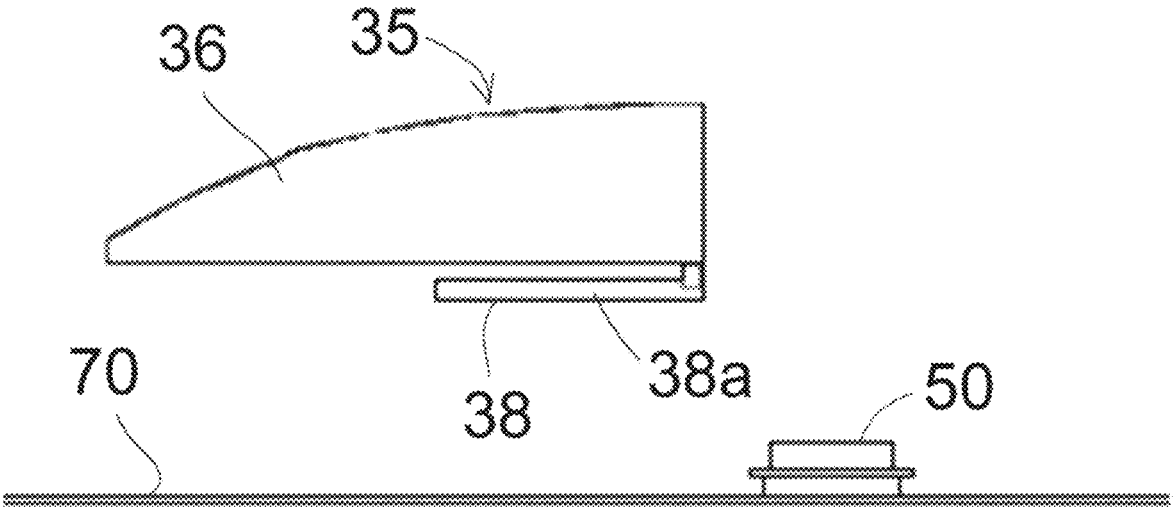
FIG. 29C is a left side view under the same conditions.

FIG. 29A is a rear view (view when the antenna device is seen from the front side) illustrating a model in which major structural portions of Embodiment 4 of the antenna device according to the present invention are arranged on the ground plane 70, and the GPS antenna is arranged behind the AM/FM antenna. FIG. 29B is a right side view under the same conditions. FIG. 29C is a left side view under the same conditions. In the antenna device, as illustrated in FIG. 1, the AM/FM antenna 30 and the GPS antenna 50 therebehind are accommodated in an internal space surrounded by the exterior case 5 which is constituted by the base 10 and the cover 20 covering the base (for example, having a shark fin-shape).

In this case, the capacitively loaded plate 35 formed of a conductor plate includes: the conductor main body portion 36; and the additional conductor portion 38 including the parallel strip-shaped portion 38*a* extending in parallel to a rear side lower edge 36*c* of the conductor main body portion 36. A region having a high electric field of the conductor main body portion 36 is the rear side lower edge portion of the right side surface of the conductor main body portion 36. Therefore, the parallel strip-shaped portion 38*a* of the additional conductor portion 38 is arranged to face the rear side lower edge 36*c* of the right side surface of the conductor main body portion 36 at a short distance. The length of the parallel strip-shaped portion 38*a* along the rear side lower edge 36*c* of the conductor main body portion 36 is set as a length that is ¼ of an effective wavelength in the frequency band of the GPS antenna 50 (may be set as a length that is substantially ¼ of the effective wavelength).

The other configurations are similar to those of Embodiment 2, and the similar effects as those of Embodiment 2 can be obtained.

Embodiment 5

Embodiment 5 of the antenna device according to the present invention has a configuration in which the SDARS antenna of Embodiment 1 illustrated in FIG. 1 is arranged in front of the AM/FM antenna and the GPS antenna is additionally provided in front of the AM/FM antenna but behind the SDARS antenna.

Figure 30A:
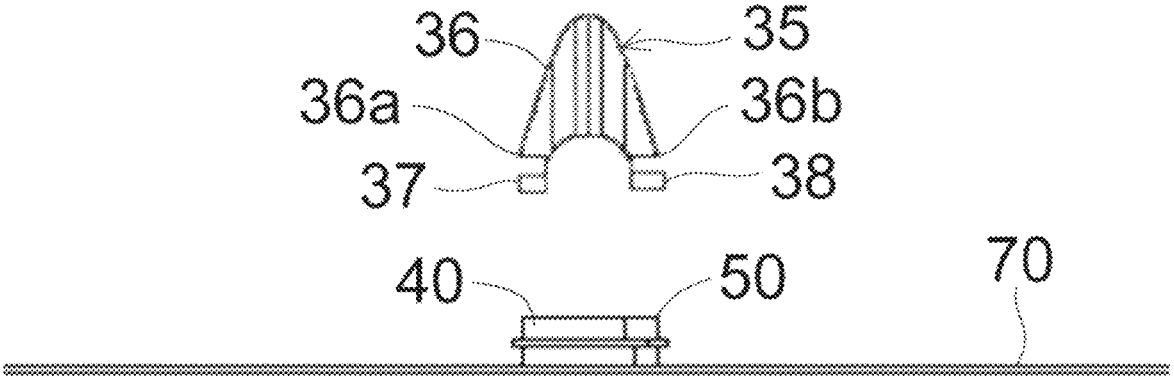
FIG. 30A is a rear view illustrating major structural portions of Embodiment 5 (case where the SDARS antenna and the GPS antenna are arranged in front of the AM/FM antenna).
Figure 30B:
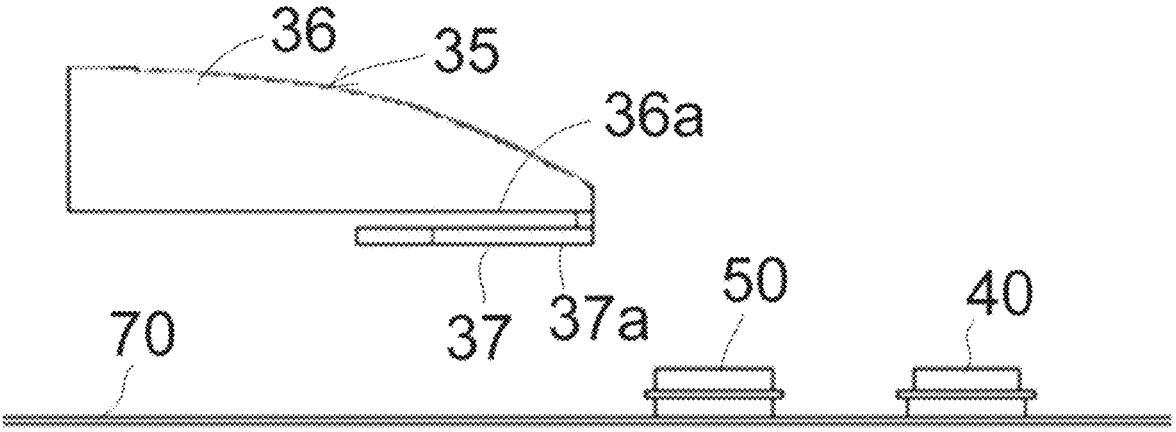
FIG. 30B is a right side view under the same conditions.
Figure 30C:
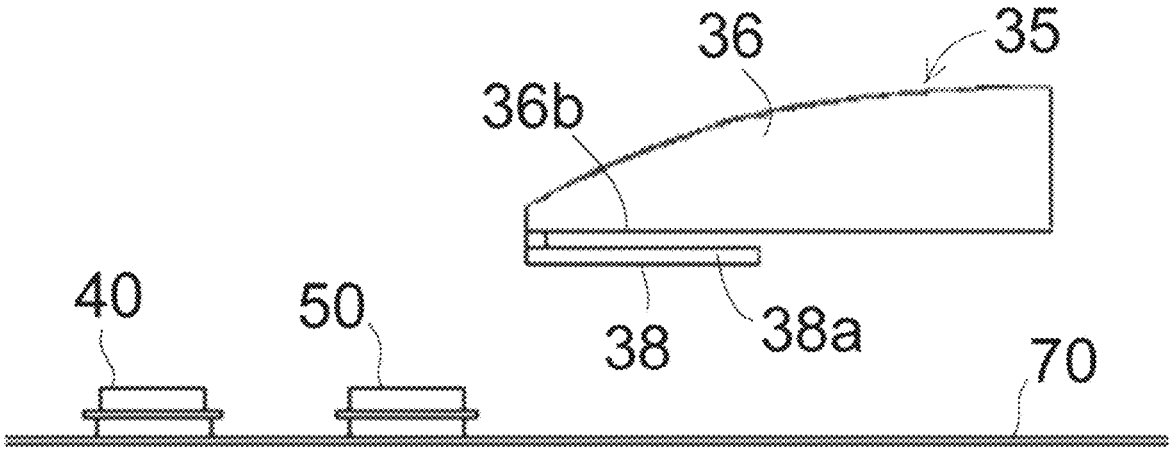
FIG. 30C is a left side view under the same conditions.

FIG. 30A is a rear view (view when the antenna device is seen from the front side) illustrating a model in which major structural portions of Embodiment 5 of the antenna device according to the present invention are arranged on the ground plane 70, and the SDARS antenna and the GPS antenna are arranged in front of the AM/FM antenna. FIG. 30B is a right side view under the same conditions. FIG. 30C is a left side view under the same conditions. In the antenna device, as illustrated in FIG. 1, the AM/FM antenna 30, and the SDARS antenna 40 and the GPS antenna 50 in front thereof are accommodated in an internal space surrounded by the exterior case 5 which is constituted by the base 10 and the cover 20 covering the base (for example, having a shark fin-shape). Here, the AM/FM antenna 30 corresponds to the first antenna, the SDARS antenna 40 corresponds to the second antenna, and the GPS antenna 50 corresponds to the third antenna. In Embodiment 5, the SDARS antenna 40, the GPS antenna 50, and the AM/FM antenna 30 are disposed in this order from the front side. However, the arrangement of the SDARS antenna 40 and the GPS antenna 50 may be reversed.

The capacitively loaded plate 35 formed of a conductor plate includes: the conductor main body portion 36; the additional conductor portion 37 (corresponding to the SDARS antenna 40) including the parallel strip-shaped portion 37*a* extending in parallel to the front lower edge 36*a* of the right side surface of the conductor main body portion 36; and the additional conductor portion 38 (corresponding to the GPS antenna 50) including the parallel strip-shaped portion 38*a* extending in parallel to the front lower edge 36*b* of the left side surface of the conductor main body portion 36. The length of the parallel strip-shaped portion 37*a* along the front lower edge 36*a* of the conductor main body portion 36 is set as a length that is ¼ of an effective wavelength in the frequency band of the SDARS antenna 40 (may be set as a length that is substantially ¼ of the effective wavelength). The length of the parallel strip-shaped portion 38*a* along the front lower edge 36*a* of the conductor main body portion 36 is set as a length that is ¼ of an effective wavelength in the frequency band of the GPS antenna 50 (may be set as a length that is substantially ¼ of the effective wavelength).

The other configurations may be considered to be similar to those of Embodiment 1. In Embodiment 5, even when the SDARS antenna 40 and the GPS antenna 50 are arranged in front of the AM/FM antenna 30, disturbance in the directional characteristics of the respective antennas 40 and 50 caused by the presence of both the SDARS antenna 40 and the GPS antenna 50 in the vicinity of the AM/FM antenna 30 can be reduced, excellent directional characteristics close to non-directivity can be secured, and the size of the case 5 can be reduced.

Embodiment 6

Embodiment 6 of the antenna device according to the present invention has a configuration in which the SDARS antenna of Embodiment 1 illustrated in FIG. 1 is arranged in front of the AM/FM antenna and the GPS antenna is additionally provided behind the AM/FM antenna.

Figure 31A:
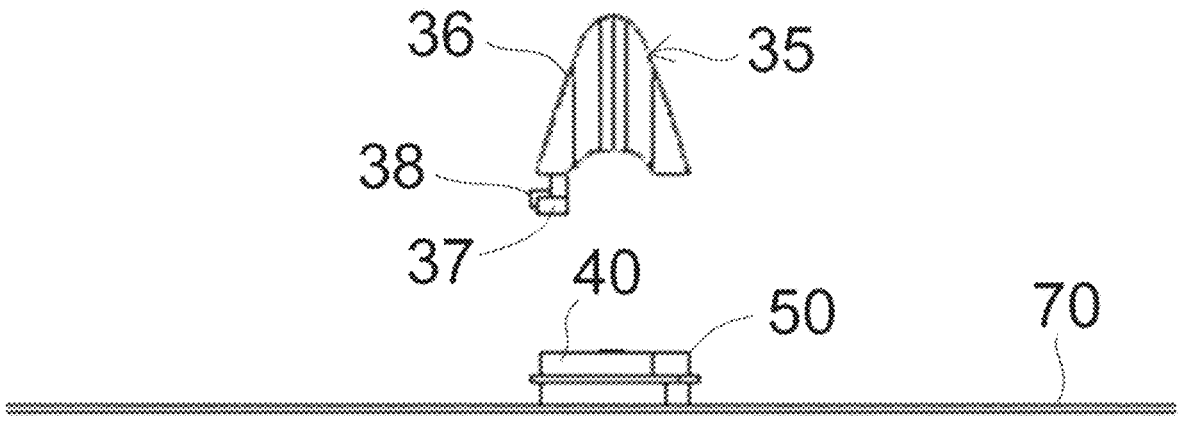
FIG. 31A is a rear view illustrating major structural portions of Embodiment 6 (case where the SDARS antenna is arranged in front of the AM/FM antenna and the GPS antenna is arranged behind the AM/FM antenna).
Figure 31B:
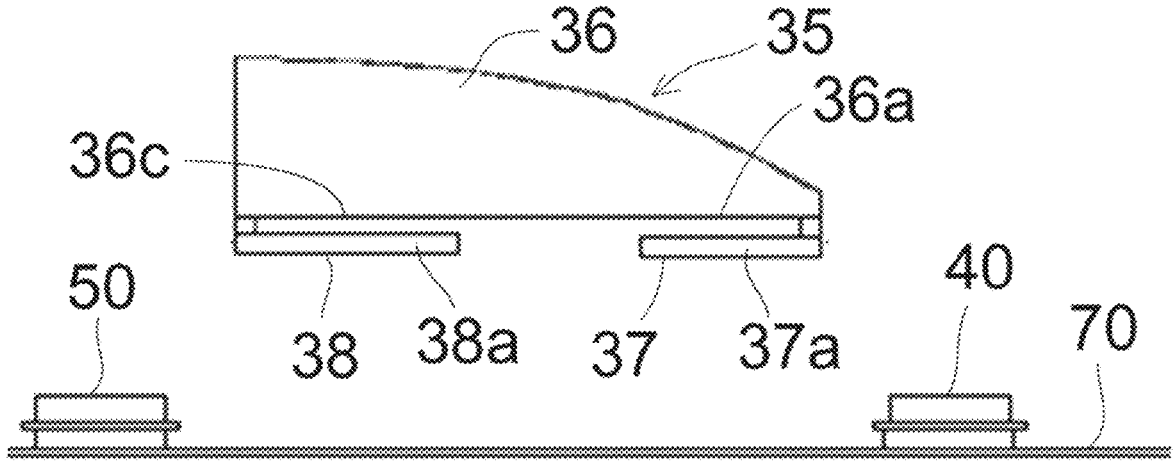
FIG. 31B is a right side view under the same conditions.
Figure 31C:
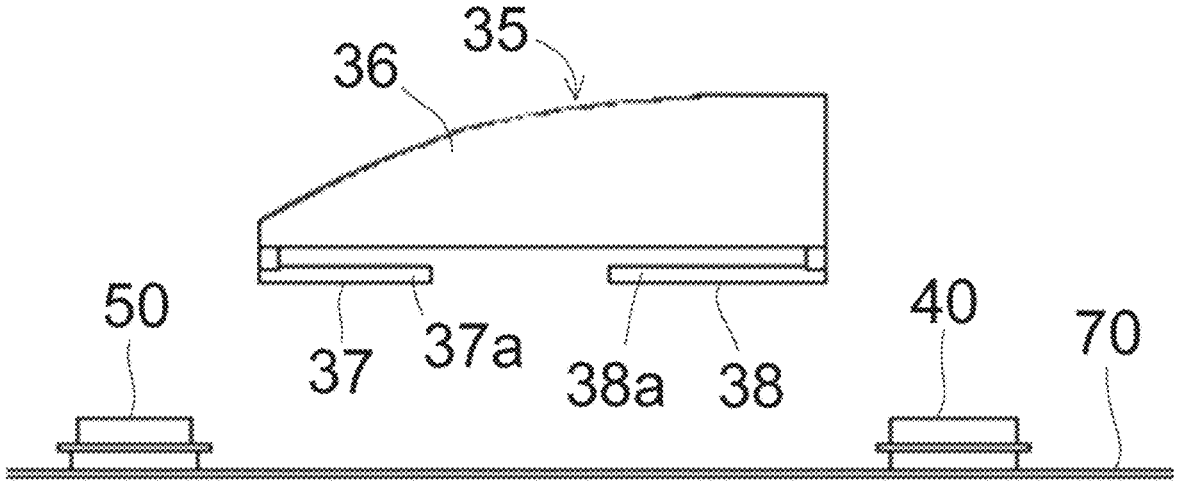
FIG. 31C is a left side view under the same conditions.

FIG. 31A is a rear view (view when the antenna device is seen from the front side) illustrating a model in which major structural portions of Embodiment 6 of the antenna device according to the present invention are arranged on the ground plane 70, and the SDARS antenna is arranged in front of the AM/FM antenna, and the GPS antenna is arranged behind the AM/FM antenna. FIG. 31B is a right side view under the same conditions. FIG. 31C is a left side view under the same conditions. In the antenna device, as illustrated in FIG. 1, the AM/FM antenna 30, the SDARS antenna 40 in front thereof, and the GPS antenna 50 behind the AM/FM antenna 30 are accommodated in an internal space surrounded by the exterior case 5 which is constituted by the base 10 and the cover 20 covering the base (for example, having a shark fin-shape). That is, the SDARS antenna 40, the AM/FM antenna 30, and the GPS antenna 50 are arranged in this order from the front side. Here, the AM/FM antenna 30 corresponds to the first antenna, the SDARS antenna 40 corresponds to the second antenna, and the GPS antenna 50 corresponds to the third antenna.

The capacitively loaded plate 35 formed of a conductor plate includes: the conductor main body portion 36; the additional conductor portion 37 (corresponding to the SDARS antenna 40) including the parallel strip-shaped portion 37*a* extending in parallel to the front lower edge 36*a* of the right side surface of the conductor main body portion 36; and the additional conductor portion 38 (corresponding to the GPS antenna 50) including the parallel strip-shaped portion 38*a* extending in parallel to the rear side lower edge 36*c* of the right side surface of the conductor main body portion 36. The length of the parallel strip-shaped portion 37*a* along the front lower edge 36*a* of the right side surface of the conductor main body portion 36 is set as a length that is ¼ of an effective wavelength in the frequency band of the SDARS antenna 40 (may be set as a length that is substantially ¼ of the effective wavelength). The length of the parallel strip-shaped portion 38*a* along the rear side lower edge 36*c* of the right side surface of the conductor main body portion 36 is set as a length that is ¼ of an effective wavelength in the frequency band of the GPS antenna 50 (may be set as a length that is substantially ¼ of the effective wavelength).

The other configurations may be considered to be similar to those of Embodiment 1. In Embodiment 6, even when the SDARS antenna 40 is arranged in front of the AM/FM antenna 30 and the GPS antenna 50 is arranged behind the AM/FM antenna 30, disturbance in the directional characteristics of the respective antennas 40 and 50 caused by the presence of both the SDARS antenna 40 and the GPS antenna 50 in the vicinity of the AM/FM antenna 30 can be reduced, excellent directional characteristics close to non-directivity can be secured in both of the antennas 40 and 50, and the size of the case 5 can be reduced.

Embodiment 7

Embodiment 7 of the antenna device according to the present invention has a configuration in which the SDARS antenna of Embodiment 1 illustrated in FIG. 1 is arranged behind the AM/FM antenna and the GPS antenna is additionally provided in front of the AM/FM antenna.

Figure 32A:
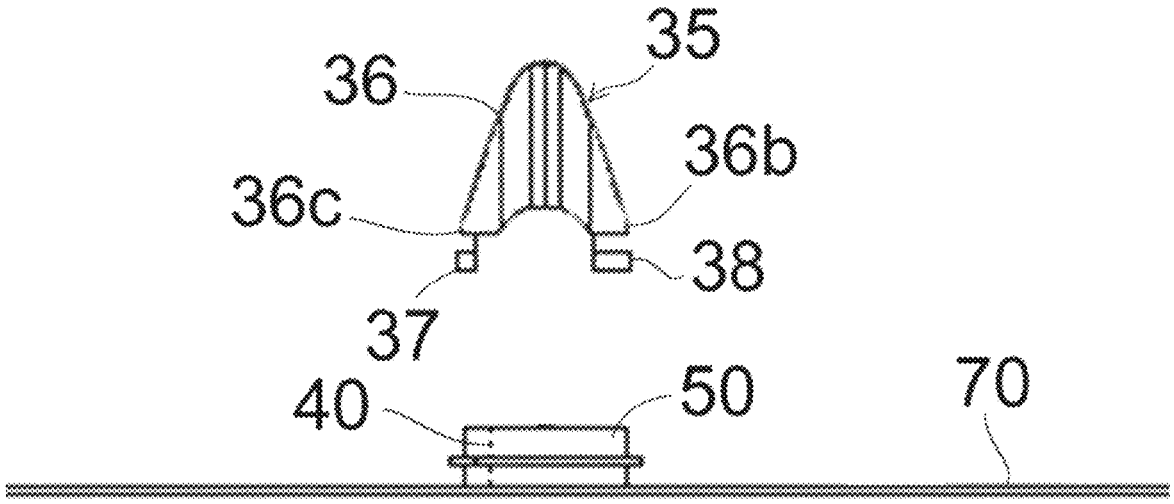
FIG. 32A is a rear view illustrating major structural portions of Embodiment 7 (case where the GPS antenna is arranged in front of the AM/FM antenna and the SDARS antenna is arranged behind the AM/FM antenna).
Figure 32B:
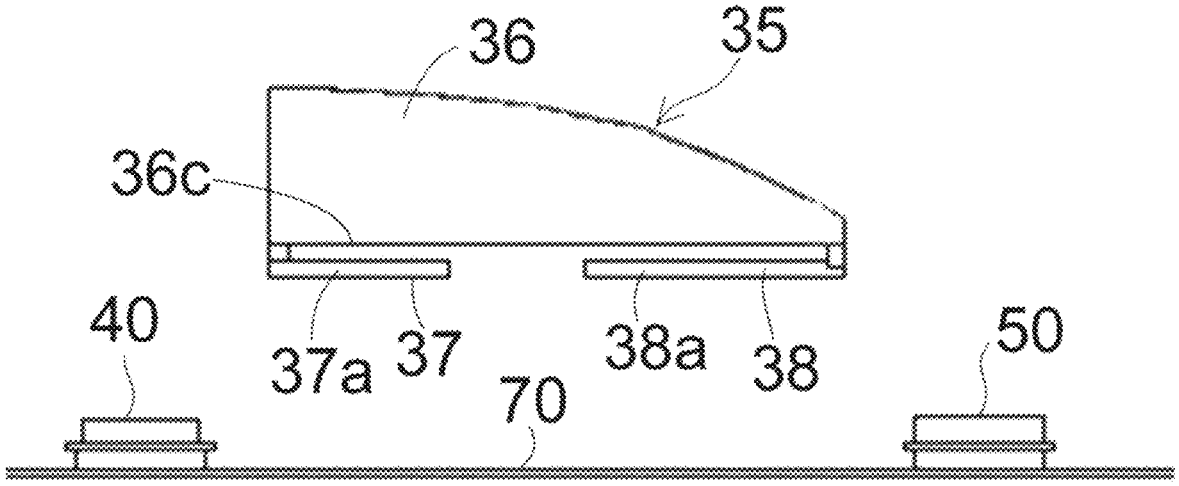
FIG. 32B is a right side view under the same conditions.
Figure 32C:
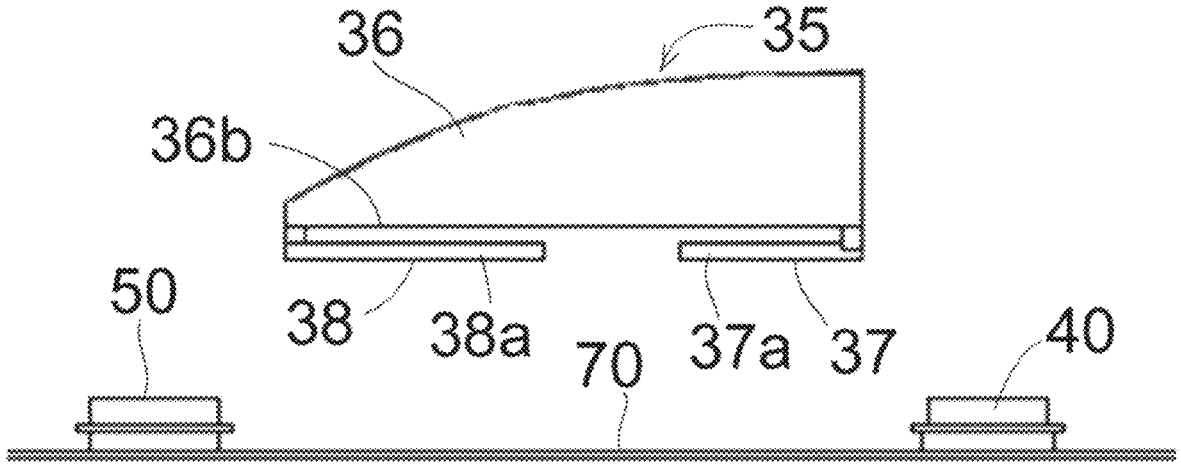
FIG. 32C is a left side view under the same conditions.

FIG. 32A is a rear view (view when the antenna device is seen from the front side) illustrating a model in which major structural portions of Embodiment 7 of the antenna device according to the present invention are arranged on the ground plane 70, and the GPS antenna is arranged in front of the AM/FM antenna and the SDARS antenna is arranged behind the AM/FM antenna. FIG. 32B is a right side view under the same conditions. FIG. 32C is a left side view under the same conditions. In the antenna device, as illustrated in FIG. 1, the AM/FM antenna 30, the GPS antenna 50 in front thereof, and the SDARS antenna 40 behind the AM/FM antenna 30 are accommodated in an internal space surrounded by the exterior case 5 which is constituted by the base 10 and the cover 20 covering the base (for example, having a shark fin-shape). That is, the GPS antenna 50, the AM/FM antenna 30, and the SDARS antenna 40 are arranged in this order from the front side. Here, the AM/FM antenna 30 corresponds to the first antenna, the SDARS antenna 40 corresponds to the second antenna, and the GPS antenna 50 corresponds to the third antenna.

The capacitively loaded plate 35 formed of a conductor plate includes: the conductor main body portion 36; the additional conductor portion 38 (corresponding to the GPS antenna 50) including the parallel strip-shaped portion 38*a* extending in parallel to the front lower edge 36*b* of the left side surface of the conductor main body portion 36; and the additional conductor portion 37 (corresponding to the SDARS antenna 40) including the parallel strip-shaped portion 37*a* extending in parallel to the rear side lower edge 36*c* of the right side surface of the conductor main body portion 36. The length of the parallel strip-shaped portion 38*a* along the front lower edge 36*a* of the left side surface of the conductor main body portion 36 is set as a length that is ¼ of an effective wavelength in the frequency band of the GPS antenna 50 (may be set as a length that is substantially ¼ of the effective wavelength). In addition, the length of the parallel strip-shaped portion 37*a* along the rear side lower edge 36*c* of the right side surface of the conductor main body portion 36 is set as a length that is ¼ of an effective wavelength in the frequency band of the SDARS antenna 40 (may be set as a length that is substantially ¼ of the effective wavelength).

The other configurations may be considered to be similar to those of Embodiment 1. In Embodiment 7, even when the GPS antenna 50 is arranged in front of the AM/FM antenna 30 and the SDARS antenna 40 is arranged behind the AM/FM antenna 30, disturbance in the directional characteristics of the respective antennas 40 and 50 caused by the presence of both the SDARS antenna 40 and the GPS antenna 50 in the vicinity of the AM/FM antenna 30 can be reduced, excellent directional characteristics close to non-directivity can be secured, and the size of the case 5 can be reduced.

Embodiment 8

Figure 33A:
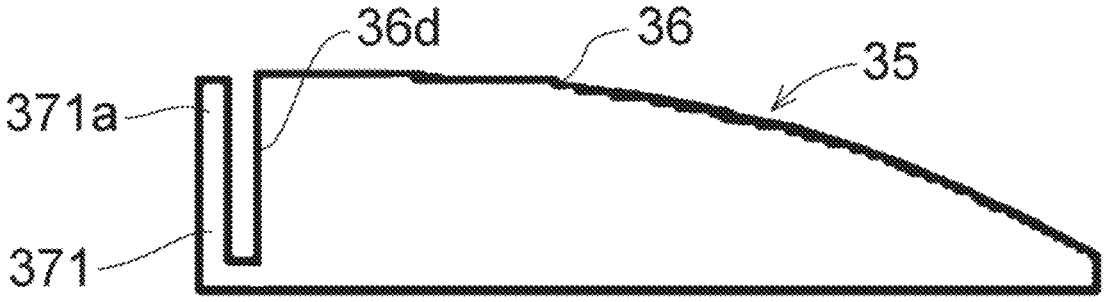
FIG. 33A is a right side view illustrating a configuration of a capacitively loaded plate of the AM/FM antenna according to Embodiment 8.
Figure 33B:
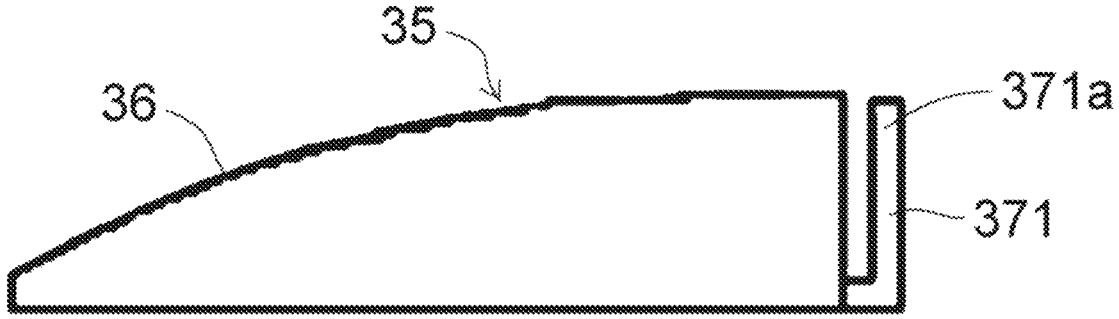
FIG. 33B is a left side view under the same conditions.

FIG. 33A is a right side view illustrating a configuration of a capacitively loaded plate of the AM/FM antenna (first antenna) according to Embodiment 8. FIG. 33B is a left side view under the same conditions. In this case, the capacitively loaded plate 35 formed of a conductor plate includes: the conductor main body portion 36; and an additional conductor portion 371 (corresponding to the second antenna such as the SDARS antenna or the GPS antenna) including a parallel strip-shaped portion 371*a* extending in parallel to face a rear edge 36*d* of the right side surface. The length of the parallel strip-shaped portion 371*a* along the rear edge 36*d* of the right side surface of the conductor main body portion 36 is set as a length that is ¼ of an effective wavelength in the frequency band of the second antenna (may be set as a length that is substantially ¼ of the effective wavelength). Configurations other than the configuration of the capacitively loaded plate are similar to those of Embodiment 1.

The configuration of Embodiment 8 is effective when a region having a high electric field of the conductor main body portion 36 in the frequency band of the second antenna is in the vicinity of the rear edge 36*d* of the right side surface of the conductor main body portion 36 and the parallel strip-shaped portion 371*a* is arranged to face the rear edge 36*d*. That is, disturbance in directional characteristic caused by the presence of the second antenna in the vicinity of the AM/FM antenna can be reduced.

Embodiment 9

Figure 34A:
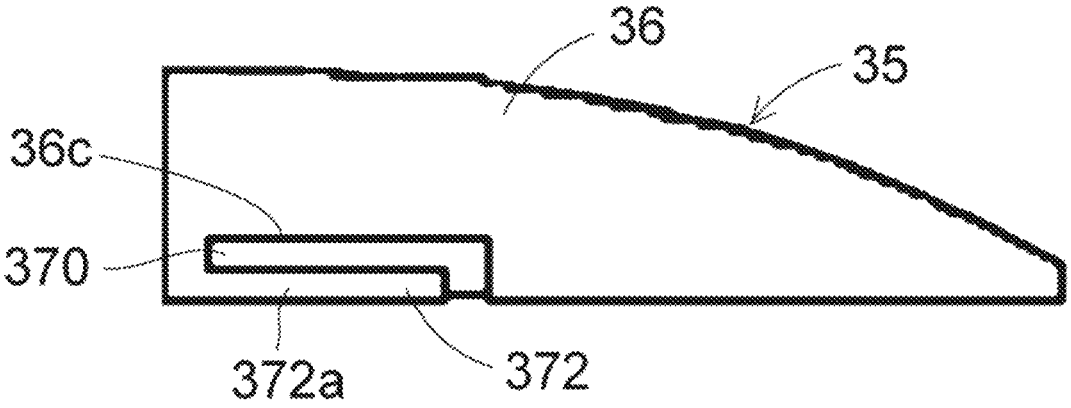
FIG. 34A is a right side view illustrating a configuration of a capacitively loaded plate of the AM/FM antenna according to Embodiment 9.
Figure 34B:
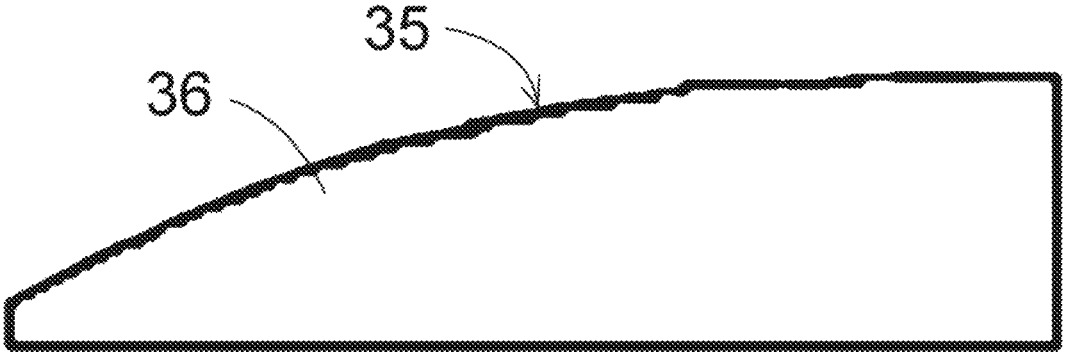
FIG. 34B is a left side view under the same conditions.

FIG. 34A is a right side view illustrating a configuration of a capacitively loaded plate of the AM/FM antenna (first antenna) according to Embodiment 9. FIG. 34B is a left side view under the same conditions. In this case, the capacitively loaded plate 35 formed of a conductor plate includes: the conductor main body portion 36; and an additional conductor portion 372 (corresponding to the second antenna such as the SDARS antenna or the GPS antenna) including a parallel strip-shaped portion 372*a* extending in parallel to face the rear side lower edge 36*c* of the right side surface of the conductor main body portion 36. Here, the additional conductor portion 372 is formed to be positioned further inside of the lower edge of the conductor main body portion 36. For example, by separating a part of the conductor main body portion 36 using an inverted L-shaped notch 370, the additional conductor portion 372 integrated with the conductor main body portion 36 can be formed. The length of the parallel strip-shaped portion 372*a* along the rear side lower edge 36*c* of the right side surface of the conductor main body portion 36 is set as a length that is ¼ of an effective wavelength in the frequency band of the second antenna (may be set as a length that is substantially ¼ of the effective wavelength). Configurations other than the configuration of the capacitively loaded plate are similar to those of Embodiment 1.

The configuration of Embodiment 9 is effective when a region having a high electric field of the conductor main body portion 36 in the frequency band of the second antenna is in the vicinity of the rear side lower edge 36*c* of the right side surface of the conductor main body portion 36 and the parallel strip-shaped portion 372*a* is arranged to face the rear side lower edge 36*c*. That is, disturbance in directional characteristic caused by the presence of the second antenna in the vicinity of the AM/FM antenna can be reduced.

Embodiment 10

Figure 35A:
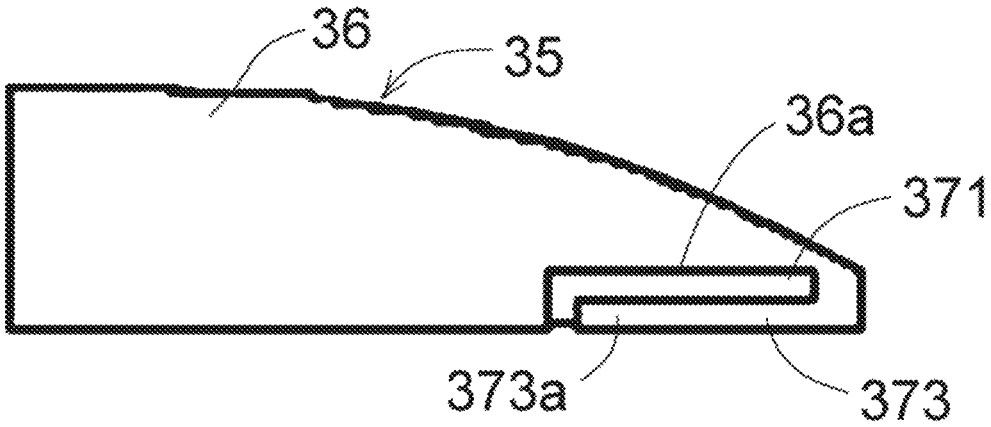
FIG. 35A is a right side view illustrating a configuration of a capacitively loaded plate of the AM/FM antenna according to Embodiment 10.
Figure 35B:
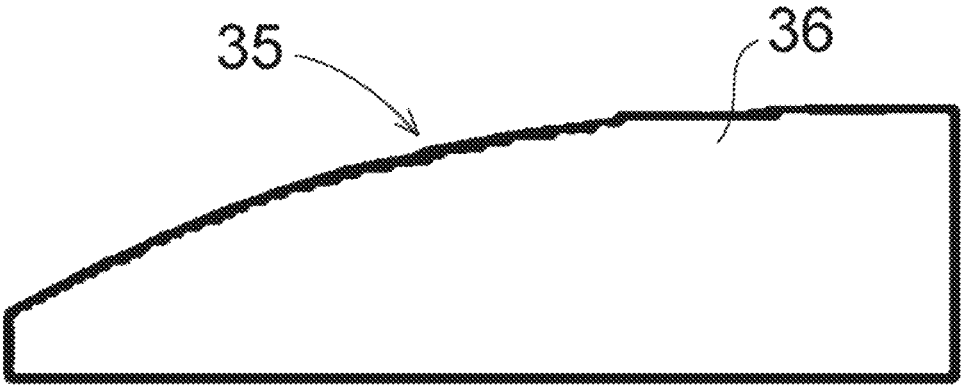
FIG. 35B is a left side view under the same conditions.

FIG. 35A is a right side view illustrating a configuration of a capacitively loaded plate of the AM/FM antenna (first antenna) according to Embodiment 10. FIG. 35B is a left side view under the same conditions. In this case, the capacitively loaded plate 35 formed of a conductor plate includes: the conductor main body portion 36; and an additional conductor portion 373 (corresponding to the second antenna such as the SDARS antenna or the GPS antenna) including a parallel strip-shaped portion 373*a* extending in parallel to face the front lower edge 36*a* of the right side surface of the conductor main body portion 36. Here, the additional conductor portion 373 is formed to be positioned further inside of the lower edge of the conductor main body portion 36. For example, by separating a part of the conductor main body portion 36 using an inverted L-shaped notch 371, the additional conductor portion 373 integrated with the conductor main body portion 36 can be formed. The length of the parallel strip-shaped portion 373*a* along the front lower edge 36*a* of the right side surface of the conductor main body portion 36 is set as a length that is ¼ of an effective wavelength in the frequency band of the second antenna (may be set as a length that is substantially ¼ of the effective wavelength). Configurations other than the configuration of the capacitively loaded plate are similar to those of Embodiment 1.

The configuration of Embodiment 10 is effective when a region having a high electric field of the conductor main body portion 36 in the frequency band of the second antenna is in the vicinity of the front lower edge 36*a* of the right side surface of the conductor main body portion 36 and the parallel strip-shaped portion 373*a* is arranged to face the front lower edge 36*a*. That is, disturbance in directional characteristics caused by the presence of the second antenna in the vicinity of the AM/FM antenna can be reduced.

Hereinabove, the present invention has been described using the embodiments as examples. However, it is understood by those skilled in the art that the respective components or the respective treatment processes of the embodiments can be modified in various ways within the scope described in the claims. Hereinafter, modification examples will be simply described.

In each of the embodiments of the present invention, the AM/FM antenna is used as an example of the first antenna, and the SDARS antenna or the GPS antenna is used as an example of the second antenna having a frequency band different from that of the first antenna. However, the present invention is also applicable to a case where antennas having different frequency bands are combined.

The position where the additional conductor portion is extended out from the conductor main body portion of the first antenna is appropriately modifiable according to the positional relationship between the first antenna and the second antenna, and is not limited to the arrangement of each of the embodiments.

REFERENCE SIGNS LIST

1: antenna device
5: exterior case
7: attachment bracket
10: base
20: cover
30: AM/FM antenna
31, 35: capacitively loaded plate
32: coil element
36: conductor main body portion
37, 38, 371, 372, 373: additional conductor portion
37*a*, 38*a*, 371*a*, 372*a*, 373*a*: parallel strip-shaped portion
39: connection portion
40: SDARS antenna
50: GPS antenna
60: circuit board
70: ground plane

The invention claimed is:

1. An antenna device comprising a first antenna and a second antenna that are provided in a common case and have different frequency bands, wherein an additional conductor portion extends out from a conductor main body portion of the first antenna, the additional conductor portion includes a predetermined-length portion extending at a distance along and parallel to an edge of the conductor main body portion and having a predetermined length corresponding to a frequency band of the second antenna, and the additional conductor portion facilitates a state of directionality of the second antenna by current of the additional conductor portion offsetting current of the first antenna.

2. The antenna device according to claim 1, wherein the predetermined-length portion of the additional conductor portion is arranged to correspond to a region having a high electric field of the conductor main body portion in the frequency band of the second antenna.

3. The antenna device according to claim 1, wherein the predetermined-length portion of the additional conductor portion has a length that is substantially 1/4 of an effective wavelength in the frequency band of the second antenna.

4. The antenna device according to claim 1, wherein a separation distance between the first antenna and the second antenna in a horizontal direction is substantially within 1/2 of a wavelength in the frequency band of the second antenna.

5. The antenna device according to claim 1, wherein the second antenna is omnidirectional in a horizontal plane, and a difference between a maximum gain and a minimum gain of the second antenna at a predetermined elevation angle is small as compared with a case where the additional conductor portion is not present.

6. The antenna device according to claim 1, further comprising a third antenna that is provided in the case, wherein the third antenna has a frequency band different from the frequencies of the first antenna and the second antenna, another additional conductor portion extends out from the conductor main body portion, and said another additional conductor portion includes a predetermined-length portion extending at a distance along an edge of the conductor main body portion and having a predetermined length corresponding to the frequency band of the third antenna.

7. The antenna device according to claim 6, wherein the predetermined-length portion of said another additional conductor portion is arranged to correspond to a region having a high electric field of the conductor main body portion in the frequency band of the third antenna.

8. The antenna device according to claim 6, wherein the predetermined-length portion of the other additional conductor portion has a length that is substantially 1/4 of an effective wavelength in the frequency band of the third antenna.

9. The antenna device according to claim 6, wherein a separation distance between the first antenna and the third antenna in a horizontal direction is substantially within 1/2 of a wavelength in the frequency band of the third antenna.

10. The antenna device according to claim 6, wherein the third antenna is omnidirectional in a horizontal plane, and a difference between a maximum gain and a minimum gain of the third antenna at a predetermined elevation angle is small as compared with a case where the additional conductor portion is not present.

11. The antenna device according to claim 1, wherein the additional conductor portion is a separate component from the conductor main body portion and is fixed to or integrated with the conductor main body portion.

12. The antenna device according to claim 1, wherein the first antenna is an AM/FM antenna, and a capacitive element of the AM/FM antenna includes the conductor main body portion and the additional conductor portion.

13. The antenna device according to claim 1, wherein the conductor main body portion extends in a horizontal direction, and the additional conductor portion extends in the horizontal direction or a vertical direction from a vicinity of an end portion of the conductor main body portion toward an outside thereof.

14. The antenna device according to claim 1, wherein the first antenna includes the conductor main body portion and the additional conductor portion.

15. The antenna device according to claim 1, wherein the additional conductor portion is provided between the first antenna and the second antenna.

16. The antenna device according to claim 1, wherein the additional conductor portion extends in parallel with the edge of the conductor main body portion.

17. The antenna device according to claim 1, wherein the second antenna is a satellite-type antenna.

18. The antenna device according to claim 1, wherein the additional conductor portion reduces a variation in directivity of the second antenna.

19. The antenna device according to claim 1, wherein the additional conductor portion is formed in a strip shape which extends in parallel with the edge of the conductor main body portion.

20. The antenna device according to claim 1, wherein the additional conductor portion includes an interconnection portion that connects to the conductor main body portion, in a vicinity of an end portion of the additional conductor portion.

* * * * *